US008587628B2

(12) United States Patent
Nagumo

(10) Patent No.: US 8,587,628 B2
(45) Date of Patent: Nov. 19, 2013

(54) DRIVER APPARATUS, PRINT HEAD, AND IMAGE FORMING APPARATUS

(75) Inventor: Akira Nagumo, Takasaki (JP)

(73) Assignee: Oki Data Corporation, Tokyo (JP)

( * ) Notice: Subject to any disclaimer, the term of this patent is extended or adjusted under 35 U.S.C. 154(b) by 84 days.

(21) Appl. No.: 13/218,652

(22) Filed: Aug. 26, 2011

(65) Prior Publication Data

US 2012/0050450 A1 Mar. 1, 2012

(30) Foreign Application Priority Data

Aug. 30, 2010 (JP) ..... 2010-192277
Aug. 31, 2010 (JP) ..... 2010-193414

(51) Int. Cl.

| | |
|---|---|
| ***B41J 2/385*** | (2006.01) |
| ***B41J 2/47*** | (2006.01) |
| ***B41J 2/45*** | (2006.01) |
| ***B41J 2/435*** | (2006.01) |

(52) U.S. Cl.

USPC ..... 347/237; 347/130; 347/132; 347/238; 347/247

(58) Field of Classification Search

None

See application file for complete search history.

(56) References Cited

U.S. PATENT DOCUMENTS

| | | | | |
|---|---|---|---|---|
| 2003/0173979 | A1 * | 9/2003 | Maeshima et al. | 324/649 |
| 2004/0046976 | A1 * | 3/2004 | Ohno et al. | 358/1.8 |
| 2010/0045763 | A1 * | 2/2010 | Tsuchiya | 347/130 |
| 2010/0134147 | A1 * | 6/2010 | Ohta et al. | 326/83 |

FOREIGN PATENT DOCUMENTS

JP 2004-195796 A 7/2004

* cited by examiner

*Primary Examiner* — Matthew Luu
*Assistant Examiner* — Kendrick Liu
(74) *Attorney, Agent, or Firm* — Panitch Schwarze Belisario & Nadel LLP

(57) ABSTRACT

A driver apparatus drives light emitting elements connected to a common terminal. A clock driver outputs first and second pulses to first and second output terminals, respectively, alternately. A differentiating circuit includes an inductor and a resistor, and differentiates the first and second pulses to produce first and second clocks, respectively. A data driver circuit outputs a data signal to the common terminal in response to an ON/OFF command signal. A scanning circuit starts to operate in response to a starting signal such that the cascaded sub scanning stages turn on in sequence one at a time. A sub scanning stage turns on in response to the second clock, outputting a drive signal to a corresponding one of the light emitting elements. The light emitting elements emit light only when the drive signal and the ON/OFF command signal are fed to the light emitting elements.

28 Claims, 21 Drawing Sheets

CK1R
CK1
t3
t4
t8
b
Vp
VDD

CK2
CK2R
CK1
CK1R
94
93
92
91
90
I1
I2
I3
111B-2
120B-2
111B-1
120B-1
GND
70
VDD
84-2a
84-2
82-2
80-2
81-2
83-2
85-2
85-2a
C2
S69-2
84-1a
84-1
82-1
80-1
81-1
83-1
85-1
85-1a
C1
S69-1
S
D

CK2R
CK2
t4
t5
Vp
d
GND
VDD
111-2
111-1
130-2
150
CK1
93
94
91
92
I3
I2
I1
CK1R
CK2R
90
70
84-1a
84-2a
85-1a
85-2a
84-1
84-2
85-1
85-2
82-1
82-2
83-1
83-2
81-1
81-2
80-1
80-2
C1
C2
S69-1
S69-2

CK2R
CK2
t4
t5
d
Vp
VDD
I3
I2
I1
CK2
CK1
CK2R
CK1R
94
93
92
91
90
70
150B
130B-2
111B-2
111B-1
VDD
GND
S
D
84-2a
84-2
84-1a
84-1
85-2a
85-2
85-1a
85-1
82-2
83-2
81-2
80-2
82-1
83-1
81-1
80-1
C2
S69-2
C1
S69-1

DRIVER APPARATUS, PRINT HEAD, AND IMAGE FORMING APPARATUS

BACKGROUND OF THE INVENTION

1. Field of the Invention

The present invention relates a driver apparatus for driving a plurality of light emitting elements, a print head that incorporates the driver apparatus, and an image forming apparatus that employs the print head.

2. Description of the Related Art

Some existing image forming apparatus such as an electrophotographic printer employ an exposing unit in which a plurality of light emitting thyristors are aligned. A single driver circuit drives a group of light emitting thyristors. A drive signal is applied to the gate of a light emitting thyristor that should emit light, thereby causing current to flow from anode to cathode to emit light.

One known print head using light emitting thyristors is a self-scanning light emitting print head. For example, a power supply voltage of 3.3 V is not enough to trigger the gate of the light emitting thyristors. Therefore, a transfer clock signal is passed through a circuit that causes an undershoot voltage on the waveform of the transfer clock signal. Then, the power supply voltage of 3.3 V is added to the undershoot voltage to provide a signal capable of triggering the gate.

For example, Japanese Patent Application Publication No. 2004-195796 discloses the following technique. A transfer clock is outputted from a first output terminal of a clock driver, and is passed through a CR differentiation circuit to generate a waveform with undershoot. Then, the undershoot waveform is added to the output from a second output terminal in order to add a direct current component. The second output terminal is necessary to provide a direct current component since the CR differentiation circuit fails to provide a direct current component.

The above-mentioned conventional self-scanning light emitting print head requires a clock driver having two output terminals and therefore suffers from the following drawbacks.

In order to implement high speed operation, a print head incorporate a plurality of chips of self-scanning thyristor array that operate simultaneously in parallel. The data transfer clock for the arrays is a two-phase clock that feeds two clock pulses to each array chip. This implies that a clock driver for the self-scanning print head requires four output terminals for driving a single array chip.

The print head incorporates multiple self-scanning thyristor array chips, and therefore the clock driver must have a large number of output terminals. This leads to a large scale integrated circuit having a large number of terminals. However, a large scale integrated circuit is limited in the number of terminals that can be formed therein. If only a limited number of terminals are to be accommodated in a large scale integrated circuit, then the clock driver must drive a large number of chips in parallel. This heavy load causes the waveform of the clock to be distorted. As a result, the print head cannot operate at high speed.

The same is true for a self-scanning print head that uses light emitting diodes.

There is a need for an LSI circuit configuration of self-scanning light emitting array chips that can be driven by clock signals through as small a number of terminals as possible.

SUMMARY OF THE INVENTION

The present invention was made to solve the aforementioned drawbacks.

An object of the invention is to provide a driver apparatus for driving a plurality of light emitting elements.

Another object is to provide a driver apparatus that requires a smaller number of terminals than conventional driver apparatus.

Still another object of the invention is to provide a driver apparatus capable of transferring data at higher speed.

Yet another object of the invention is to provide a low cost driver apparatus.

Further object of the invention is to provide a print head that employs the driver apparatus.

Further object of the invention is to provide an image forming apparatus that employs the print head.

A driver apparatus drives a plurality of light emitting elements connected to a common terminal. A clock driver is configured to output a first pulse to a first output terminal and a second pulse to a second output terminal. The first pulse and the second pulse are produced based on a scanning square signal, and outputted alternately. A differentiating circuit is formed of an inductor and a resistor, and differentiates the first pulse to produce a first clock and differentiates the second pulse to produce a second clock. The first clock is outputted from the differentiating circuit to a first clock terminal. The second clock is outputted from the differentiating circuit to a second clock terminal. A data driver circuit outputs a data signal to the common terminal in response to an ON/OFF command signal. A scanning circuit includes a plurality of cascaded sub scanning stages, the scanning circuit starts to operate in response to a starting signal such that the cascaded sub scanning stages turn on in sequence one at a time. An odd-numbered sub scanning stage turns on in response to the first clock, outputting a drive signal to a corresponding one of the light emitting elements. An even-numbered sub scanning stage turns on in response to the second clock, outputting a drive signal to a corresponding one of the light emitting elements. The light emitting elements emit light only when the driving signal and the ON/OFF command signal are fed to the light emitting elements.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Outline of Image Forming Apparatus

Figure 1:
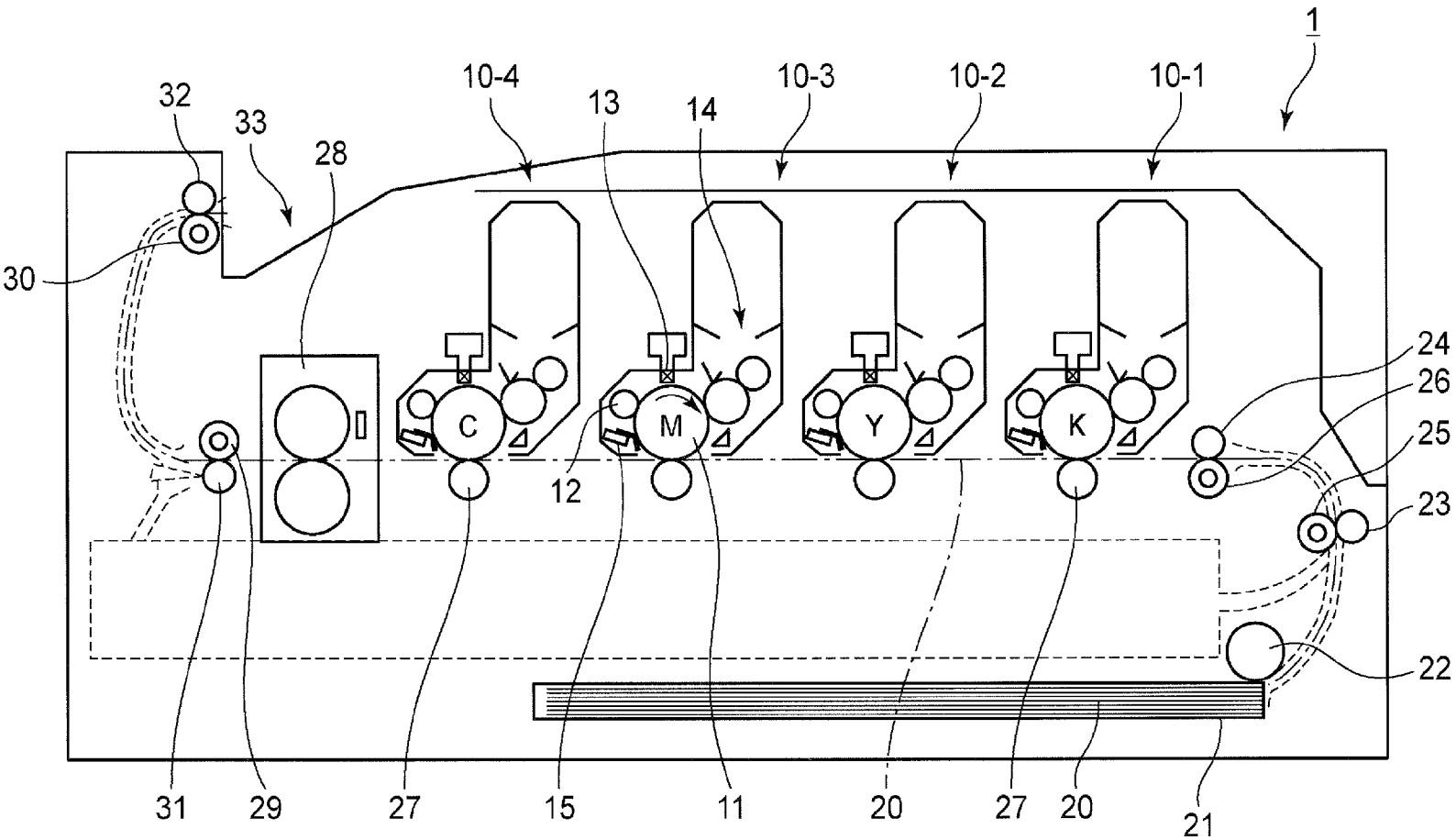
FIG. 1 illustrates the outline of an image forming apparatus according to the invention.

FIG. 1 illustrates the outline of an image forming apparatus according to a first embodiment.

The image forming apparatus 1 is an electrophotographic color printer that employs an exposing unit constituted of light emitting elements, e.g., three-terminal thyristors. The image forming apparatus 1 includes four process units 10-1 to 10-4 that form black (K), yellow (Y), magenta (M), and cyan (C) images, respectively. The four process units are aligned from upstream to downstream of a transport path of a recording medium, e.g., paper 20. Each of the process units may be substantially identical; for simplicity only the operation of the process unit 10-3 for forming cyan images will be described, it being understood that the other process units may work in a similar fashion.

The process unit 10-3 includes a photoconductive drum 11 rotatable in a direction shown by arrow A. A charging unit 12, an exposing unit (e.g., an optical print head 13), a developing unit 14, and a cleaning device 15 are disposed in this order around the photoconductive drum 11. The charging unit 12 charges the surface of the photoconductive drum 11. The exposing unit 13 selectively illuminates the charged surface of the photoconductive drum 11 to form an electrostatic latent image. The developing unit 14 deposits magenta toner to the electrostatic latent image formed on the photoconductive drum 11 to form a toner image. The cleaning device 15 removes toner remaining on the photoconductive drum 11 after transferring the toner image onto the paper 20. A drive source (not shown) drives the photoconductive drum 11 and a variety of rollers in rotation via a gear train.

A paper cassette 21, which holds a stack of paper 20 therein, is disposed at a lower portion of the image forming apparatus 1. A hopping roller 22 is disposed over the paper cassette 21, and feeds the paper 20 on a sheet-by-sheet basis into the transport path. A transport roller 25 cooperates with a pinch roller 23 to hold the paper 20 in a sandwiched relation. A registry roller 26 cooperates with a pinch roller 24 to correct the skew of the paper 20, and transports the paper 20 to the process unit 10-1. The discharge roller 25 and registry roller 26 are disposed downstream of the hopping roller 22. A drive source (not shown) drives the hopping roller 22, discharge roller 25, and registry roller 26 in rotation via a gear train.

Transfer units 27 are formed of, for example, a semi-conductive rubber material, and parallel the photoconductive drums 11 of the process units 10-1 to 10-4. When the toner images formed on the photoconductive drums 11 are transferred onto the paper 20, the transfer units 27 receive voltages so that a potential difference is created across each transfer unit 27 and the surface of a corresponding photoconductive drum 11.

A fixing unit 28 is located downstream of the process unit 10-4, and includes a heat roller, which incorporates a heater therein, and a pressure roller. When the paper 20 passes through the gap between the pressure roller and the heat roller, the toner image on the paper 20 is fixed under heat and pressure. Discharge rollers 29 and 30, discharge pinch rollers 31 and 32, and a paper stacker 33 are located downstream of the fixing unit 28. The discharge rollers 29 and 30 cooperate with the pinch rollers 31 and 32 to hold the paper 20 in a sandwiched relation, and transport the paper 20 to the paper stacker 33. The heat roller, pressure roller, and discharge rollers 29 and 30 are driven in rotation by a drive power transmitted via, for example, a gear train from a drive source (not shown).

The image forming apparatus 1 operates as follows:

The hopping roller 22 feeds the paper 20 into the transport path from the paper cassette 21 on a sheet-by-sheet basis. The paper 20 is held by the transport roller 25, registry roller 26, and pinch rollers 23 and 24 in a sandwiched relation, and is transported into a transfer point defined between the photoconductive drum 11 of the process unit 10-1 and the transfer unit 27. As the photoconductive drum 11 rotates, the paper 20 is further transported through the transfer point so that the toner image on the photoconductive drum 11 is transferred onto the paper 20. Likewise, the paper 20 is transported through the remaining process units 10-2 to 10-4 so that the toner images of corresponding colors are transferred onto the paper 20 in registration.

When the paper 20 passes through the fixing unit 28, the toner images carried on the paper 20 are fixed. The paper 20 is further transported by the discharge rollers 29 and 30 and pinch rollers 31 and 32 to the paper stacker 33 defined on the outer wall of the image forming apparatus 1. This completes printing.

{Construction of Optical Print Head}

Figure 2:
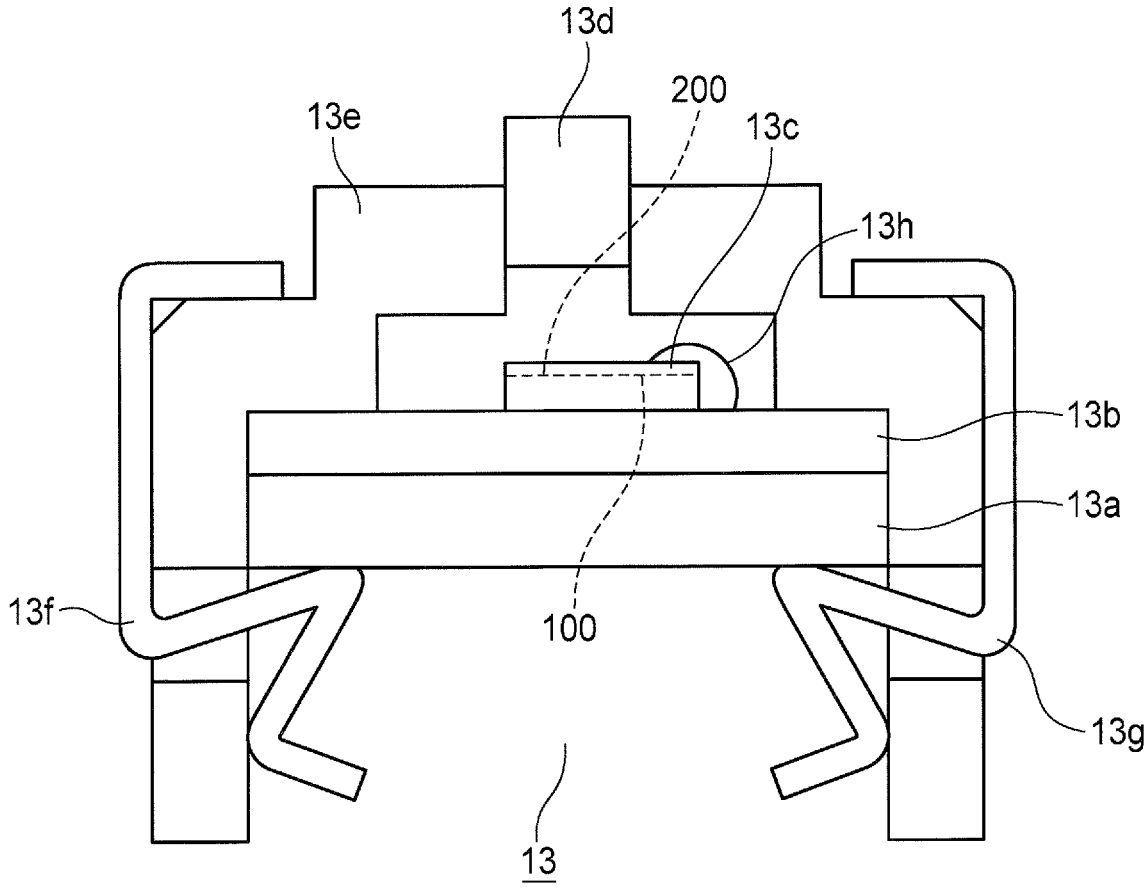
FIG. 2 is a cross-sectional view of the optical print head shown in FIG. 1.
Figure 3:
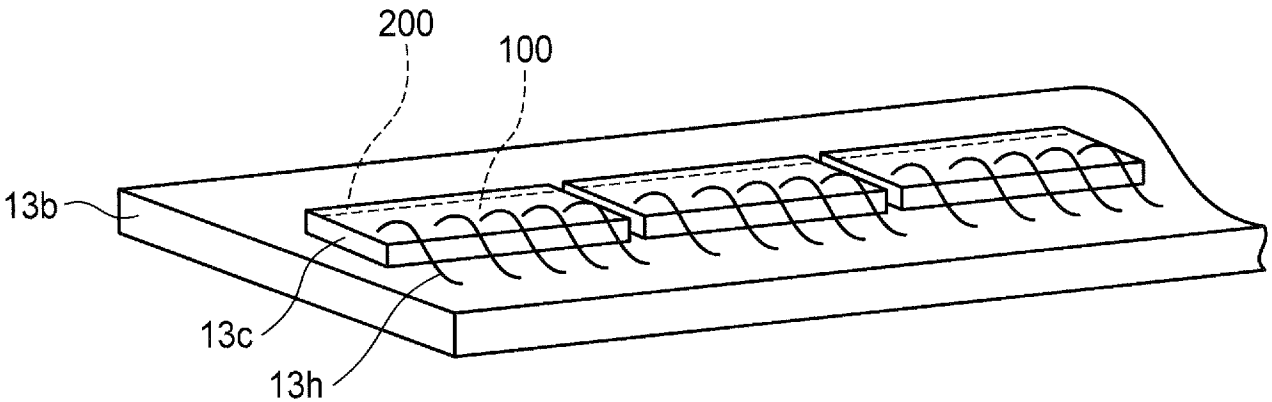
FIG. 3 is a perspective view of the print circuit board shown in FIG. 2.

FIG. 2 is a cross-sectional view of the optical print head 13 shown in FIG. 1. FIG. 3 is a perspective view of a print circuit board shown in FIG. 2.

The optical print head 13 includes a base 13*a* and a printed wiring board 13*b* fixed on the base 13*a*. The printed wiring board 13*b* carries a plurality of semiconductor chips 13*c* mounted by means of, for example, thermosetting resin. A plurality of light emitting thyristor arrays 200 and the driver ICs are disposed on the chip 13*c*. The light emitting thyristor arrays 200 are electrically connected to the driver ICs by means of thin film wirings, and the driver ICs are electrically connected to the wiring pads of the printed wiring board 13*b* by bonding wires 13*h*.

A rod lens array 13*d*, which incorporates a plurality of columns of optical elements, is located over the driver ICs. The rod lens array 13*d* is fixedly supported by a holder 13*e*. Clamp members 13*g* and 13*f* firmly hold the base 13*a*, printed wiring board 13*b*, and holder 13*e* together.

{Printer Controller}

Figure 4:
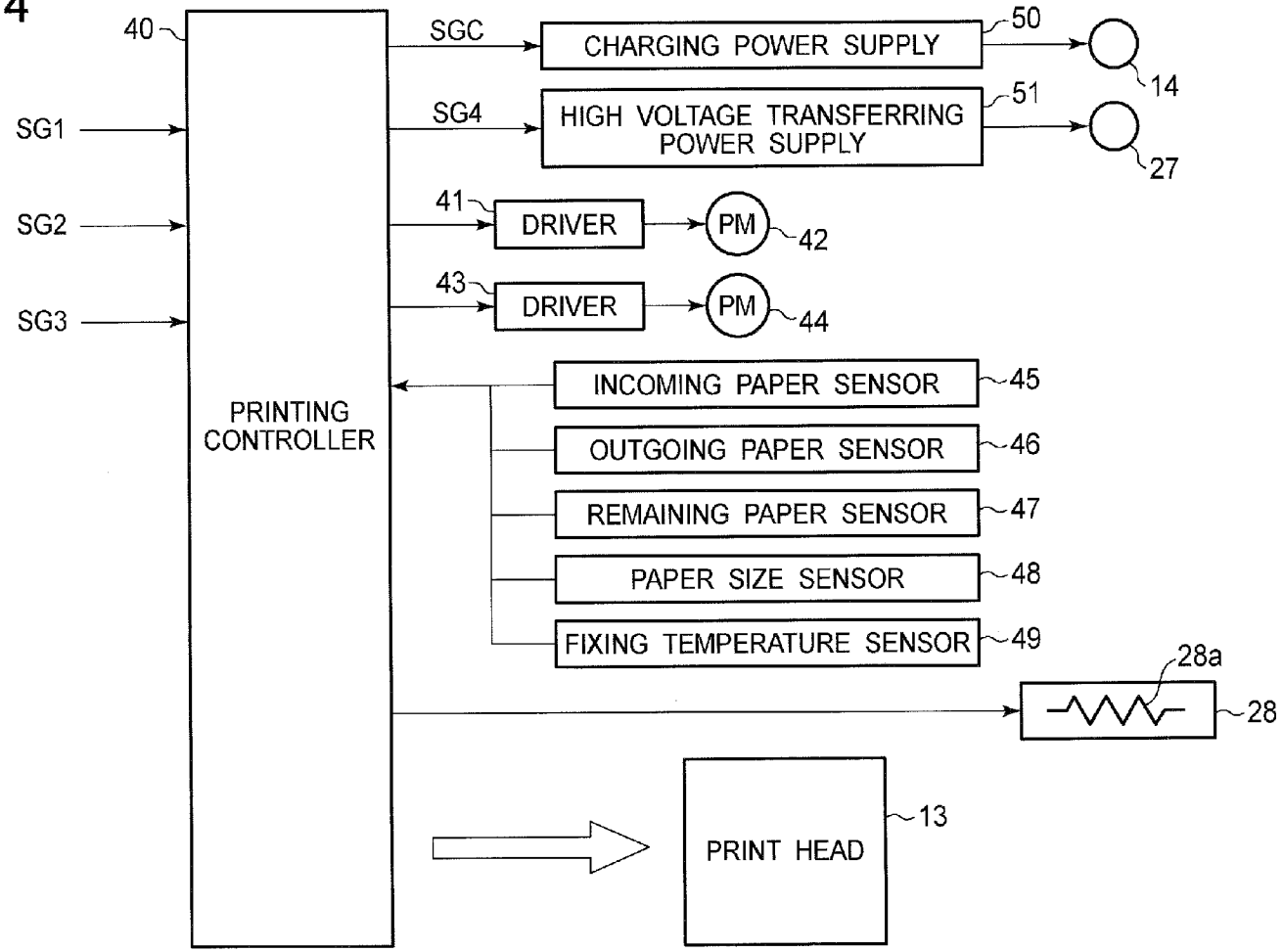
FIG. 4 is a block diagram illustrating the configuration of a printer controller for use in the image forming apparatus shown in FIG. 1.

FIG. 4 is a block diagram illustrating the configuration of a printer controller for use with the image forming apparatus 1 shown in FIG. 1.

The printer controller includes a printing controller 40 located in a printing section of the image forming apparatus 1. The printing controller 40 mainly includes a microprocessor, a read only memory (ROM), a random access memory (RAM), an input/output port, and a timer. The printing controller 40 receives a control signal SG1 and a video signal (bit map data arranged in a straight line) SG2 from an image processing section (not shown) to perform sequential control of the overall operation of the image forming apparatus 1 for printing. The printing controller 40 is connected to the four optical print heads 13 of the process units 10-1 to 10-4, a heater 28*a* of the fixing unit 28, drivers 41 and 43, an incoming paper sensor 45, an outgoing paper sensor 46, a remaining paper sensor 47, a paper size sensor 48, a fixing temperature sensor 49, a high voltage charging power supply 50, and a high voltage transferring power supply 51. The driver 41 is connected to a developing/transferring process motor (PM) 42. The driver 43 is connected to a paper transporting motor (PM) 44. The high voltage charging power supply 50 is connected to the developing unit 14. The high voltage transferring power supply 51 is connected to transfer units 27.

The printing controller 40 operates as follows:

Upon reception of the control signal SG1 to command printing from the image processing section, the printing controller 40 determines by means of the temperature sensor 49 whether the heat roller in the fixing unit 28 is in a usable temperature range. If the heat roller is not within the usable temperature range, the printing controller 40 supplies electric power to the heater 28*a* to heat the heat roller to the usable temperature. The printing controller 40 then causes the driver 41 to rotate the developing/transfer process motor 42, and also outputs a charging signal SGC to turn on the high voltage charging power supply 50, thereby charging the developing unit 14.

Then, the remaining paper sensor 47 detects whether the paper 20 is present in the paper cassette (FIG. 1) and the paper size sensor 48 detects the size of the paper 20. Thus, the paper 20 of the right size is fed to the transport path. The paper transporting motor 44 is adapted to rotate in the forward and reverse directions. Switching the rotation direction of the paper transporting motor 44 allows switching of the rotation directions of the transport rollers 25.

When printing on one page of paper is started, the paper transporting motor 44 is rotated in the reverse direction, thereby transporting the paper 20 by a predetermined amount until the incoming paper sensor 45 detects the paper 20. The paper transporting motor 44 is then rotated in the forward direction to transport the paper 20 into a print engine of the image forming apparatus 1.

When the paper 20 reaches a position where printing can be performed, the printing controller 40 provides a timing signal SG3 including a main scanning sync signal and a sub scanning sync signal to an image processing section (not shown), and receives the video signal SG2. The video signal SG2 is edited on a page-by-page basis in the image processing section, and is received by the printing controller 40. The video signal SG2 is then transferred as print data to the respective optical print heads 13. Each of the optical print heads 13 incorporates the scanning circuits 100 and a plurality of light emitting thyristor arrays 200 driven by the scanning circuits 100, each light emitting thyristor forming a dot or pixel of an image.

The video signal SG2 is transmitted and received on a line-by-line basis. The optical print head 13 illuminates the negatively charged surface of the photoconductive drum 11 to form an electrostatic latent image formed of dots having increased potential due to exposure to light. The toner is negatively charged in the developing unit 14 and is then attracted to the dots formed on the photoconductive drum 11 by the Coulomb force, thereby forming a toner image.

The toner image on the photoconductive drum 11 is then transported to the transfer point defined between the photoconductive drum 1 and the transfer unit 27. A transfer signal SG4 causes the high voltage transfer power supply 51 to turn on to apply a positive voltage to the transfer unit 27. As the paper 20 passes through the transfer point, the toner image is transferred onto the paper 20. The paper 20 then carries the toner image thereon and subsequently passes through the fixing point defined between the heat roller and pressure roller of the fixing unit 28, so that the toner image is fixed under heat and pressure. The paper 20 is then further transported past the outgoing paper sensor 46 to the outside of the printer.

In response to the detection signals from the paper size sensor 48 and incoming paper sensor 45, the printing controller 40 causes the high voltage transfer power supply 51 to turn on to apply the high voltage to the transfer unit 27 while the paper 20 is passing through the transfer point. When the paper 20 has passed the outgoing paper sensor 46 after completion of printing, the printing controller 40 causes the high voltage charging power supply 50 to stop applying the high voltage to the developing section 14, and the developing/transferring process motor 42 to stop rotating. The above-described operation is repeated until the entire print data has been printed.

{Circuit of Optical Print Head}

Figure 5:
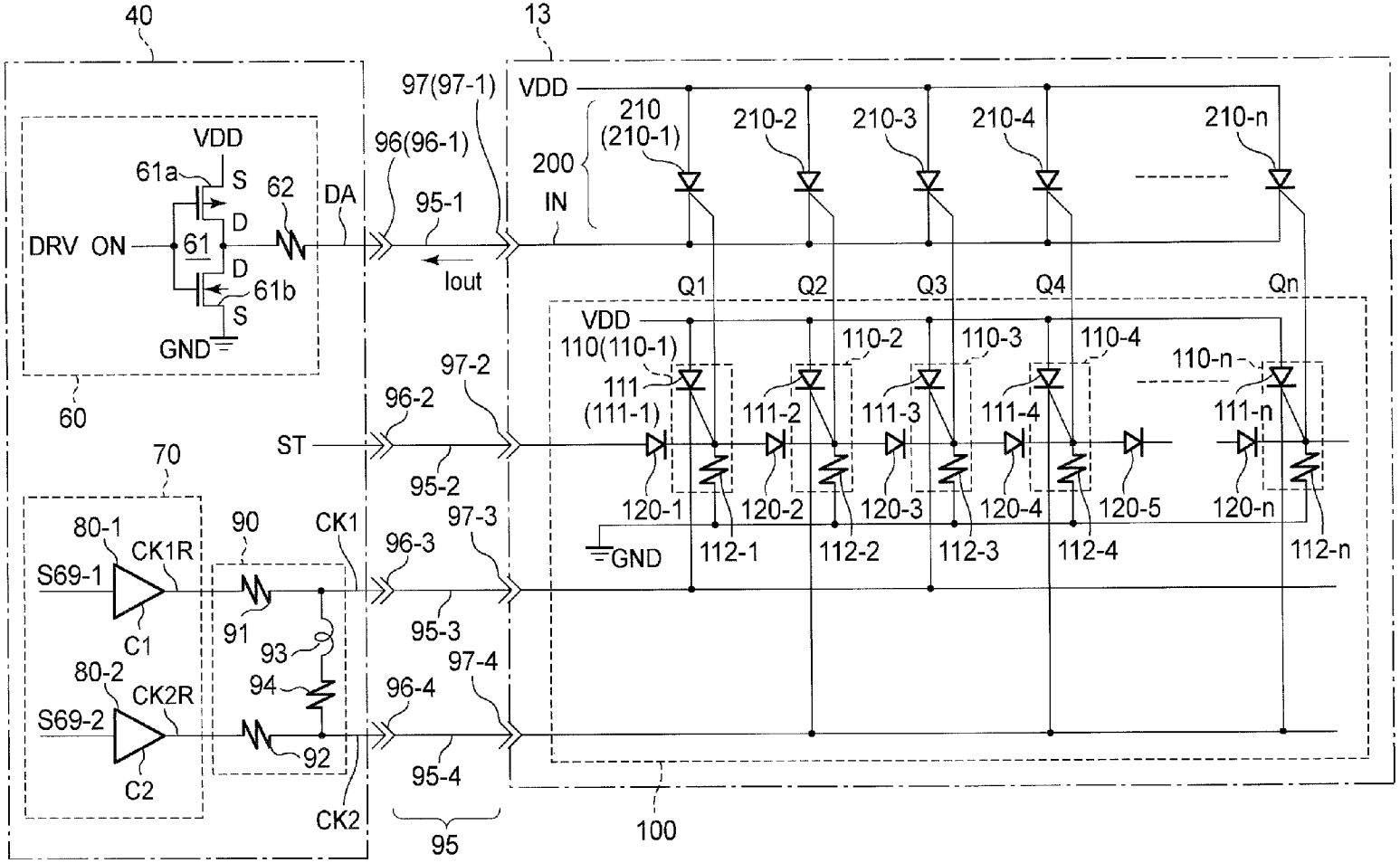
FIG. 5 illustrates the circuit configuration of the printing controller and the optical print head shown in FIG. 4.

FIG. 5 illustrates the circuit configuration of the printing controller 40 and the optical print head 13 shown in FIG. 4.

The print head 13 includes a chip 13*c* shown in FIG. 3 that has scanning circuits 100 and light emitting thyristor arrays 200 therein. The scanning circuits 100 and light emitting thyristor arrays 200 are connected to the printing controller 40 via the cable 95-1 to 95-4, connectors 96-1 to 96-4 and 97-1 to 97-4 to which the cables 95-1 to 95-4 are connected.

The light emitting thyristor array 200 scanned by the scanning circuit 100 includes a plurality of P gate type light emitting thyristors 210-1 to **210-*n*. Each of the P gate type light emitting thyristors 210-1 to 210-*n* has an anode connected to a first power supply (e.g., power supply voltage VDD), a cathode connected to a connector 97-1 via a common terminal IN through which a drive current Tout flows, and a gate connected to a corresponding one of output terminals Q1 to Qn. When the power supply voltage VDD is applied across the anode and cathode of each light emitting thyristor 210, if a triggering signal (e.g., triggering current) is applied to the gate, the light emitting thyristor 210 is turned on so that current flows from anode to cathode. The optical print head 13 illuminates the surface of the photoconductive drum to form an electrostatic latent image thereon. The optical print head 13** includes 4992 light emitting thyristors for forming 4992 dots on A4 size paper at a resolution of 600 dots per inch (dpi).

The scanning circuit 100 is clocked by a two-phase clock supplied from the printing controller 40 through first and second clock terminals CK1 and CK2, connectors 96-2 and 96-4, cables 95-2 and 95-4, and connectors 97-2 and 97-4, thereby controlling the triggering current to turn on or off the light emitting thyristor array 200. The scanning circuit 100 is a self-scanning shift register, and includes a plurality of sub scanning circuits 110-1 to **110-*n* (n is, for example, 4992) and a plurality of diodes 120-2 to 120-*n* (n is, for example, 4992) for determining the order or the direction in which the scanning circuit 100 is scanned to turn on the light emitting thyristors 210-1, 210-2, 210-3, 210-4, . . . 210-*n*** in sequence.

Odd-numbered scanning circuits 110-1, 110-3, 110-5, . . . , **110-(*n*−1) include corresponding self-scanning thyristors 111-1, 111-3, 111-5, . . . , 111-(*n*−1). The self-scanning thyristors 111-1, 111-3, 111-5, . . . , 111-(*n*−1) have an anode connected to the power supply voltage VDD, a cathode (second terminal) connected to the first clock terminal CK1 via the connector 97-3, cable 95-3 and the connector 96-3, and a gate connected to the ground GND via the resistor 112-1, 112-3, 112-5, . . . 112-(*n*−1), respectively. The gate of the respective self-scanning thyristors 111-1, 111-3, 111-5, . . . , 111-(*n*−1) is connected to output terminals (Q1, Q3, Q5, . . . Q (n−1)), respectively. It should be noted that the starting sub scanning circuits 110-1 includes a diode 120-1 connected between the gate of a self-scanning thyristor 111-1 and the connector 97-2**.

Even-numbered scanning circuits 110-2, 110-4, 110-6, . . . , **110-*n* include corresponding self-scanning thyristors 111-2, 111-4, 111-6, . . . , 111-*n*. The self-scanning thyristors 111-2, 111-4, 111-6, . . . , 111-*n* have an anode connected to the power supply voltage VDD, a cathode connected to the second clock terminal CK2 via the connector 97-4, cable 95-4 and the connector 96-4, and a gate connected to the ground GND via the second resistor 112-2, 112-4, 112-6, . . . 112-*n*, respectively. The gate of the respective self-scanning thyristors 111-2, 111-4, 111-6, . . . , 111-*n* is connected to output terminals Q2, Q4**, . . . Qn, respectively.

Diodes 120-2, 120-3, 120-4, . . . **120-*n* are connected between the gates of adjacent ones of the self-scanning thyristors 111-1, 111-2, 111-3, 111-4, . . . 111-*n*. The diodes 120-2, 120-3, 120-4, . . . 120-*n* determine the order in which the light emitting thyristors 210-1, 210-2, 210-3, 210-4, . . . 210-*n*** are turned on in sequence.

The self-scanning thyristors 111-1 to **111-*n* in the scanning circuit 100 have a similar layer structure to the light emitting thyristors 210 in the light emitting thyristor arrays 200, and operate in a similar manner. However, the upper layer of the self-scanning thyristors 111 is covered with an opaque material (e.g., metal) since the self-scanning thyristors 111** do not have to emit light.

The self-scanning thyristors 111-1 to **111-*n* in the self-scanning circuit 100 are clocked by the first clock and the second clock supplied from the first clock terminal CK1 and the second clock terminal CK2, respectively, of the printing controller 40, so that the self-scanning thyristors 111-1 to 111-*n* are selectively turned on one at a time. The ON-state of the self-scanning thyristors 111-1 to 111-*n* is transmitted to the light emitting thyristor arrays 200, causing corresponding light emitting thyristors (210-1 to 210-*n*) to emit light. The ON-state of the self-scanning thyristor 111 of each stage is transmitted to the next adjacent stage upon the first clock and the second clock, so that the entire scanning circuit 100** operates as a shift register.

The printing controller 40 includes a plurality of data driver circuits 60, a clock driver 70, and an RL differentiation circuit 90. The data driver circuit 60 supplies a drive current Iout to the common terminal IN 60, thereby driving the plurality of light emitting thyristor arrays 200 in a time division manner in response to an ON/OFF command signal DRVON. The ON/OFF command signal DRVON is a square wave signal outputted from an ON/OFF command signal generating circuit (not shown). The clock driver 70 and RL differentiation circuit 90 cooperate to generate the first and second clocks CK1 and CK2 to be supplied to the scanning circuit 100, based on square wave signals S69-1 and S69-2 outputted from a scanning square wave generating circuit (not shown). For the sake of simplicity, FIG. 5 illustrates only one of the data driver circuits 60. The light emitting thyristor arrays 200 include, for example, a total of 4992 light emitting thyristors 210-1 to **210-*n*, which are grouped into a plurality of groups. Each group is driven by a corresponding driver circuit 60** so that the groups are driven simultaneously in a time division manner.

An exemplary configuration includes light emitting thyristor arrays 200 in chip form, each array including light emitting thyristors 210-1 to **210-*n*, (e.g., n=192). The 26 arrays are mounted on the printed wiring board 13*b* shown in FIG. 3. This configuration provides a total of 4992 light emitting thyristors necessary for the print head 13. The 26 light emitting thyristor arrays are driven by corresponding data drivers 60** having 26 output terminals.

The clock driver 70 and RL differentiation circuit 90 are designed to drive the scanning circuit 100 in the form of an array. The clock driver 70 and RL differentiation circuit 90 not only output clock signals but also control the amount of energy required for turning' on the self-scanning thyristors 111. For high-speed operation of the print head 13, the clock driver 70 and RL differentiation circuit 90 are preferably fabricated for each scanning circuit 100. However, if low data transfer rate for the print head 13 is acceptable, a single combination of the clock driver 70 and RL differentiation circuit 90 may be used to drive a plurality of scanning circuits 100.

The driver apparatus according to the first embodiment is constituted of the data driver 60, clock driver 70, RL differentiation circuit 90, and scanning circuit 100. The data driver 60, clock driver 70, and RL differentiation circuit 90 shown in FIG. 5 may be accommodated either in the print head 13 or in the printing controller 40.

The data driver 60 includes a CMOS inverter 61 constituted of CMOS transistors, and a resistor 62 connected between the output terminal of the CMOS inverter 61 and a data terminal DA. The CMOS inverter 61 receives the ON/OFF command signal DRVON from the ON/OFF command signal generation circuit (not shown), and outputs the inverted the ON/OFF command signal DRVON. The CMOS inverter 61 includes a P type MOS transistor (referred to PMOS transistor hereafter) 61*a* and an N type MOS transistor (referred to as NMOS transistor hereafter) 61*b*. These transistors 61*a* and 61*b* are connected in series between the power supply voltage VDD and the ground GND.

The PMOS transistor 61*a* has a gate that receives the ON/OFF command signal DRVON, a source connected to the power supply voltage VDD, and a drain connected to one end of the resistor 62. The NMOS transistor 61*b* has a gate that receives the ON/OFF command signal DRVON, a source connected to the ground GND, and a drain connected to the one end of the resistor 62. The other end of the resistor 62 is connected to the data terminal DA. The data terminal DA is connected to the cathodes of light emitting thyristors 210-1 to 210-*n* through the connector 96-1, cable 95-1, connector 97-1, and the common terminal IN of the print head 13. The drive current Iout flows in the data terminal DA when the light emitting thyristors 210-1 to 210-*n* are driven in sequence.

The clock driver 70 includes a first output buffer 80-1, a second output buffer 80-2, a first output terminal CK1R, and a second output terminal CK2R. The first and second output buffers 80-1 and 80-2 receive square wave signals S69-1 and S69-2 as scanning signals outputted from a square wave generator (not shown). The first and second output terminals CK1R and CK2R are connected to the outputs of the first and second output buffers 80-1 and 80-2.

The first and second output buffers 80-1 and 80-2 are of the same circuit configuration, and may be implemented in CMOS inverters, so that the output of the output buffer may be either the High level or the Low level. However, it is desirable that the first and second output buffers 80-1 and 80-2 have a three-state output which can be one of the High level, the Low level, and the High impedance state (i.e., Hi-Z state). The first and second output buffers 80-1 and 80-2 in the form of a three-state logic circuit have an output logic level equal to that at the input terminal when the control signals C1 and C2 are the High level, and an output terminal of Hi-Z state when the control signal C1 and C2 are the low level. As described above, a three-state configuration can have a High level output, a Low level output, and a Hi-Z state. In addition to the High level and the Low level, the output buffer has the Hi-Z state 1, thereby generating drive signals having a waveform suitable for triggering the gate of the self-scanning thyristor 111.

The RL differentiation circuit 90 having the first and second clock terminals CK1 and CK2 is connected across the first and second output terminals CK1R and CK2R. The RL differentiation circuit 90 includes a resistor 91 connected between the first clock terminal CK1 and the first output terminal CK1R, a resistor 92 connected between the second clock terminal CK2 and the second output terminal CK2R, and a series connection of an inductor 93 and a resistor 94 which is connected between the first clock terminal CK1 and the second clock terminal CK2.

The inductor 93 may be a high permeability ferrite bead on which a thick film wiring layer is formed connecting one end electrode of the inductor to the other, the thick film wiring being formed either on the outer surface of the ferrite bead or on the inner surface.

The first clock terminal CK1 is connected to the scanning circuit 100 via the connector 96-3, cable 95-3, and connector 97-3. The second clock terminal CK2 is connected to the scanning circuit 100 via the connector 96-4, cable 95-4, and connector 97-4.

The resistors 91 and 92 and resistor 94 may be omitted if the clock driver 70 has sufficient drive capability for driving the self-scanning circuit.

{Light Emitting Thyristor of First Embodiment}

Figure 6C:
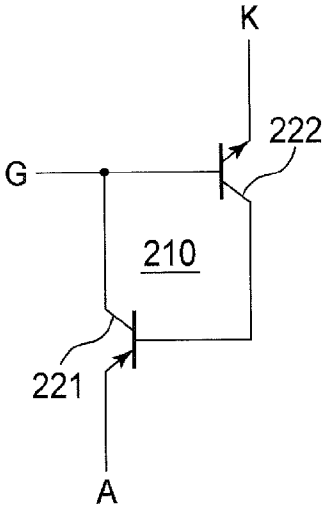
FIGS. 6A-6C illustrate the light emitting thyristor shown in FIG. 5.
Figure 6B:
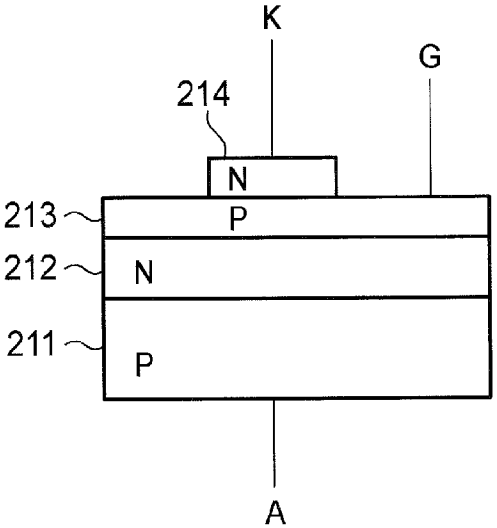
Figure 6A:
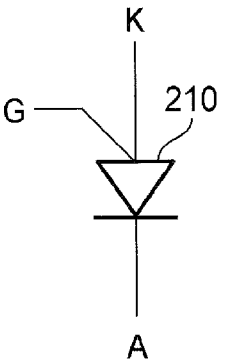

FIGS. 6A-6C illustrate the light emitting thyristor 210 shown in FIG. 5.

FIG. 6A illustrates circuit symbols of the light emitting thyristor 210B having an anode A, a cathode K, and a gate G.

FIG. 6B is a cross-sectional view of the light emitting thyristor 210. The light emitting thyristor 210 is fabricated as follows: First, a predetermined crystal is epitaxially grown on a P type GaAs wafer by known metal organic chemical vapor deposition (MO-CVD).

A predetermined buffer layer (not shown) is formed on the GaAs wafer and then an AlGaAs layer is formed on the buffer. A PNPN structure or a four-layer structure is fabricated on the AlGaAs layer. The four-layer structure includes a P-type layer 211 that contains a P-type impurity, an N-type layer 212 that contains an N-type impurity, a P-type layer 213 that contains a P-type impurity, and an N-type layer 214 that contains an N-type impurity, in this order. Grooves (not shown) are then formed in the wafer to isolate individual devices by a known etching technique. When etching is performed, apart of the P-type layer 213 is etched to expose. A metal wiring is formed on the exposed region to form a gate G. The uppermost N-type layer 214 is partially exposed and a metal wiring is formed on the exposed region to form a cathode K. A metal wiring is formed on a side of the P-type layer 211 opposite the N-type layer 212, thereby forming an anode A.

FIG. 6C illustrates an electrical equivalent circuit of the light emitting thyristor 210 shown in FIGS. 6A and 6B.

The light emitting thyristor 210 is constituted of a PNP transistor 221 and an NPN transistor 222. The emitter of the PNP transistor 221 corresponds to the anode A of the light emitting thyristors 210, and the base of the NPN transistor 222 corresponds to the gate G. The emitter of the NPN transistor 222 corresponds to the cathode K. The collector of the PNP transistor 221 is connected to the base of the NPN transistor 222. The base of the PNP transistor 221 is also connected to the collector of the NPN transistor 222.

The light emitting thyristor 210 shown in FIGS. 6A-6C has an AlGaAs layer formed on the GaAs wafer. The thyristor 210 is not limited to this configuration. The thyristor 210 may have a layer of GaP, GaAsP, AlGaInP or InGaAsP formed on the GaAs wafer. Alternatively, the thyristor 210 may have a GaN layer, an AlGaN layer, or an InGaN layer formed on a sapphire substrate.

{Brief Description of Operation of Printing Controller and Print Head}

Referring back to FIG. 5, if the ON/OFF command signal DRVON is the Low level, the PMOS transistor 61*a* of the CMOS inverter 61 is ON and the NMOS transistor 61*b* is OFF, so that the data terminal DA is the High level. The High level at the data terminal DA is fed to the cathodes of the respective light emitting thyristors 210 through the connector 96-1, cable 95-1, connector 97-1, and common terminal IN. As a result, the anode-cathode voltage of the respective light emitting thyristors is substantially zero volts, causing the drive current Tout to become zero, so that none of the light emitting thyristors 210-1 to 210-*n* emits light.

If the ON/OFF command signal DRVON is the High level, the PMOS transistor 61*a* of the CMOS inverter 61 is OFF and the NMOS transistor 61*b* is ON, so that the data terminal DA is the Low level. The Low level at the data terminal DA is fed to the cathodes of the respective light emitting thyristors 210 through the connector 96-1, cable 95-1, connector 97-1, and common terminal IN. As a result, the anode-cathode voltage of the respective thyristors is substantially equal to the power supply voltage VDD.

At this moment, the scanning circuit 100 starts its shifting operation upon the High level of the start signal ST supplied through the diode 120, outputting the High level signal to the gates of light emitting thyristors 210 that should be turned on. The High level at the gates of light emitting thyristors 210 cause triggering current to flow in the gates. The triggering current causes the light emitting thyristors 210 to turn on. The cathode current (i.e., drive current Iout) flows into the data terminal DA, producing a corresponding amount of light.

When the Low level is fed to the cathodes of the thyristors to be turned on, their anode-cathode voltage is equal to the power supply voltage VDD. Since the gates of the light emitting thyristors 210 are directly connected to the gates of the corresponding self-scanning thyristors 111, voltage is also applied across the gate and cathode of the self-scanning thyristors 111. Thus, if a High level signal is applied to the gates of the light emitting thyristors 210 that should be turned on, the High level signal causes a trigger current to flow through light emitting thyristors 210 that should be turned on. Thus, the drive current Tout or a cathode current flows through a corresponding light emitting thyristor 210, causing the light emitting thyristor 210 to emit light.

{Detailed Operation of Printing Controller and Print Head}

Figure 7:
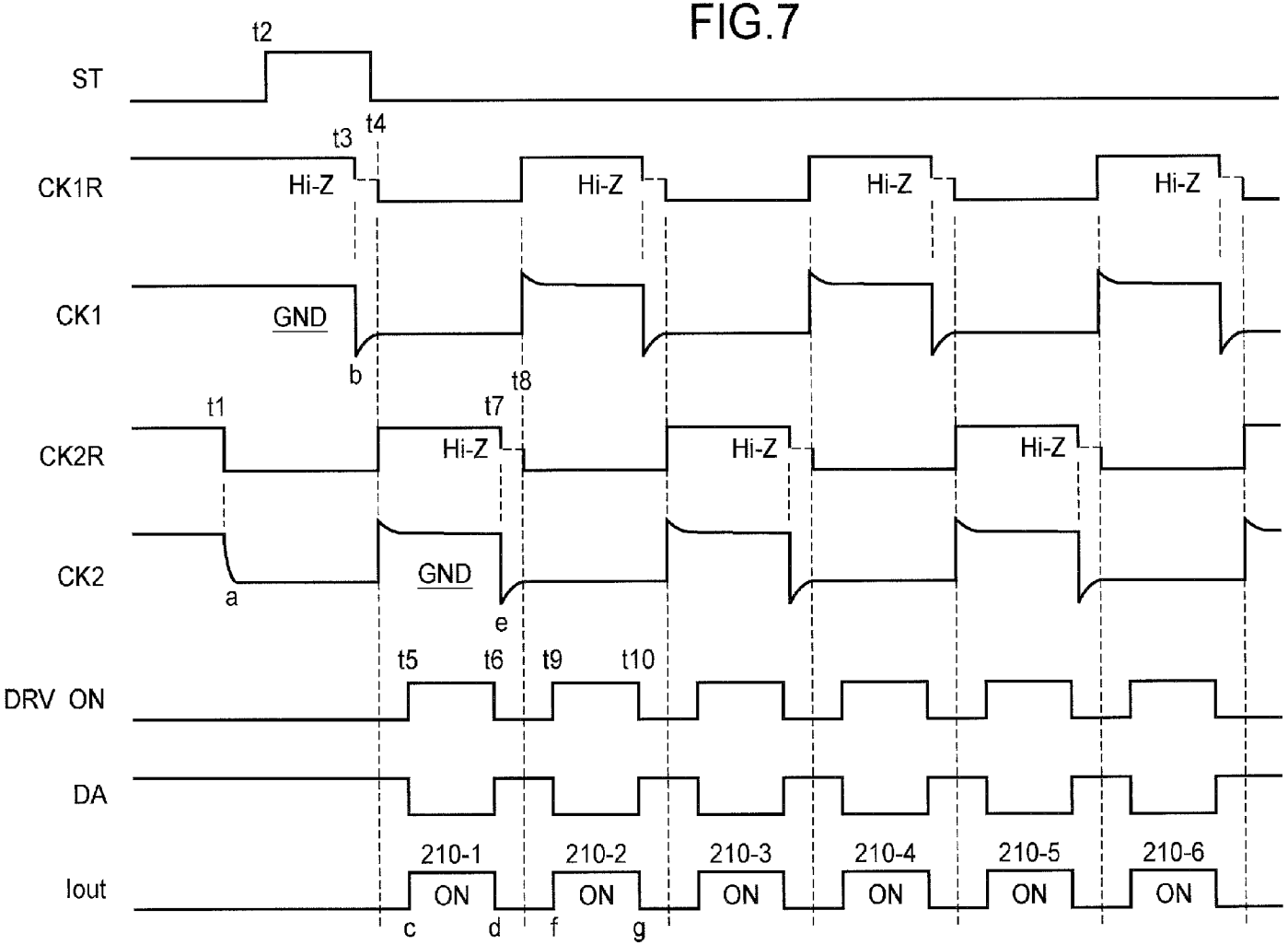
FIG. 7 is a timing chart illustrating the details of the operation of the printing controller and print head shown in FIG. 5.

FIG. 7 is a timing chart illustrating the details of the operation of the printing controller 40 and print head 13 shown in FIG. 5.

FIG. 7 illustrates the waveform of respective signals when the light emitting thyristors 210-1 to **210-*n*** (e.g., n=6) are turned on alternately one at a time in a single scanning line.

The scanning circuit 100 using self-scanning thyristors 111 operates on the two-phase clock outputted from the first and second clock terminals CK1 and CK2. The two-phase clock is driven by the clock driver 70 having the first and second output terminals CK1R and CK2R.

Before time t1 shown in FIG. 7, the control signals C1 and C2 are the High level, and the square wave signals S69-1 and S69-2 outputted from a square wave generator (not shown) are fed to the first and second output buffers 80-1 and 80-2. The high level clock pulses are outputted from the first and second output terminals CK1R and CK2R.

The first output terminal CK1R is connected to the first clock terminal CK1 through the resistor 91. The second output terminal CK2R is connected to the second clock terminal CK2 through the resistor 92. Thus, the cathodes of odd-numbered self-scanning thyristors 111-1, 111-3, 111-5 and the cathodes of even-numbered self-scanning thyristors 111-2, 111-4, 111-6 are the High level, and therefore the self-scanning thyristors are OFF. The ON/OFF command signal DRVON is the Low level and the output of the CMOS inverter 61 is the High level. The High level output of the CMOS inverter 61 is fed to the cathode of the light emitting thyristors 210-1 to 210-6 through the resistor 62, data terminal DA, connector 96-1, cable 95-1, connector 97-1, and common terminal IN, so that the light emitting thyristors 210-1 to 210-6 are OFF.

A description will be given of the process for turning on the self-scanning thyristors 111-1 and 111-2 in the first and second stages scanning circuit 110-1 and 110-2, respectively.

{Phase I: Turning-on of Thyristor 111-1}

At time t1 shown in FIG. 7, the second output terminal CK2R goes low, so that the second clock terminal CK2 goes low as depicted at "a," causing the cathodes of the odd-numbered self-scanning thyristors 111-1, 111-3, 111-5 to become Low level. Since the odd-numbered self-scanning thyristors 111-1, 111-3, 111-5 are OFF, the even-numbered self-scanning thyristors 111-2, 111-4, 111-6 are OFF.

At time t2, the start signal ST goes high to initiate the scanning operation. The High level of the start signal ST is fed to the anode of the diode 120-1 via the connector 96-2, cable 95-2, and connector 97-2.

This means that a voltage is fed through a path defined by the diodes 120-1 and 120-2, the gate-cathode junction of the self-scanning thyristor 111-2, and second clock terminal CK2. In a typical design, the forward voltage Vf of the diodes 120-1 and 120-2 is about 1.6 V, and the gate-cathode voltage Vgk of the self-scanning thyristors 111-1 to 111-6 is also about 1.6 V. The High level is nearly equal to the power supply voltage VDD and the Low level is nearly zero volts, i.e., GND. Thus, the sum of the forward voltage in the aforementioned path is given as follows:

$$Vf+Vf+Vgk=1.6+1.6+1.6=4.8\text{ V}$$

Since Vf+Vf+Vgk>VDD, no current flows through the path so that no gate current flows through the self-scanning thyristor 111-2 and the self-scanning thyristor 111-2 remains OFF. The same is true of the self-scanning thyristor 111-4.

At time t3, the control signal C1 goes low, causing the first output terminal CK1R to enter the Hi-Z state, which is depicted by a dotted line between the High level and Low level in FIG. 7.

Immediately before time t3, the first output terminal CK1R is the High level, causing current to flow in a path defined by the first output terminal CK1R, resistor 91, inductor 93, resistors 94 and 92, and second output terminal CK2R (Low level). However, since no current can flow through the first output terminal CK1R in the Hi-Z state, a back electromotive force is developed across the inductor 93 and causes a waveform with undershoot as depicted at "b" in FIG. 7 to appear on the first clock terminal CK1. It is to be noted that the waveform undershoots negatively the ground level. At time t3, the undershooting waveform and High level of the start signal ST cooperate to create a current path defined by the diode 120-1, the gate-cathode junction of the self-scanning thyristor 111-1, and first clock terminal CK1. Thus, a triggering current flows through this current path, causing the self-scanning thyristor 111-1 to turn on.

At time t4, the first output terminal CK1R becomes the Low level to create a path for the cathode current of the self-scanning thyristor 111-1 to flow through the first clock terminal CK1 and the resistor 91 to the ground. Substantially at time t4, the second output terminal CK2R becomes the High level, which appears on the second clock terminal CK2.

At time t5, the ON/OFF command signal DRVON goes high and is inverted by the CMOS inverter 61, so that the Low level appears on the data terminal DA. This causes a voltage nearly equal to the power supply voltage VDD to appear across the anode-cathode junction of the light emitting thyristor 210-1. At this moment, the self-scanning thyristor 111-1 is ON and the light emitting thyristor 210-1 is ON since both the self-scanning thyristor 111-1 and light emitting thyristor 210-1 have the same gate potential. Thus, the drive current Iout flows as depicted at "c" in FIG. 7, emitting a corresponding amount of light.

At time t6, the ON/OFF command signal goes low and is inverted by the CMOS inverter 61, so that the High level appears on the data terminal DA. This causes the anode-cathode voltage to become substantially zero volts, so that the light emitting thyristor 210-1 turns off and the drive current Iout is substantially zero as depicted at "d" in FIG. 7.

The light emitting thyristor 210-1 emits light to form an electrostatic latent image on the photoconductive drum 11 shown in FIG. 1. The exposing energy is determined by the exposing time (i.e., time t6 to time t5) times the light power produced by the drive current Iout. The light power may vary due to variations in manufacturing process, but the exposing time for individual thyristors may be adjusted to compensate for the variations of light power. If the light emitting thyristor 210 is not to be turned on, the ON/OFF command signal DRVON can be maintained high for a period of time from time t5 to time t6. In this manner, the ON/OFF command signal DRVON can drive the light emitting thyristors 210 to emit or not to emit light.

{Turning on of Self-Scanning Thyristor 111-2}

At time t7, the control signal C2 goes low, causing the second output terminal CK2R to enter the Hi-Z state.

Immediately before time t7, the second output terminal CK2R is the High level, creating a current path defined by the second output terminal CK2R, resistors 92 and 94, inductor 93, resistor 91, and first output terminal CK1R (Low level). However, immediately after time t7, the first output terminal CK1R enters the Hi-Z state, so that no current can flow and a back electromotive force is developed across the inductor 93 and causes a waveform with undershoot as depicted at "e" in FIG. 7 to appear on the first clock terminal CK2.

The anode potential of the self-scanning thyristor 111-2 is equal to the power supply voltage, i.e., 3.3 V in a typical design. The anode potential of the diode 120-2 is the High level, i.e., nearly equal to the power supply voltage VDD due to fact that the anode of the diode 120-2 is directly connected to the gate of the self-scanning thyristor 111-1. Thus, current flows in a path defined by the gate of the self-scanning thyristor 111-1, the anode-cathode junction of the diode 120-2, the gate-cathode junction of the self-scanning thyristor 111-2, and second clock terminal CK2. This current serves as a triggering current for the self-scanning thyristor 111-2 to turn on.

At time t8, the second output terminal CK2R goes low to create a current path for the cathode current of the self-scanning thyristor 111-2 to flow. Substantially at time t8, the first output terminal CK1R goes high, causing the first clock terminal CK1 to go high. The High level on the first clock terminal CK1 causes the cathode potential of the self-scanning thyristor 111-1 to rise, so that the anode-cathode voltage abruptly decreases to cause the self-scanning thyristor 111-1 to turn off.

At time t9, the ON/OFF command signal DRVON goes high and is inverted by the CMOS inverter, so that the Low level appears on the data terminal DA. When the data terminal DA goes low, the anode-cathode voltage of the light emitting thyristor 210-2 become substantially equal to the power supply voltage VDD. As described previously, at time t9, the self-scanning thyristor 111-2 is ON and the self-scanning thyristor 111-1 is OFF. Thus, the light emitting thyristor 210-2 turns on since the light-emitting thyristor 210-2 and the self-scanning thyristor 111-2 have the same gate potential. This causes the drive current Iout to flow as depicted at "f" in FIG. 7, emitting light with a corresponding amount of light.

At time t10, the ON/OFF command signal DRVON goes low and is inverted by the CMOS 61, so that the High level appears on the data terminal DA. The High level signal on the data terminal DA causes the anode-cathode voltage of the light emitting thyristor 210-2 to become substantially zero, so that the light emitting thyristor 210-2 turns off and the drive current Iout becomes substantially zero as depicted at "g" in FIG. 7.

Likewise, the first and second output terminals CK1R and CK2R and the ON/OFF command signal DRVON alternately becomes ON and OFF, thereby causing the light emitting thyristors 210-3 to 210-6 in sequence.

{Waveform with Undershoot Shown in FIG. 7}

Figure 8A:
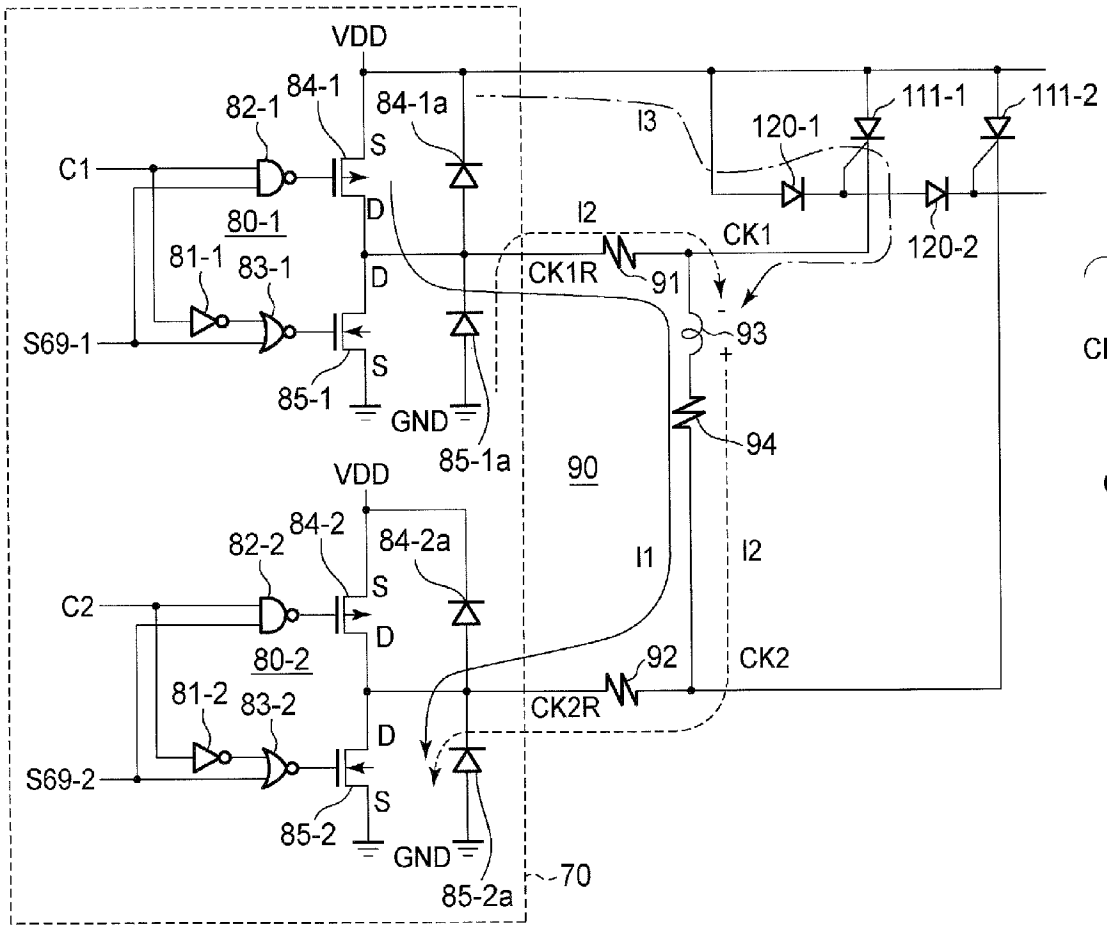
FIG. 8A illustrates a clock driver.
Figure 8B:
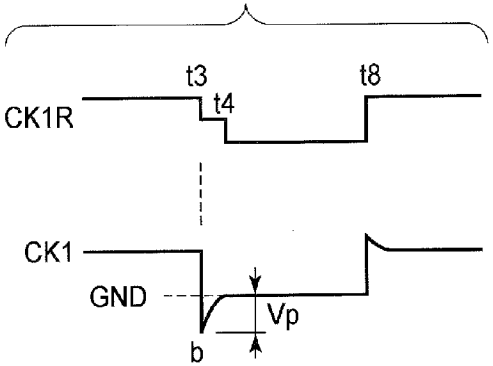
FIG. 8B illustrates a part of the timing chart shown in FIG. 7.

FIG. 8A illustrates the clock driver 70 that includes the first and second output buffers 80-1 and 80-2 in the form of a three-state logic circuit, the RL differentiation circuit 90, and scanning circuits 110-1 and 110-2. FIG. 8B illustrates a part of the timing chart shown in FIG. 7.

Referring to FIG. 8A, the first output buffer 80-1 includes an inverter 81-1 that inverts the control signal C1, a two-input NAND gate 82-1 that outputs a negated logical product of the control signal C1 and the square wave signal S69-1, and a two-input NOR gate 83-1 that outputs a negated logical sum of the output of the inverter 81-1 and the square wave signal S69-1. The output of the NAND gate 82-1 is connected to the gate of a first switch element or PMOS transistor 84-1 (e.g., first conductivity type). The output of the NOR gate 83-1 is connected to the gate of a second switch element or NMOS transistor 85-1 (e.g., second conductivity type). A diode 84-1*a* is connected in parallel with the first switch element 84-1. A diode 85-1*a* is connected in parallel with the second switch element or NMOS transistor 85-1.

The PMOS transistor 84-1 has a gate connected to the output of the NAND gate 82-1, a source connected to the VDD, and a drain connected to the first output terminal CK1R. The NMOS transistor 85-1 has a gate connected to the output of the NOR gate 83-1, a drain connected to the first output terminal CK1R, and a source connected to the ground GND. The diode 84-1*a* has a cathode connected to the power supply voltage VDD and an anode connected to the first output terminal CK1R. The diode 85-1*a* has a cathode connected to the first output terminal CK1R and an anode connected to the ground GND.

The diode 84-1*a* is not essential to the circuit operation but is formed by accident as a parasitic diode between the substrate and the drain of the PMOS transistor 84-1 when the PMOS transistor 84-1 and NMOS transistor 85-2 are fabricated.

The second output buffer 80-2 is of the same circuit configuration as the first output buffer 80-1. The second output buffer 80-2 includes a two-input NAN gate 82-2, and a two-input NOR gate 83-2. The NAND gate 82-2 outputs a negated logical product of the control signal C2 and the square wave signal S69-2. The NOR gate 83-2 outputs a negated logical sum of the output signal of the inverter 81-2 and the square waveform signal S69-2. The output of the NAND gate 82-2 is connected to the gate of a third switch element or PMOS transistor 84-2. The output of the NOR gate 83-2 is connected to a fourth switch element or NMOS transistor 85-2.

The PMOS transistor 84-2 has a gate connected to the output terminal of the NAND gate 82-2, a source connected to the power supply voltage VDD, and a drain connected to the second output terminal CK2R. The NOMOS transistor 85-2 has a gate connected to the output terminal of the NOR gate 83-2, a drain connected to the second output terminal CK2R, and a source connected to the ground GND. The diode 84-2*a* has a cathode connected to the power supply voltage VDD and an anode connected to the second output terminal CK2R. The diode 85-2*a* has a cathode connected to the second output terminal CK2R and an anode connected to the ground GND.

The diode 84-2*a* is not essential to the circuit operation but is a parasitic diode formed by accident between the substrate and the drain of the NMOS transistor 85-2.

The first output buffer 80-1 and second output buffer 80-2 operate in the same manner, and only the first output buffer 80-1 will be described for simplicity.

If the control signal C1 is the High level and the square waveform signal S69-1 is the Low level, and the outputs of the NAND gate 82-1 and NOR gate 83-1 are the High level, the PMOS transistor 84-1 is OFF, the NMOS transistor 85-1 is ON, and the first output terminal CK1R is the Low level. If the control signal C1 and square wave signal S69-1 are both the High level and the outputs of the NAND gate 82-1 and NOR gate 83-1 are both the Low level, then the PMOS transistor 84-1 is ON, the NMOS transistor 85-1 is OFF, and the first output terminal CK1R is the High level. If the control signal C1 is the Low level, the output of the NAND gate 82-1 is the High level, and the output of the NOR gate 83-1 is the Low level, then the PMOS transistor 84-1 and NMOS transistor 85-1 are both OFF, so that the first output terminal CK1R enters the Hi-Z state.

The self-scanning thyristor 111-1 has its anode connected to the power supply voltage VDD and its cathode connected to the first clock terminal CK1. The first clock terminal CK1 is connected to the first output terminal CK1R through the resistor 91. The self-scanning thyristor 111-2 has its anode connected to the power supply voltage VDD and its cathode connected to the second clock terminal CK2. The second clock terminal CK2 is connected to the second output terminal CK2R through the resistor 92. A series circuit of the inductor 93 and the resistor 94 is connected between the first and second clock terminals CK1 and CK2. The gate of the self-scanning thyristor 111-1 is connected to the cathode of the diode 120-1. When the self-scanning thyristor 111-1 turns on, the start signal ST is substantially the same as the power supply voltage VDD, so the anode of the diode 120-1 can be thought of as being connected to the power supply voltage VDD. Thus, the anode of the diode 120-1 is connected to the power supply voltage VDD in FIG. 8A for simplicity.

For example, let's consider a case in which the first output terminal CK1R is the High level and the second output terminal CK2R is the Low level.

Figure 12:
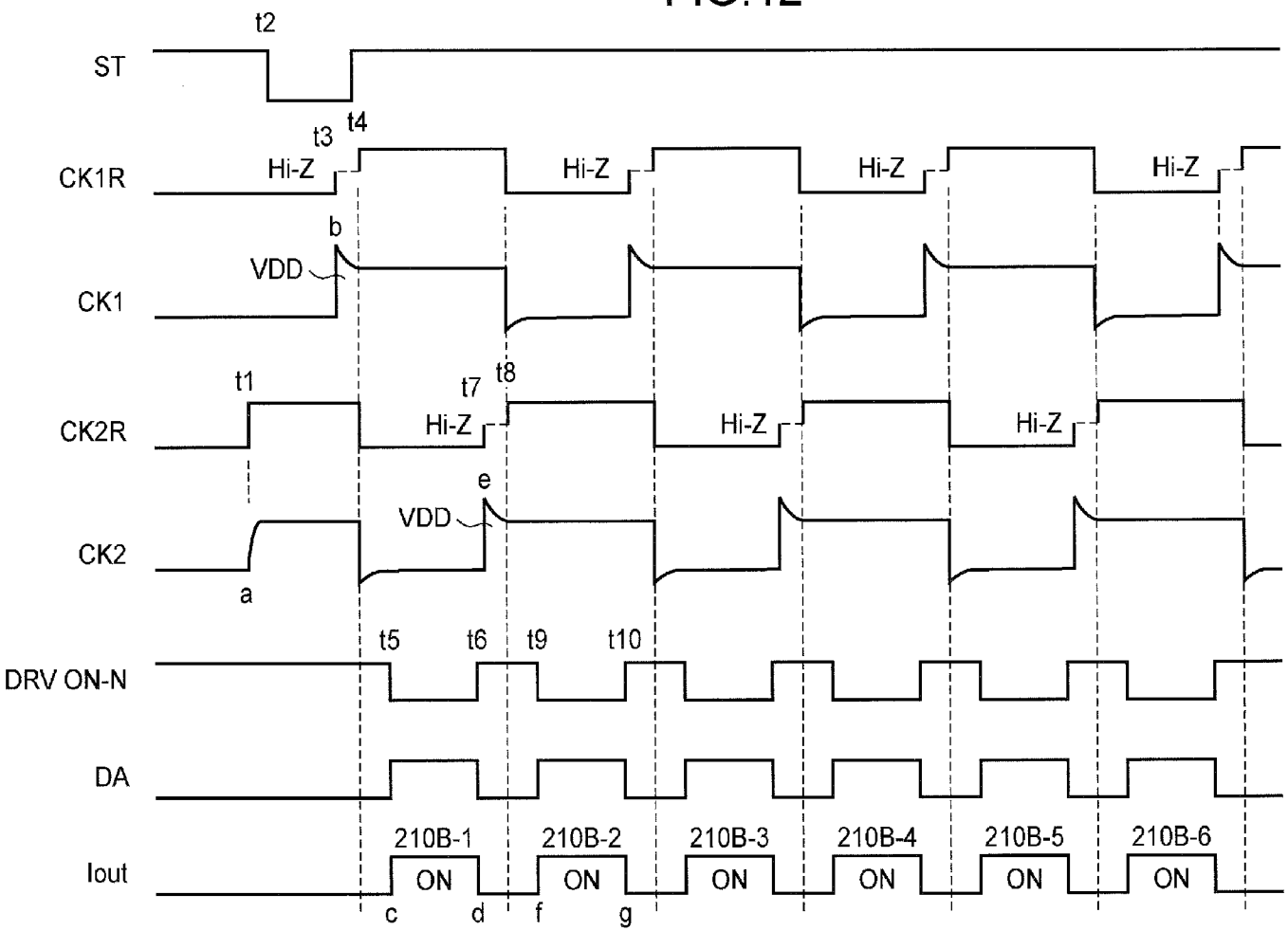
FIG. 12 is a timing chart illustrating the details of the operation of the printing controller and print head shown in FIG. 10.
Figures 13A, 13B:
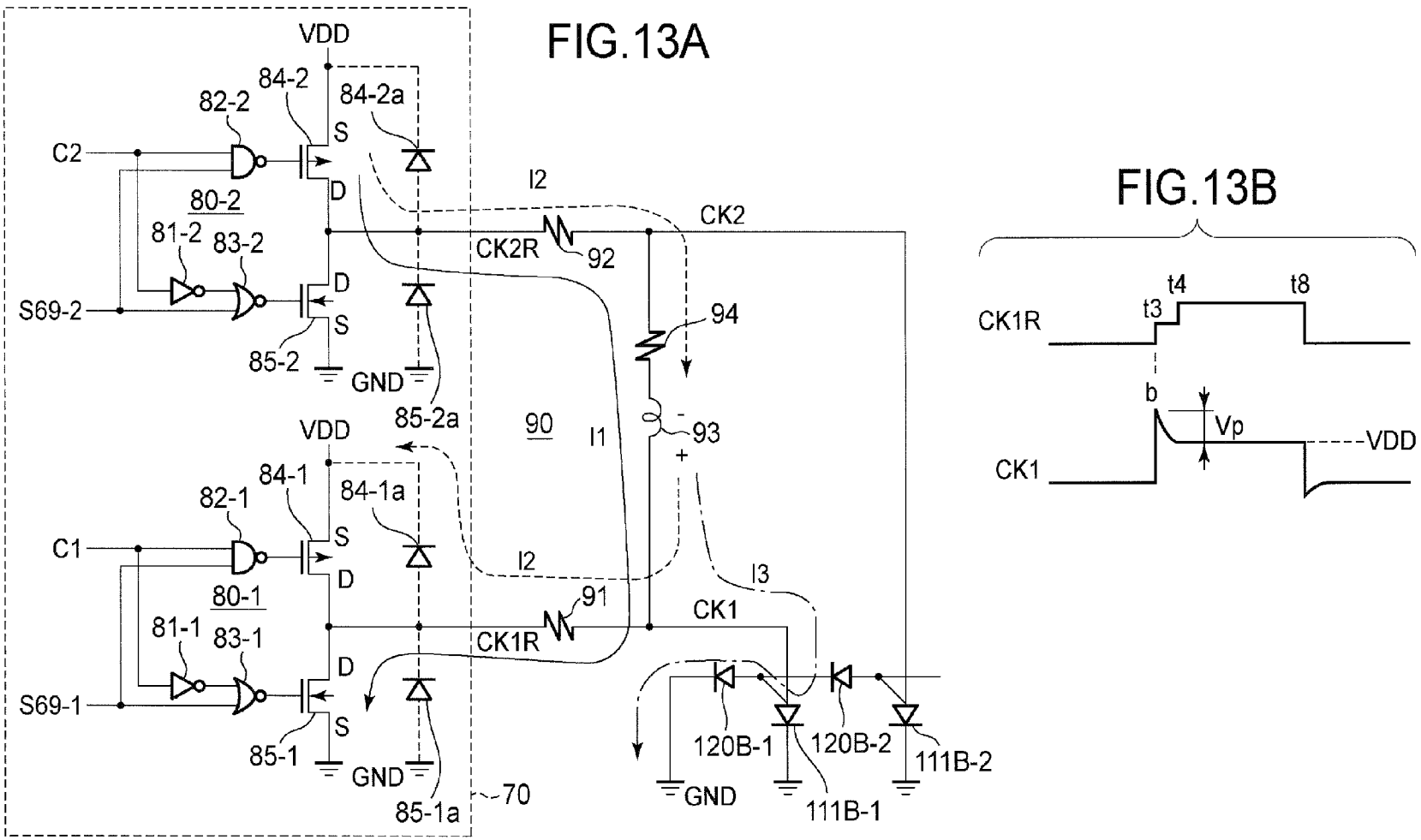
FIG. 13A illustrates the clock driver shown in FIG. 10.
FIG. 13B illustrates a part of the timing chart illustrated in FIG. 12.

This corresponds to the situation immediately before time t3 shown in FIGS. 12 and 13B. A current I1 flows in a direction shown by a solid line as shown in FIG. 8A in a path defined by the power supply voltage VDD, PMOS transistor 84-1, first output terminal CK1R, resistor 91, inductor 93, resistor 94 and 92, NMOS transistor 85-2, and ground GND.

Immediately after time t3, the control signal C1 goes low, causing the PMOS transistor 84-1 and NMOS transistor 85-1 to go off so that the second output terminal CK1R enters the Hi-Z state. This causes a back electromotive force across the inductor 93 with the polarities shown in FIG. 8A, which results in the current I2 shown by a dotted line. The current I2 flows in a path defined by the positive sign of the inductor 93, resistors 94 and 92, NMOS transistor 85-2, GND, diode 85-1*a*, resistor 91, NMOS transistor 85-2, ground GND, diode 85-1*a*, resistor 91, and the negative sign of the inductor 93.

Let's focus our attention on the second current path. The anode of the diode 85-1*a* is connected to the ground GND so that the potential of the first output terminal CK1R is lower than that of the ground GND by the forward voltage of the diode 85-1*a*. Therefore, the potential of the first clock terminal CK1 is lower than that of the cathode of the diode 85-1*a* by the voltage drop across the resistor 91. As a result, as shown by a dot-dashed line, a current I3 flows in a path defined by the power supply voltage VDD, diode 120-1, the gate-cathode junction of the self-scanning thyristor 111-1, and first clock terminal CK1. The gate current I3 serves as a triggering current for the self-scanning thyristor 111-1 to turn on.

FIG. 8B illustrates the waveforms of the signals on the first output terminal CK1R and first clock terminal CK1. When the first output terminal CK1R changes from the High level to the Hi-Z state, the signal on the first clock terminal CK1 will abruptly undershoot the ground GND by voltage Vp as depicted at "b."

In a typical design, the power supply voltage VDD is 3.3 V, the forward voltage Vf of the diode 120-2 is about 1.6 V, and the forward voltage Vgk of the gate-cathode junction of the self-scanning thyristor 111-1 is also about 1.6 V. In order for the current I3 to flow in the dot-dashed line path, the following relationship must be satisfied.

$$Vf+Vgk<VDD+Vp$$

At this moment, if the signal on the second clock terminal CK1 shown in FIG. 8B had no undershoot "b" so that Vp=0 V, the value of Vf+Vgk would be as follows:

$$Vf+Vgk=1.6\text{ V}+1.6\text{ V}=3.2\text{ V}$$

This implies that Vf+Vgk is somewhat lower than the power supply voltage VDD, and therefore cannot cause sufficient gate current for the thyristor 111-2 to turn on.

In contrast, in the first embodiment, the undershoot voltage Vp=0.6 V is produced to satisfy the following relationship.

$$VDD+Vp=3.3\text{ V}+0.6\text{ V}=3.9\text{ V}$$

This indicates that the value of VDD+Vp is greater than Vf+Vgk, and can cause sufficient trigger current for the self-scanning thyristor 111-1 to turn on.

{First Modification to First Embodiment}

Figure 9:
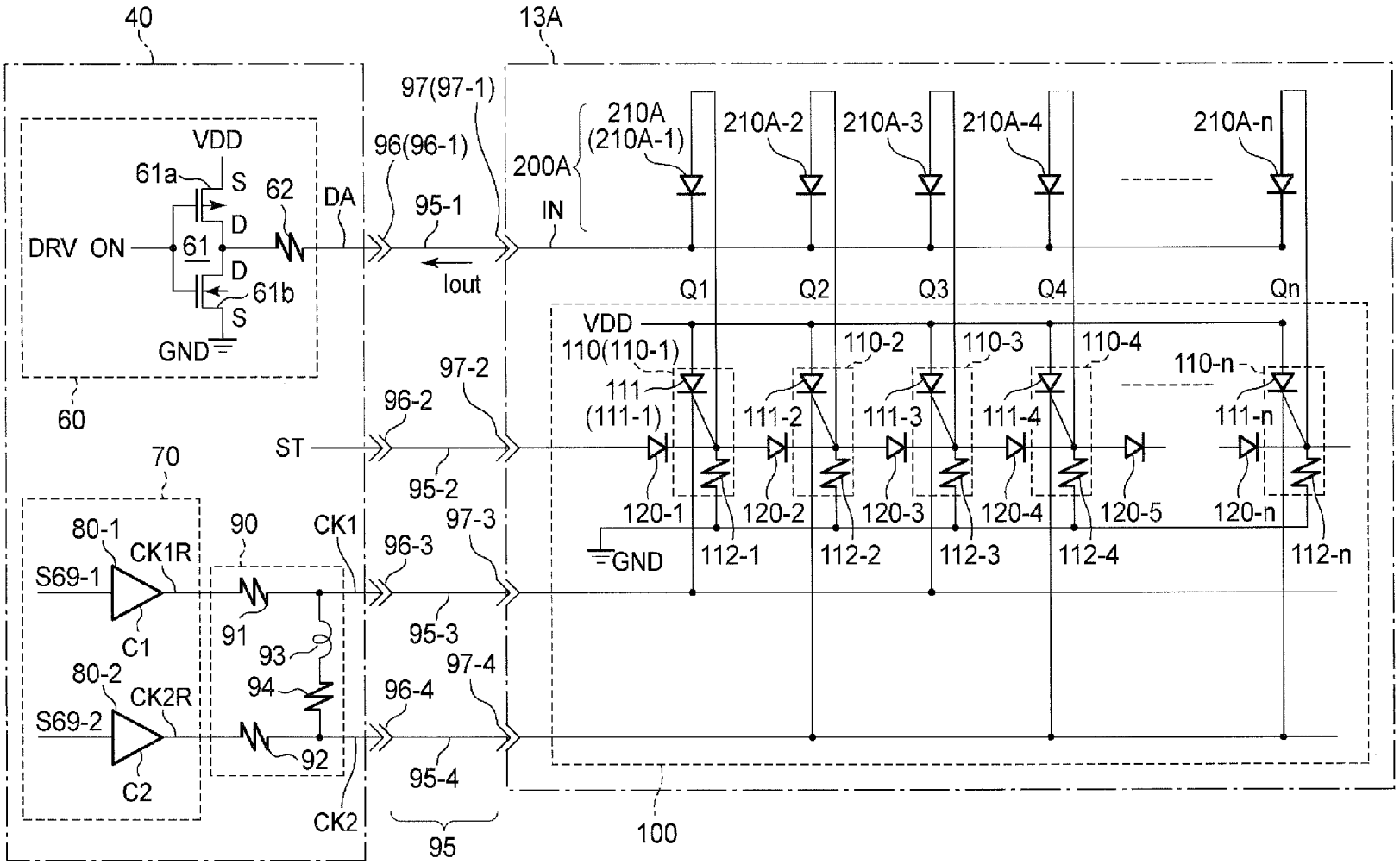
FIG. 9 is a block diagram illustrating the outline of the circuit configuration of the printing controller and the print

FIG. 9 is a block diagram illustrating the outline of the circuit configuration of the printing controller 40 and a print head 13A of a first modification to the first embodiment. Elements similar to those shown in FIG. 5 have been given the same reference numerals.

The first modification has a printing controller 40 similar to that of the first embodiment. The printing controller 40 is connected to the print head 13A via a plurality of connectors 96-1 to 91-4, cables 95-1 to 95-4, and connectors 97-1 to 97-4. The print head 13A includes a scanning circuit 100 similar to that of the first embodiment and light emitting element arrays 200A different from light emitting arrays 200 of the first embodiment.

The light emitting array 200A has a plurality of two-terminal light emitting elements (e.g., LEDs) 210A-1 to 210A-n. The light emitting elements have anodes connected to the corresponding output terminals Q1 to Q4 of the scanning circuit 100, and cathodes connected to the connector 97-1 via a common terminal IN through which a drive current Tout flows. A total of 4992 LEDs 210A are used for printing an image on A4 size paper with a resolution of 600 dots per inch (dpi).

The printing controller 40 and print head 13A of the aforementioned configuration operate as follows:

For example, if the ON/OFF command signal DRVON is the Low level, the Low level is inverted by the CMOS inverter 61, so that the High level appears on the data terminal DA via the resistor 62. The High level is then directed through the connector 96-1, cable 95-1 and connector 97-1 to the cathodes of the respective LEDs 210A, causing all of the LEDs 210A-1 to 210A-n not to emit light.

Alternatively, if the ON/OFF command signal DRVON is the High level, the High level is inverted by the CMOS 61 so that the Low level appears on the data terminal DA through the resistor 62. Thus, the low level, which is nearly equal to the ground potential, also appears on the common terminal IN via the connector 96-1, cable 95-1, and connector 97-1. At this moment, the scanning circuit 100 applies the High level to the selected LEDs 210A, causing the selected LEDs 210A to turn on. The cathode current (i.e., drive current Iout) of the LED 210A flows into the data terminal DA, producing a corresponding amount of light. As described above, the first modification operates in substantially the same manner as the first embodiment.

{Second Modification to First Embodiment}

Referring to FIG. 8A, the diodes 84-1*a*, 84-2*a*, 85-1*a*, and 85-2*a* may be in the form of parasitic diodes formed by accident when the PMOS transistor 84-1 and 84-2 and NMOS transistors 85-1 and 85-2 are fabricated.

If these PMOS and NMOS transistors are implemented with other form of switching element, e.g., bipolar transistors, the diodes 85-1*a* and 85-2*a* may be designed diodes instead of parasitic diodes, in which case since the diodes 84-1*a* and 84-2*a* do not form a path for the current I2 and therefore may be omitted. This saves the number of circuit elements.

{Effects of First Embodiment and First and Second Modifications}

Effect A

In conventional scanning circuits, a CR differentiation circuit was used in place of the RL differentiation circuit 90 shown in FIG. 5, thereby outputting a two-phase clock from the first and second clock terminals CK1 and CK2 with undershoot at "b" shown in FIG. 8B. Since the CR differentiation circuit fails to transmit a direct current component, first and second output terminals CK1R and CK2R are required for supplying the direct current component for each of the first and second clock terminals CK1 and CK2. In other words, a total of four clock terminals are required for each transfer clock.

In contrast, the RL differentiation circuit 90 differentiates the first and second clock pulses outputted from the first and second output terminals CK1R and CK2R, thereby producing waveforms with undershoot at the portion "b" shown in FIG. 8B. Thus, the single first output terminal CK1R and the single second output terminal CK2R are required for each transfer clock, requiring only half the number of terminals which would otherwise be required in the conventional configuration. These configurations increase the data transfer speed in the print heads 13 and 13A and reduce the circuit size, and hence manufacturing cost.

Effect B

The first embodiment and first and second modifications employ the print heads 13 and 13A, respectively, providing the high quality image forming apparatus with good space utilization efficiency and light outputting efficiency. The print heads 13 and 13*a* are applicable not only to the full color image forming apparatus 1 according to the first embodiment and first and second modifications but also to monochrome and multi color image forming apparatuses, in which case the present invention is particularly useful.

Second Embodiment

A second embodiment differs from the first embodiment in that a print head 13B is used in place of the print head 13. The second embodiment will be described mainly in terms of portions of the print head 13B different from the print head 13.

{Printing Controller and Print Head}

Figure 10:
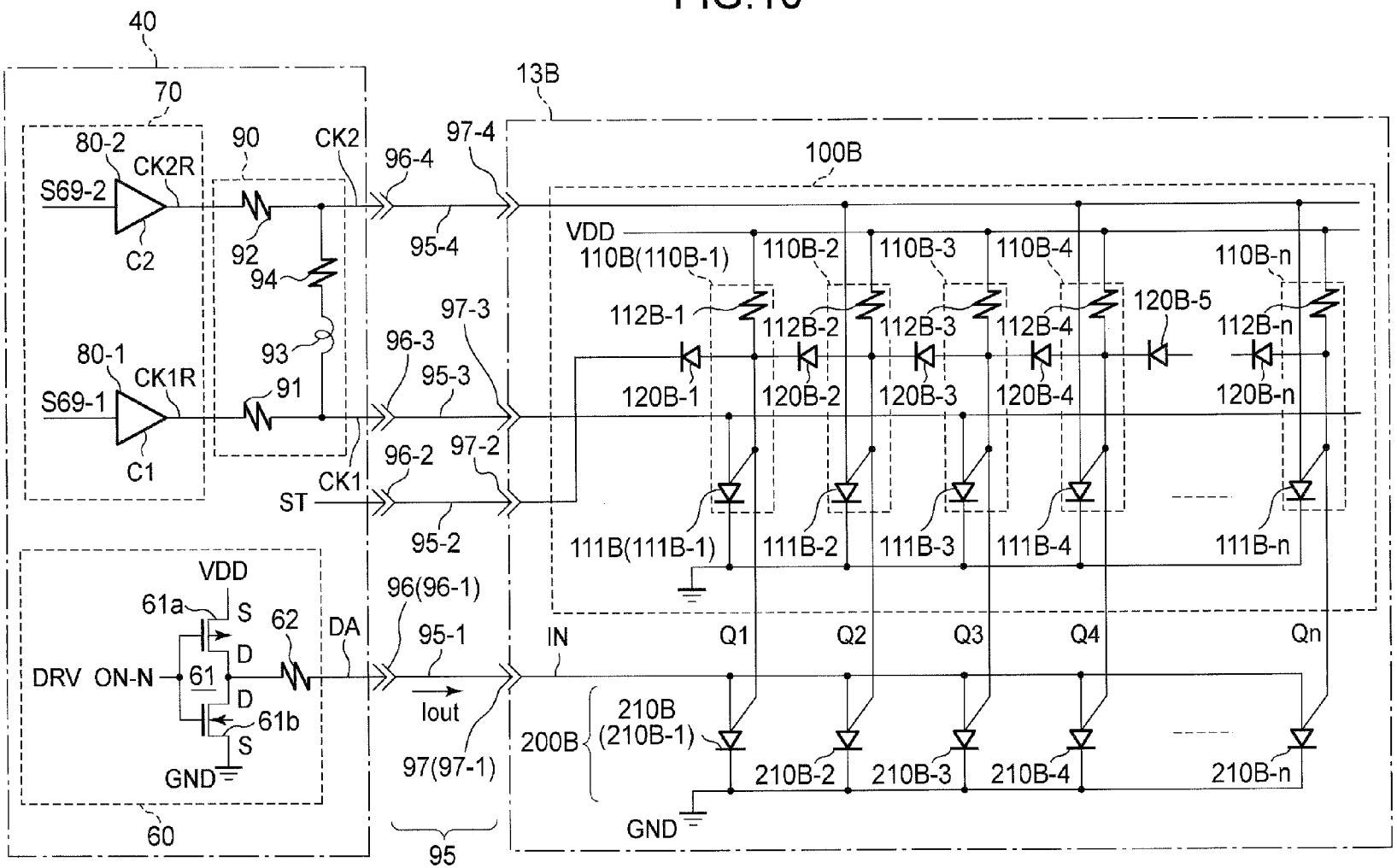
FIG. 10 illustrates the circuit configuration of the printing controller and the print head according to a second embodiment.

FIG. 10 illustrates the circuit configuration of a printing controller 40 and the print head 13B according to the second embodiment. Elements similar to those of the first embodiment shown in FIG. 5 have been given the same reference numerals.

The print head 13B has a scanning circuit 100B and light emitting element arrays 200B. The scanning circuit 100B and light emitting element arrays 200B are connected to the printing controller 40 via cables 95-1 to 95-4 and connectors 96-1 to 96-4 and 97-1 to 97-4 to the printing controller 40.

The light emitting thyristor arrays 200B scanned by the scanning circuit 100B include a plurality of N gate type light emitting thyristors 210B-1 to 210B-n. Each of the N gate type light emitting thyristors has an anode connected to a connector 97-1 via a common terminal IN through which a drive current Iout flows, a cathode connected to the ground GND, and a gate connected to a corresponding one of output terminals Q1 to Qn. The optical print head 13 is capable of forming an electrostatic latent image on the photoconductive drum at a resolution of, for example, 600 dots per inch (dpi), and includes 4992 light emitting thyristors for forming 4992 dots on A4 size paper.

The scanning circuit 100B is clocked by a two-phase clock supplied from first and second clock terminals CK1 and CK2 through connectors 96-3 and 96-4, cables 95-3 and 95-4, and connectors 97-3 and 97-4, thereby controlling the trigger current to turn on or off the light emitting thyristor array 200B. The scanning circuit 100B is a self-scanning shift register. The scanning circuit 100B includes a plurality of sub scanning circuits 110B-1 to 110B-n (n is, for example, 4992), and diodes 120B-1 to 120B-n connected between adjacent sub scanning circuits. The scanning circuit 100B is constituted of self-scanning thyristors 111B-1 to 111B-n and a plurality of resistors 112B-1 to 112B-n.

The sub scanning circuits 110B includes the diode 120B connected to the connector 97-2, and a self-scanning thyristor 111B-1. The self-scanning thyristor 111B-1 has a first terminal (e.g., cathode) connected to the ground (e.g., GND); a second terminal (e.g., anode) connected to a first clock terminal CK1 via a connector 97-3, cable 95-3, and connector 96-3; and a gate connected to the power supply voltage VDD via the resistor 112B-1.

Odd-numbered sub scanning circuits 110B-3, 110B-5, . . . , 110B-($n$−1) include corresponding self-scanning thyristors 111B-1, 111B-3, 111B-5, . . . , 111B-($n$−1). Each of the self-scanning thyristors 111B-3, 111B-5, . . . , 111B-($n$−1)) has the second terminal (anode) connected to the first clock terminal CK1 through the connector 97-3, cable 95-3, and connector 96-3; the cathode connected to the ground GND; and the gate gates connected to the power supply voltage VDD via the second resistors 112B-3, 112B-5, . . . 112-($n$−1), and connected to output terminals Q1, Q3, Q5, . . . Q (n−1), respectively.

Even-numbered sub scanning circuits 110B-2, 110B-4, . . . , 110B-n include corresponding self-scanning thyristors 111B-2, 111B-4, 111B-6, . . . , 111B-n. Each of the self-scanning thyristors 111B-2, 111B-4, . . . , 111B-n has the second terminal (anode) connected to the second clock terminal CK2 through the connector 97-4, cable 95-4, and connector 96-4; the cathode connected to the ground GND; and the gate connected to the power supply voltage VDD via the second resistors 112B-2, 112B-4, 112B-6, . . . 112-$n$, and connected to output terminals Q2, Q4, Qn, respectively.

The self-scanning thyristors 111B-1 to 111B-n in the sub scanning circuits 110B-1 to 110B-n have a similar layer structure to the light emitting thyristors 210B in the light emitting thyristor arrays 200B, and operate in a similar manner. However, the upper layer of the self-scanning thyristors 111B is covered with an opaque material, e.g., metal since the self-scanning thyristors do not have to emit light.

Diodes 120B-2, 120B-3, 1203-4, . . . 120B-n are connected between the gates of adjacent ones of the self scanning thyristors 111B-1, 111B-2, 111B-3, 111B-4, . . . 111B-n. The diodes 1203-2, 120B-3, 120B-4, . . . 120B-n determine the order in which the light emitting thyristors 210B-1, 210B-2, 210B-3, 210B-4, . . . , 210B-n are turned on in sequence.

The self-scanning thyristors 111B-1 to 111B-n in the self-scanning circuit 1003 are clocked by the first clock and the second clock supplied from the first clock terminal CK1 and the second clock terminal CK2, respectively, of the printing controller 40, so that the self-scanning thyristors 111B-1 to 111B-n are selectively turned on one at a time. The ON-state of the self-scanning thyristor 111B of each stage is transmitted to the next adjacent stage upon the first clock and the second clock, so that the entire self-scanning circuit 1003 operates as a shift register.

The printing controller 40 includes a plurality of data driver circuits 60, a clock driver 70, and an RL differentiation circuit 90. The data driver circuit 60 supplies a drive current Iout to the common terminal IN, thereby driving the plurality of light emitting thyristor arrays 200B in a time division manner in response to an ON/OFF command signal DRVON-N. The ON/OFF command signal DRVON-N is a negative logic signal and a square wave signal outputted from an ON/OFF command signal generating circuit (not shown). The clock driver 70 and RL differentiation circuit 90 cooperate to generate a two-phase clock, i.e., the first and second clocks based on square signals S69-1 and S69-2, and supply the first and second clocks to the self-scanning circuit 100B.

For the sake of simplicity, FIG. 10 illustrates only one of the data driver circuits 60. The light emitting thyristor arrays 200B include, for example, a total of 4992 light emitting thyristors 210B-1 to 210B-n, which are grouped into a plurality of groups. The respective groups are driven by corresponding driver circuits 60 so that the respective groups are driven simultaneously in a time division manner.

An exemplary configuration includes light emitting thyristor arrays 200B in chip form, each array including, for example, 192 light emitting thyristors 210B-1 to 210B-n. The 26 arrays are mounted on the printed wiring board 13*b* shown in FIG. 3. This configuration provides a total of 4992 light emitting thyristors 210B-1 to 210B-n necessary for the print head 13B. The 26 light emitting thyristor arrays are driven by corresponding data drivers 60 each of which has 26 output terminals.

The clock driver 70 and RL differentiation circuit 90 are designed to drive the scanning circuit 100B in the form of an array. The clock driver 70 and RL differentiation circuit 90 not only output clock signals but also control the energy required for turning on the self-scanning thyristors 111B. For high-speed operation of the print head 13B, the clock driver 70 and RL differentiation circuit 90 are preferably employed for each self-scanning circuit 100B. However, if low data transfer speed for the print head 13B is acceptable, each combination of the clock driver 70 and RL differentiation circuit 90 may be used to drive a plurality of self-scanning circuits 100B.

The driver apparatus according to the first embodiment is constituted of the data driver 60, clock driver 70, RL differentiation circuit 90, and self-scanning circuit 100B. Alternatively, the data driver 60, clock driver 70, and RL differentiation circuit 90 shown in FIG. 10 may be accommodated in the print head 13B.

{Light Emitting Thyristor of Second Embodiment}

Figure 11C:
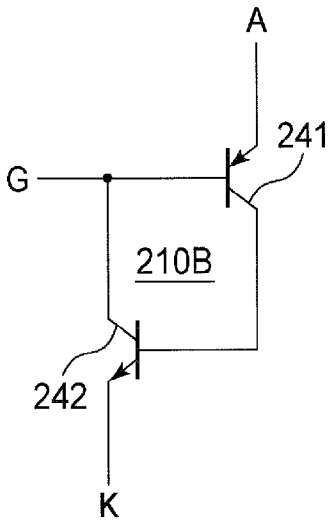
FIG. 11C illustrates an electrical equivalent circuit of the light emitting thyristor 210B shown in FIGS. 11A and 11B.
Figure 11B:
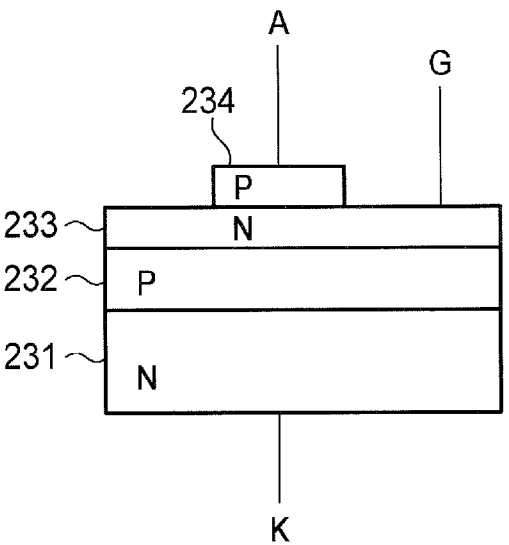
FIG. 11B is a cross-sectional view of the light emitting thyristor shown in FIG. 11A.
Figure 11A:
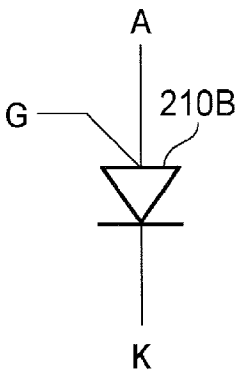
FIG. 11A illustrates the circuit symbol of a light emitting thyristor having an anode, a cathode, and a gate.

FIGS. 11A-11C illustrate the light emitting thyristor 210B shown in FIG. 10.

FIG. 11A illustrates the circuit symbol of the light emitting thyristor 210B having an anode A, a cathode K, and a gate G.

FIG. 11B is a cross-sectional view of the light emitting thyristor 210B. The light emitting thyristor 210B is fabricated as follows: First, a predetermined crystal is epitaxially grown on a P type GaAs wafer by known metal organic chemical vapor deposition (MO-CVD).

A predetermined buffer layer (not shown) is formed on an N type GaAs wafer and then an AlGaAs layer is formed on the buffer. A PNPN structure or a four-layer structure is fabricated on the AlGaAs layer. The four-layer structure includes an N-type layer 231 that contains an N-type impurity, a P-type layer 232 that contains a P-type impurity, an N-type layer 233 that contains an N-type impurity, and a P-type layer 234 that contains a P-type impurity, in this order. Grooves (not shown) are formed in the wafer to define individual devices by a known etching technique.

When etching is performed, a part of the N-type layer 233 is etched to expose. A metal wiring is formed on the exposed region to form a gate G. The uppermost P-type layer 234 is partially exposed and a metal wiring is formed on the exposed region to form an anode. A metal wiring is formed on a side of the N-type layer 231 opposite the P-type layer 232, thereby forming a cathode K.

FIG. 11C illustrates an electrical equivalent circuit of the light emitting thyristor 210B shown in FIGS. 11A and 11B.

The light emitting thyristor 210B is constituted of a PNP transistor 241 and an NPN transistor 242. The emitter of the PNP transistor 241 corresponds to the anode A of the light emitting thyristors 210B, and the base of the PNP transistor 241 corresponds to the gate G of the light emitting thyristors 210B. The emitter of the NPN transistor 242 corresponds to the cathode K of the light emitting thyristor 210B. The collector of the PNP transistor 242 is connected to the base of the NPN transistor 241. The base of the PNP transistor 241 is also connected to the collector of the NPN transistor 242.

The light emitting thyristor 210B shown in FIGS. 11A-11C has an AlGaAs layer formed on the GaAs wafer. The thyristor 210B is not limited to this configuration. The thyristor 210B 0 may have a layer of GaP, GaAsP, AlGaInP or InGaAs formed on the GaAs wafer. Alternatively, the thyristor 210B may have a GaN layer, an AlGaN layer, or an InGaN layer formed on a sapphire substrate.

{Brief Description of Printing Controller and Print Head}

Referring to FIG. 10, if the ON/OFF command signal DRVON-N is the High level, the PMOS transistor 61*a* of the CMOS inverter 61 is OFF and the NMOS transistor 61*b* is ON, so that the data terminal DA is the Low level. The Low level at the data terminal DA is fed to the anodes of the respective light emitting thyristors 210B through the connector 96-1, cable 95-1, connector 97-1, and common terminal IN. As a result, the anode-cathode voltage of the respective light emitting thyristors 210B-1 to 210B-n is substantially zero volts, causing the drive current Tout to become zero, so that none of the light emitting thyristors 210B-1 to 210B-n emits light.

If the ON/OFF command signal DRVON-N is the low level, the PMOS transistor 61*a* of the CMOS inverter 61 is ON and the NMOS transistor 61*b* is OFF, so that the data terminal DA is the High level. The High level at the data terminal DA is fed to the anodes of the respective light emitting thyristors 210B through the connector 96-1, cable 95-1, connector 97-1, and common terminal IN. As a result, the anode-cathode voltage of the respective light emitting thyristors 210B is substantially equal to the power supply voltage VDD.

At this moment, the scanning circuit 100B starts its shifting operation, outputting the Low level to the gates of selected light emitting thyristors 210B that should be turned on. The Low level at the gates causes triggering current to flow into the gates, which in turn causes the light emitting thyristors 210B to turn on. The drive current Iout flows through the data terminal DA, producing a corresponding amount of light.

The cathodes of the light emitting thyristors 210B are grounded. If a High level signal is applied to the anodes of the light emitting thyristors 210B, voltage is applied across the anode and cathode of these light emitting thyristors 210B. Since the gates of the light emitting thyristors 210B are directly connected to the gates of the self-scanning thyristors 111B, voltage is also applied across the gate and cathode of the self-scanning thyristors 111B. Thus, if a Low level signal is applied to the gates of the light emitting thyristors 210 that should be turned on, the Low level signal causes a trigger current to flow through light emitting thyristors 210B that should be on. Thus, the drive current Iout or a cathode current flows through the light emitting thyristors 210B, causing the light emitting thyristors 210B to emit light.

{Detailed Operation of Printing Controller and Print Head}

FIG. 12 is a timing chart illustrating the details of the operation of the printing controller 40 and print head 13B shown in FIG. 10.

FIG. 12 illustrates the waveform of respective signals when the light emitting thyristors 210B-1 to 210B-n (e.g., n=6) are turned on alternately one at a time in a single scanning line.

Before time t1 shown in FIG. 12, the control signals C1 and C2 are the High level, and the square wave signals S69-1 and S69-2 outputted from a square wave generator (not shown) are fed to the first and second output buffers 80-1 and 80-2, respectively. The Low level clock pulses are outputted from the first and second output terminals CK1R and CK2R.

The first output terminal CK1R is connected to the first clock terminal CK1 through the resistor 91. The second output terminal CK2R is connected to the second clock terminal CK2 through the resistor 92. Thus, the anodes of odd-numbered self-scanning thyristors 111B-1, 111B-3, 111B-5 and the anodes of even-numbered self-scanning thyristors 111B-2, 111B-4, 111B-6 are the Low level, and therefore the self-scanning thyristors 111B-1 to 111B-6 are OFF. The ON/OFF command signal DRVON-N is the High level and the output of the CMOS inverter 61 is the Low level. The Low level output of the CMOS inverter 61 is fed to the cathode of the light emitting thyristors 210B-1 to 210B-6 through the resistor 62, data terminal DA, connector 96-1, cable 95-1, connector 97-1, and common terminal IN. Thus, the light emitting thyristors 210B-1 to 210B-6 are OFF.

A description will be given of the process for turning on the self-scanning thyristors 111B-1 and 111B-2 in the sub scanning circuits 110B-1 and 110B-2, respectively.

{Phase I: Turning-on of Thyristor 111B-1}

At time t1 shown in FIG. 12, the first output terminal CK2R goes high, so that the first clock terminal CK2 goes high as depicted at "a". This causes the anode potential of the even-numbered self-scanning thyristors 111B-2, 111B-4, 111B-6 to go high. However, since the odd-numbered self-scanning thyristors 111B-1, 111B-3, and 111B-5 are OFF, the even-numbered self-scanning thyristors 111B-2, 111B-4, and 111B-6 are OFF.

At time t2, the start signal ST goes low to initiate the scanning operation. The Low level of the start signal ST is fed to the cathode of the diode 120B-1 via the connector 96-2, cable 95-2, and connector 97-2.

This means that voltage is fed through a path defined by the second clock terminal CK2, the anode-gate junction of the self-scanning thyristor 111B-2, diodes 120B-2 and 120B-1, and the input terminal of the start signal ST. In a typical design, the forward voltage Vf of the diodes 120B-1 and 120B-2 is about 1.6 V, and the gate-cathode voltage Vgk of the self-scanning thyristors 111B-1 to 111B-6 is also 1.6 V. The High level is nearly equal to the power supply voltage VDD and the Low level is nearly zero volts, i.e., GND. Thus, the sum of the forward voltage in the aforementioned path is given as follows:

$$Vf+Vf+Vgk=1.6+1.6+1.6=4.8\text{ V}$$

Since Vf+Vf+Vgk>VDD, no current flows through the path so that no gate current flows through the self-scanning thyristor 111B-2 and the self-scanning thyristor 111B-2 remains OFF. The same is true of the self-scanning thyristors 111B-4 and 111B-6.

At time t3, the control signal C1 goes low, causing the first output terminal CK1R to enter the Hi-Z state, which is depicted by a dotted line between the High level and Low level in FIG. 12. This blocks the current flowing through the inductor 93, causing a back electromotive force across the inductor 93. As a result, the potential of the first clock terminal CK1 will overshoot the power supply voltage VDD as depicted at "b" in FIG. 12.

In a typical design, the power supply voltage VDD is about 3.3 V, and the anode potential of the self-scanning thyristor 111B-1 overshoots 3.3 V. The cathode of the diode 120B-1 is connected to the input terminal of the start signal ST and has a potential substantially equal to the ground GND. The overshooting waveform at "b" causes current to flow in a path defined by the anode-gate junction of the self-scanning thyristor 111B-1, diode 120B-1, and the input terminal of the start signal ST. This current serves as a triggering current for the self-scanning thyristor 111B-1 to turn on.

At time t4, the control signal C1 goes high, causing the first output terminal CK1R to go high. This creates a path for the anode current of the self-scanning thyristor 111B-1. At substantially t4, the square wave signal S69-1 goes low, causing the second output terminal CK2R to go low. The Low level on the second output terminal CK2R is fed to the second clock terminal CK2 through the resistor 92.

At time t5, the ON/OFF command signal DRVON-N goes low, which in turn is inverted by the CMOS inverter 61. The CMOS inverter 61 outputs the High level, so that the High level appears on the data terminal DA. Thus, a voltage substantially equal to the power supply voltage VDD is applied across the anode and cathode of the light emitting thyristor 210B-1. At this moment, the self-scanning thyristor 111B-1 is ON. Therefore, the light emitting thyristor 210B-1, which has the same gate potential as the self-scanning thyristor 111B-1, turns on. The anode current or drive current Iout as depicted at "c" in FIG. 12 flows through the light emitting thyristor 210B-1, so that the light emitting thyristor 210B-1 emits light.

At time t6, the ON/OFF command signal DRVON-N goes high and is inverted by the CMOS inverter 61. The output of the CMOS inverter 61 is the Low level, and appears on the data terminal DA. Thus, the anode-cathode voltage of the light emitting thyristor 210B-1 becomes substantially zero volts so that the light emitting thyristor 210B-1 turns off, the drive current Iout becoming substantially zero as depicted at "d" in FIG. 12.

The light emitted from the light emitting thyristor 210B-1 may be used to form an electrostatic latent image on the photoconductor drum 11 shown in FIG. 1. The exposing energy is determined by the exposing time (i.e., time t6 to time t5) times the light power produced by the drive current Iout. The light power may vary due to variations in manufacturing process, but the exposing time for individual thyristors may be adjusted to compensate for the variations of light power. If the light emitting thyristor 210B-1 is not to be turned on, the ON/OFF command signal DRVON-N can be maintained high for a period of time from time t5 to time t6. In this manner, the ON/OFF command signal DRVON-N can drive the light emitting thyristors 210B.

{Phase II: Turning-on of Thyristor 111B-2}

At time t7, the control signal C2 goes low, and the second output terminal CK2R enters the Hi-Z state. The Hi-Z state is depicted by a dotted line between the High level and the Low level in FIG. 12.

Since the second output terminal CK2R enters the Hi-Z state immediately after time t7, a back electromotive force is generated across the inductor 93. The back electromotive force causes a waveform to overshoot the power supply voltage VDD as depicted at "e" on the second clock terminal CK2.

At this moment, the anode potential of the self-scanning thyristor 111B-2 is the power supply voltage VDD, which is 3.3 V in a typical design. The overshoot causes the anode potential to exceed 3.3 V. The cathode of the diode 120B-2 is connected to the gate of the self-scanning thyristor 111B-1, so that the self-scanning thyristor 111B-1 is ON. The gate of the self-scanning thyristor 111B-1 is the low level which is close to the ground GND. Therefore, current flows in a path defined by the second clock terminal CK2, the anode-gate junction of the self-scanning thyristor 111B-2, the anode-cathode junction of the diode 120B-2, the gate-cathode junction of the self-scanning thyristor 111B-1, and the ground GND. This current serves as a triggering current for the self-scanning thyristor 111B-2 to turn on.

At time t8, the second output terminal CK2R goes high, causing the anode current of the self-scanning thyristor 111B-2 to continue to flow. Substantially at time t8, the square wave signal S69-1 goes low so that the first output terminal CK1R is the Low level. The Low level signal at the first output terminal CK1R appears on the first clock terminal CK1 via the resistor 91, causing the self-scanning thyristor 111B-1 to turn on.

At time t9, the ON/OFF command signal DRVON-N goes low, which in turn is inverted by the CMOS inverter 61 so that the High level appears on the data terminal DA. The High level on the data terminal DA causes voltage substantially equal to the power supply voltage VDD to appear across the anode and cathode of the light emitting thyristor 210B-2. As described previously, at time t9, the self-scanning thyristor 111B-2 is ON, and the self-scanning thyristor 111B-1 is OFF. Since the self-scanning thyristor 111B-2 is ON, the light emitting thyristor 210B-2, whose gate is at the same potential as the self-scanning thyristor 111B-2, is ON. Thus, the drive current Iout depicted at "f" starts to flow through the cathode of the light emitting thyristor 210B-2, producing a corresponding amount of light.

At time t10, the ON/OFF command signal DRVON-N goes high and is inverted by the CMOS inverter 61. The output of the CMOS inverter 61 goes low, and appears on the data terminal DA. The low level signal on the data terminal DA causes the anode-cathode voltage of the light emitting thyristor 210B-2 to be substantially zero volts. Thus, the light emitting thyristor 210B-2 turns off, and the drive current Iout becomes substantially zero as depicted at "g".

Likewise, the potential on the first and second output terminals CK1R and CK2R change between the High level and the Low level and the ON/OFF command signal DRVON-N becomes ON or OFF in sequence, which causes the light emitting thyristor 210B-3 to 210B-6 to turn on in sequence.

The first and second clocks outputted from the first and second clock terminals CK1 and CK2, respectively, are clocks having substantially the same waveform but different in phase.

The first clocks are fed to the odd-numbered self-self-scanning thyristors 111B-1, 111B-3, and 111B-5 in sequence and the second clocks are fed to the even-numbered self-scanning thyristors 111B-2, 111B-4, and 111B-6 in sequence, so that the self-scanning thyristors 111B-1, 111B-2, 111B-3, 111B-4, 111B-5, and 111B-6 turn on in sequence.

{Waveform with Overshoot Shown in FIG. 12}

FIG. 13A illustrates the clock driver 70 that includes the first and second output buffers 80-1 and 80-2 in the form of a three state logic circuit, RL differentiation circuit 90, and part of the sub scanning circuits 110B-1 and 110B-2 shown in FIG. 10. FIG. 13B illustrates part of the timing chart illustrated in FIG. 12.

Referring to FIG. 13A, the first output buffer 80-1 includes an inverter 81-1 that inverts the control signal C1, a two-input NAND gate 82-1 that outputs a negated logical product of the control signal C1 and the square wave signal S69-1, and a two-input NOR gate 83-1 that outputs a negated logical sum of the output of the inverter 81-1 and the square wave signal S69-1. The second output buffer 80-2 includes an inverter 81-2 that inverts the control signal C1, a two-input NAND gate 82-2 that outputs a negated logical product of the control signal C1 and the square wave signal S69-1, and a two-input NOR gate 83-2 that outputs a negated logical sum of the output of the inverter 81-1 and the square wave signal S69-1.

The output of the NAND gate 82-1 is connected to the gate of a first switch element or PMOS transistor 84-1. The output of the NOR gate 83-1 is connected to the gate of a second switch element or NMOS transistor 85-1. A diode 84-1*a* is a connected in parallel with the PMOS transistor 84-1. A diode 85-1*a* is connected in parallel with the NMOS transistor 85-1.

Likewise, the PMOS transistor 84-2 has a gate connected to the output of the NAND gate 82-2, a source connected to the VDD, and a drain connected to the second output terminal CK2R. The NMOS transistor 85-2 has a gate connected to the output of the NOR gate 83-2, a drain connected to the second output terminals CK2R, and a source connected to the ground GND. The diode 84-2*a* has a cathode connected to the power supply voltage VDD and an anode connected to the second output terminal CK2R. The diode 85-2*a* has a cathode connected to the second output terminal CK2R and an anode connected to the ground GND.

The diode 85-1*a* is not essential to the circuit operation but is formed by accident as a parasitic diode between the substrate and the drain of the NMOS transistor 85-1 when the NMOS transistor 85-1 is fabricated. Likewise, the diode 85-2*a* is not essential to the circuit operation but is formed by accident as a parasitic diode between the substrate and the drain of the NMOS transistor 85-2 when the NMOS transistor 85-2 is fabricated.

The first output buffer 80-1 and second output buffer 80-2 operate in the same manner, and only the first output buffer 80-1 will be described for simplicity.

If the control signal C1 is the High level, the square waveform signal S69-1 is the Low level, then the outputs of the NAND gate 82-1 and NOR gate 83-1 are both the High level, so that the PMOS transistor 84-1 is OFF and the NMOS transistor 85-1 is ON. Thus, the first output terminal CK1R is the Low level. If the control signal C1 and square wave signal S69-1 are both the High level, the outputs of the NAND gate 82-1 and NOR gate 83-1 are both the Low level, so that the PMOS transistor 84-1 is ON and the NMOS transistor 85-1 is OFF. Thus, the first output terminal CK1R is the High level. If the control signal C1 is the Low level and the square waveform signal S69-1 is the Low level, then the output of the NAND gate 82-1 is the High level and the output of the NOR gate 83-1 is the Low level, so that the PMOS transistor 84-1 and NMOS transistor 85-1 are both OFF. Thus, the first output terminal CK1R enters the Hi-Z state.

As describe with reference to FIG. 10, the self-scanning thyristor 111B-1 has its cathode connected to the ground GND and its anode connected to the first clock terminal CK1. The first clock terminal CK1 is connected to the first output terminal CK1R through the resistor 91. The self-scanning thyristor 111B-2 has its cathode connected to the ground GND and its anode connected to the second clock terminal CK2. The second clock terminal CK2 is connected to the second output terminal CK2R through the resistor 92. A series circuit of the inductor 93 and the resistor 94 is connected between the first and second clock terminals CK1 and CK2.

Referring to FIG. 13A, a diode 120B-1 has an anode connected to the gate of the scanning thyristor 111B-1 and a cathode connected to the start signal ST. When the self-scanning thyristor 111-1 turns on, the start signal ST is substantially the same as the ground GND. Thus, the cathode of the diode 120B-1 is connected to the ground GND as shown in FIG. 13A for simplicity.

For example, let's consider a case in which the first output terminal CK1R is the Low level and the second output terminal CK2R is the High level.

This corresponds to the situation immediately before time t3 shown in FIGS. 12 and 13B. Immediately before time t4, a current I1 flows in a direction shown by a solid line shown in FIG. 13A in a path defined by the power supply voltage VDD, PMOS transistor 84-2, second output terminal CK2R, resistors 92 and 94, inductor 93, resistor 91, NMOS transistor 85-1, and the ground GND.

Immediately after time t3, the control signal C1 goes low, causing the NMOS transistor 85-1 to go off so that the first output terminal CK1R enters Hi-Z state. This causes a back electromotive force in the inductor 93 with the polarities shown in FIG. 13A, which results in a current I2 shown by a dotted line. The current I2 flows in a path defined by the positive sign of the inductor 93, resistor 91, diode 84-1*a*, power supply voltage VDD, PMOS transistor 84-2, second output terminal CK2R, resistors 92 and 94, and the negative sign of the inductor 93.

Let's focus our attention on the second current path. The cathode of the diode 84-1*a* is connected to the power supply voltage VDD so that the potential of the first output terminal CK1R is higher than that of the power supply voltage VDD by the forward voltage of the diode 84-2*a*. Therefore, the potential of the second clock terminal CK2 is higher than that of the cathode of the diode 84-2*a* by the voltage drop across the resistor 92. As a result, as shown by a dot-dashed line, a current I3 flows in a path defined by the first clock terminal CK1, the anode-gate junction of the self-scanning thyristor 111B-1, diode 120B-1, and the ground GND. The gate current that flows through the gate-cathode junction of the self-scanning thyristor 111B-1 serves as a triggering current for the self-scanning thyristor 111B-1 to turn on.

FIG. 13B illustrates the waveforms of the signals on the first output terminal CK1R and first clock terminal CK1. When the first output terminal CK1R changes from the low level to the Hi-Z state, the signal on the first clock terminal CK1 will abruptly overshoot the power supply voltage VDD as depicted at "b," being higher than the VDD by voltage Vp.

In a typical design, the power supply voltage VDD is 3.3 V, the forward voltage Vf of the diode 120B-2 is about 1.6 V, and the forward voltage Vag of the anode-gate junction of the self-scanning thyristor 111B-1 is about 1.6 V. In order for the current I3 to flow in the dot-dashed line path, the following relationship must be satisfied.

$$Vf+Vgk<VDD+Vp$$

At this moment, if the signal on the first clock terminal CK1 shown in FIG. 13B had no overshoot "b" so that Vp=0 V, the value of Vf+Vgk would be as follows:

$$Vf+Vgk=1.6\text{ V}+1.6\text{ V}=3.2\text{ V}$$

This implies that Vf+Vgk is somewhat lower than the power supply voltage VDD and therefore cannot cause sufficient gate current for the thyristor 111B-1 to turn on.

In contrast, in the first embodiment, the overshoot voltage Vp=0.6 V is produced to satisfy the following relationship.

$$VDD+Vp=3.3\text{ V}+0.6\text{ V}=3.9\text{ V}$$

This indicates that the value of VDD+Vp is greater than Vf+Vgk and can cause sufficient trigger current for the self-scanning thyristor 111B-1 to turn on.

{Modification to Second Embodiment}

A modification to the second embodiment uses a plurality of two-terminal light emitting elements (e.g., LED) 210B-1 to 210B-n in place of the light emitting arrays 200B. The LEDs have anodes connected to the corresponding output terminals Q1 to Q4 of the scanning circuit 100B, and cathodes connected to the connector 97-1 via a common terminal IN through which a drive current Iout flows.

The print head of the aforementioned configuration operates in much the same way as the second embodiment.

{Effects of Second Embodiment and Modification}

The second embodiment and its modification provide the following effects.

According to the second embodiment and modification, the RL differentiation circuit 90 differentiates the first and second clock pulses outputted from the first and second output terminals CK1R and CK2R, thereby producing waveforms with overshoot at the portion "b" shown in FIG. 13B. Thus, a single first output terminal CK1R and a single second output terminal CK2R are required for each transfer clock, requiring only half the number of terminals which would otherwise be required in the conventional configuration. These configurations increase the data transfer speed in the print head 13B and reduce the circuit size, and hence manufacturing cost.

The print head 13B provides similar effects to those of effect B of the first embodiment.

The present invention is not limited to the first and second embodiments and the modifications thereof. The invention may include the following variations.

{Further Modifications}

The first embodiment, second embodiment, and modification to the second embodiment have been described in terms of light emitting thyristors 210 and 210B and LEDs 210A. The present invention may also be applicable to other configurations in which thyristors are used as switching elements that control the voltage applied to light emitting elements (e.g., organic electroluminescence, OEL). The print heads 13 and 13A are applicable to printers that employ a print head constituted of OEL elements and display devices that have a row of display elements.

Third Embodiment

{Circuit of Optical Print Head}

Figure 14:
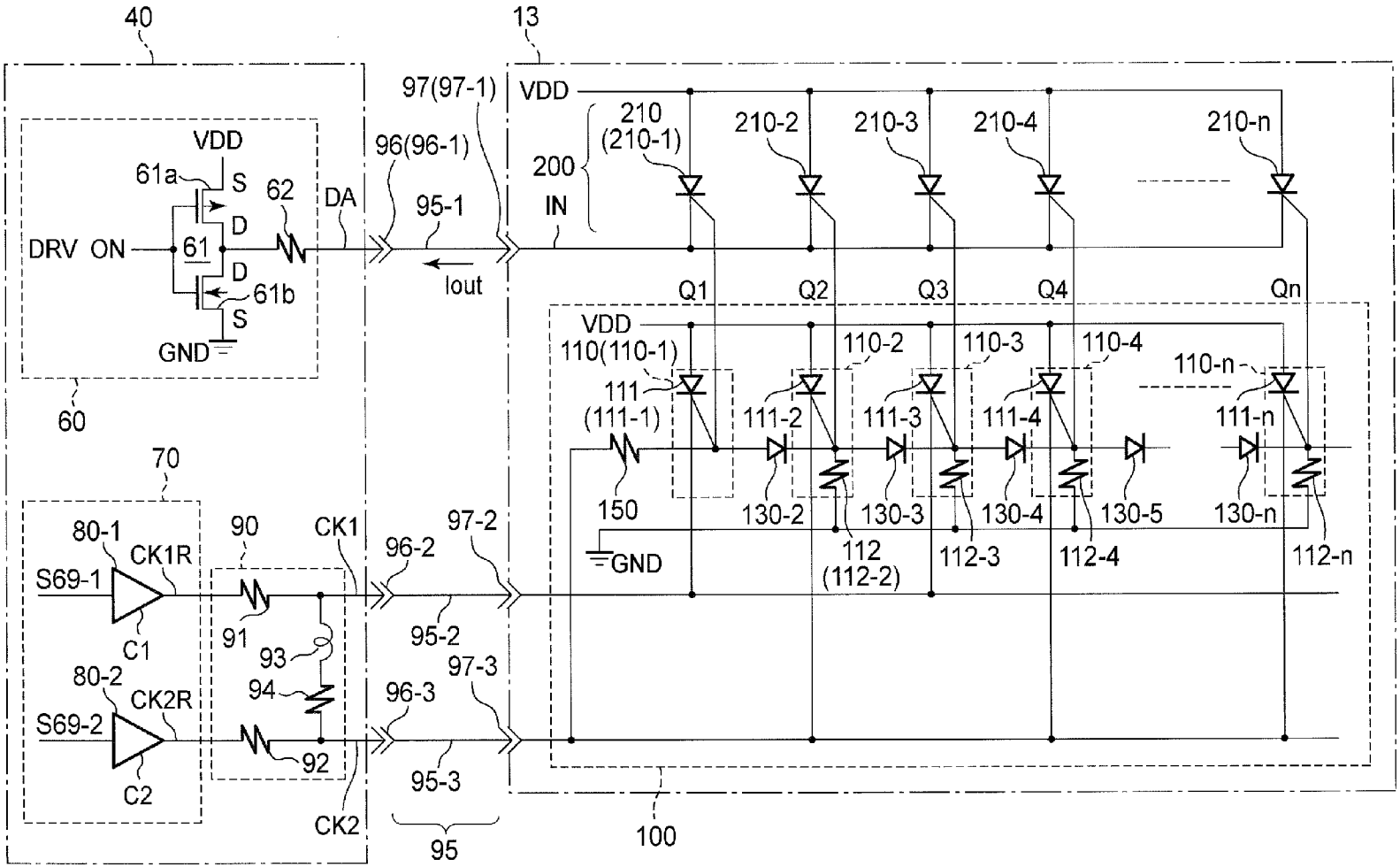
FIG. 14 illustrates the circuit configuration of the optical print head according to a third embodiment shown in FIG. 4.

FIG. 14 illustrates the circuit configuration of the optical print head 13 according to a third embodiment.

The print head 13 includes a chip 13*c* shown in FIG. 3 that has a scanning circuit 100 and light emitting thyristor arrays 200 therein. The scanning circuit 100 and light emitting thyristor arrays 200 are connected to a printing controller 40 via cables 95-1 to 95-3, connectors 96-1 to 97-3 to which the signal lines 95-1 to 95-3 are connected.

The light emitting thyristor array 200 are scanned by the scanning circuit 100, and includes a plurality of P gate type light emitting thyristors 210-1 to 210-*n*. Each of the P gate type light emitting thyristors has an anode connected to a first power supply (e.g., power supply voltage VDD), a cathode connected to a connector 97-1 via a common terminal IN through which a drive current Iout flows, and a gate connected to a corresponding output terminal (Q1 to Qn). When the power supply voltage VDD is applied across the anode and cathode of each light emitting thyristor 210, if a trigger signal (e.g., triggering current) is applied to the gate, the light emitting thyristor 210 is turned on so that current flows from anode to cathode.

The optical print head 13 is capable of forming an electrostatic latent image on the photoconductive drum, and includes 4992 light emitting thyristors for forming 4992 dots on A4 size paper at a resolution of 600 dots per inch (dpi).

The scanning circuit 100 is clocked by a two-phase clock supplied from the printing controller 40 through first and second clock terminals CK1 and CK2, connectors 96-2 and 96-3, cables 95-2 and 95-3, and connectors 97-2 and 97-3, thereby controlling the trigger current to turn on or off the light emitting thyristor array 200. The scanning circuit 100 is a self-scanning shift register. The scanning circuit 100 includes a plurality of sub scanning circuits 110-1 to 110-*n* (n is, for example, 4992), a resistor 150 through which the second clock for starting the self-scanning operation is supplied from the second clock terminal CK2, a plurality of diodes 130-2 to 130-*n* (n is, for example, 4992) for determining the order or direction of scanning.

The first stage of sub scanning circuits includes the resistor 150 connected to the connector 97-3 and a self-scanning thyristor 111-1. The self-scanning thyristor 111-1 has a first terminal (e.g., anode) connected to the power supply voltage VDD or a first power supply, and a second terminal (e.g., cathode) connected to the connector 97-2. Each of the second stage of the sub scanning circuits and onward (i.e., 110-2 to 110-*n*) includes a self-scanning thyristor (111-2 to 111-*n*) having a first terminal (e.g., anode) connected to the power supply voltage VDD or a first power supply, and a resistor (112-2 to 112-*n*) connected between the control terminal of the self-scanning thyristor 111 (e.g., gate) and a second power supply voltage (e.g., GND).

Odd-numbered sub scanning circuits 110-1, 110-3, 110-5, . . . , 110-(*n*−1) include corresponding self-scanning thyristors 111-1, 111-3, 111-5, . . . , 111-(*n*−1). Each self-scanning thyristor has an anode connected to the power supply voltage VDD and the cathode (second terminal) connected to the first clock terminal CK1 via the cable 95-2 and the connector 96-2. The self-scanning thyristor 111-1 has the gate connected to the second clock terminal CK2 via the resistor 150, connector 97-3, cable 95-3, and connector 96-3, and connected to an output terminal Q1 of the first stage. The odd-numbered self scanning thyristors 111-3, 111-5, . . . 111-(*n*−1) of the third stage and onward have their gates connected to the ground GND via the resistors 112-3, 112-5, . . . 112-(*n*−1), and connected to output terminals Q3, Q5, . . . Q (n−1), respectively.

Even-numbered sub scanning circuits 110-2 110-4, 110-6, . . . , 110-*n* include corresponding self-scanning thyristors 111-2, 111-4, 111-6, . . . , 111-*n*. Each self-scanning thyristor has an anode connected to the power supply voltage VDD and the cathode (second terminal) connected to the second clock terminal CK2 via the connector 97-3, the cable 95-3 and the connector 96-3. The even-numbered self-scanning thyristors 111-2, 111-4, 111-6, . . . 111-*n* have the gate connected to the ground GND via the resistors 112-2, 112-4, 112-6, . . . 112-*n*, and connected to output terminals Q2, Q4, Q6, . . . Qn, respectively.

The gate of self-scanning thyristor 111-1 is connected to the second clock terminal CK2 via the resistor 150, connector 97-3, cable 95-3, and connector 96-3. Diodes 130-2, 130-3, 130-4, . . . 130-*n* are connected between the gates of adjacent ones of the self-scanning thyristors 111-1, 111-2, 111-3, 111-4, . . . 111-*n*. The diodes 130-2, 130-3, 130-4, . . . 130-*n* determine the order in which the light emitting thyristors 210-1, 210-2, 210-3, 210-4, 210-*n* are turned on in sequence.

The self-scanning thyristors 111 in the scanning circuit 100 have a similar layer structure to the light emitting thyristors 210 in the light emitting thyristor arrays 200, and operate in a similar manner. However, the upper layer of the self-scanning thyristors 111 is covered with an opaque material, e.g., metal since the self-scanning thyristors do not have to emit light.

The self-scanning thyristors 111-1 to 111-*n* in the self-scanning circuit 100 are clocked by the first clock and the second clock supplied from the first clock terminal CK1 and the second clock terminal CK2, respectively, of the printing controller 40, so that the self-scanning thyristors 111-1 to 111-*n* are selectively turned on. The ON-state of the self-scanning thyristors 111-1 to 111-*n* is transmitted to the light emitting thyristor arrays 200, causing corresponding light emitting thyristors 210-1 to 210-*n* to emit light. The ON-state of the self-scanning thyristor 111 of each stage is transmitted to the next adjacent stage upon the first clock and the second clock, so that the entire scanning circuit 100 operates as a shift register.

The resistor 112 is not present between the gate of the self-scanning thyristor 111-1 and the ground GND for the purpose of saving parts. If saving parts is not primary importance, then the resistor 112 may be used between the gate of the self-scanning thyristor 111-1 and the ground GND.

Also, the diode 130 is missing from between the gate of the first stage self-scanning thyristor 111-1 and the second clock terminal CK2. However, the resistor 150 is used in place of the diode 130. Thus, another way of looking at the circuit configuration is that a resistor between the gate of the first stage self-scanning thyristor 111-1 and the ground GND is removed and is connected between the second clock terminal CK2 and the gate, and a diode is removed from between the second clock terminal CK2 and the gate of the first stage self-scanning thyristor 111-1. This configuration provides the following advantages.

When the image forming apparatus 1 is in the standby state where printing is not performed, the first and second clocks supplied from the first and second clock terminals CK1 and CK2, respectively, are at the High level. If the resistor 112 is connected between the gate of the self-scanning thyristor 111-1 and the ground GND, current flows from the second clock terminal CK2 at the High level to the ground GND through the resistors 150 and 112. This current causes unnecessary power consumption, increasing the power consumption in the standby state. In addition, the current flowing through the resistors 150 and 112 is detrimental to the measuring of leak current during the inspection stage after the assembly of the print head 13.

If the self-scanning thyristors 111-1 to **111-*n*** have some defects due to an improper semiconductor manufacturing process, a small leakage current less than 1 μA may flow during the standby state. The small leakage current may be measured to identify a defective thyristor, thereby selecting only good thyristors with no leakage current. However, if the power consumption in the standby state is significant, it is difficult to detect a small increase in current due to the leakage current.

In contrast, the configuration of the third embodiment, the resistor 112 is not present between the gate of the self-scanning thyristor 111-1 and the ground GND. Thus, no current flows between the gate of the self-scanning thyristor 111-1 and the ground GND. This results in thyristors that have no power consumption during the standby state. Besides, the defective thyristors due to the leakage current can be effectively removed, thereby ensuring high quality thyristors.

The print head 13 incorporating the scanning circuit 100 is connected to the printing controller 40. The printing controller 40 includes a plurality of data driver circuits 60, a clock driver 70, and an RL differentiation circuit 90. The data driver circuit 60 supplies a drive current Iout to the common terminal IN, thereby driving the plurality of light emitting thyristor arrays 200 in a time division manner in response to an ON/OFF command signal DRVON. The ON/OFF command signal DRVON is a square wave signal outputted from an ON/OFF command signal generating circuit (not shown). The clock driver 70 and RL differentiation circuit 90 generate the first and second clocks to be supplied to the scanning circuit 100, based on square signals S69-1 and S69-2 outputted from the ON/OFF command signal generating circuit.

For the sake of simplicity, FIG. 14 illustrates only one of the data driver circuits 60. The light emitting thyristor arrays 200 include, for example, a total of 4992 light emitting thyristors 210-1 to **210-*n*, which are grouped. The respective groups are driven by corresponding driver circuits 60** so that the respective groups are driven simultaneously in a time division manner.

An exemplary configuration includes light emitting thyristor arrays 200 in chip form, each array including 192 light emitting thyristors 210. The 26 arrays are mounted on the printed wiring board **13*b* shown in FIG. 3. This configuration provides a total of 4992 light emitting thyristors 210-1 to 210-*n* necessary for the print head 13. The 26 light emitting thyristor arrays are driven by corresponding data drivers 60** which has 26 output terminals.

The clock driver 70 and RL differentiation circuit 90 are designed to drive the scanning circuit 100 in the form of an array. The clock driver 70 and RL differentiation circuit 90 not only output clock signals but also control the energy required for turning on the self-scanning thyristors 111. For high-speed operation of the print head 13, the clock driver 70 and RL differentiation circuit 90 are preferably fabricated for each scanning circuit 100. However, if low speed data transfer for the print head 13 is acceptable, a combination of the clock driver 70 and RL differentiation circuit 90 may be used to drive a plurality of scanning circuits 100.

The driver apparatus according to the third embodiment is constituted of the data driver 60, clock driver 70, RL differentiation circuit 90, and scanning circuit 100. The data driver 60, clock driver 70, and RL differentiation circuit 90 shown in FIG. 14 may be accommodated either in the print head 13 or in the printing controller 40.

The data driver 60 includes a CMOS inverter 61 constituted of CMOS transistors, and a resistor 62 connected between the output terminal of the CMOS inverter 61 and a data terminal DA. The CMOS inverter 61 receives the ON/OFF command signal DRVON from the ON/OFF command signal generation circuit (not shown), and outputs the inverted the ON/OFF command signal. The CMOS inverter 61 includes a P type MOS transistor (referred to PMOS transistor hereafter) **61*a* and an N type MOS transistor (referred to as NMOS transistor hereafter) 61*b*. These transistors 61*a* and 61*b*** are connected in series between the power supply voltage VDD and the ground GND.

The PMOS transistor **61*a* has a gate that receives the ON/OFF command signal DRVON, a source connected to the power supply voltage VDD, and a drain connected to one end of the resistor 62. The NMOS transistor 61*b* has a gate that receives the ON/OFF command signal DRVON, a source connected to the ground GND, and a drain connected to the one end of the resistor 62. The other end of the resistor 62 is connected to the data terminal DA. The data terminal DA is connected commonly to the cathodes of light emitting thyristors 210 through the connector 96-1, cable 95-1, connector 97-1, and the common terminal IN of the print head 13. The drive current Tout flows in the data terminal DA when the plurality of light emitting thyristors 210** are driven in sequence.

The clock driver 70 includes a first output buffer 80-1, a second output buffer 80-2, a first output terminal CK1R, and a second output terminal CK2R. The first and second output buffers 80-1 and 80-2 receive square wave signals S69-1 and S69-2, respectively, as scanning signals outputted from a square wave generator (not shown). The first and second output terminals CK1R and CK2R are connected to the outputs of the first and second output buffers 80-1 and 80-2.

The first and second output buffers 80-1 and 80-2 are of the same circuit configuration, and may be implemented with a CMOS inverter, so that the output of the output buffer may be either the High level or the Low level. However, it is desirable that the first and second output buffers 80-1 and 80-2 are a three-state output which can be one of the High level, the Low level, and the High impedance state (i.e., Hi-Z state). The first and second output buffers 80-1 and 80-2 have an output logic level equal to that at the input terminal when the control signals C1 and C2 are the High level, and an output terminal of Hi-Z state when the control signal C1 and C2 are the low level. As described above, a three-state configuration can have a High level output, a Low level output, and a Hi-Z state. In addition to the High level and the Low level, the output buffer has the Hi-Z state, thereby generating drive signals having a waveform suitable for triggering the gate of the self-scanning thyristor 111.

The RL differentiation circuit 90 having the first and second clock terminals CK1 and CK2 is connected across the first and second output terminals CK1R and CK2R. RL differentiation circuit 90 includes a resistor 91 connected between the first clock terminal CK1, first output terminal CK1R, a resistor 92 connected between the second clock terminal CK2 and the second output terminal CK2R, and a series connection of an inductor 93 and a resistor 94 connected between the first clock terminal CK1 and the second clock terminal CK2.

The inductor 93 may be implemented with a high permeability ferrite bead on which a thick film wiring layer is formed connecting one end electrode of the inductor to the other, the thick film wiring being formed either on the outer surface of the ferrite bead or on the inner surface.

The first clock terminal CK1 is connected to the scanning circuit 100 via the connector 96-2, cable 95-2, and connector 97-2. The second clock terminal CK2 is connected to the scanning circuit 100 via the connector 96-3, cable 95-3, and connector 97-3.

The resistors 91 and 92 and resistor 94 may be omitted if the clock driver 70 has sufficient drive capability for driving the self-scanning circuit.

{Light Emitting Thyristor of Third Embodiment}

The light emitting thyristors according to the third embodiment are the same as those according to the first embodiment.

{Brief Description of Operation of Printing Controller and Print Head}

Referring to FIG. 14, if the ON/OFF command signal DRVON is the Low level, the PMOS transistor 61*a* of the CMOS inverter 61 is ON and the NMOS transistor 61*b* is OFF, so that the data terminal DA is the High level. The High level at the data terminal DA is fed to the cathodes of the respective light emitting thyristors 210 through the connector 96-1, cable 95-1, connector 97-1, and common terminal IN. As a result, the anode-cathode voltage of the respective thyristors is substantially zero volts, causing the drive current Iout to become zero, so that none of the light emitting thyristors 210-1 to 210-*n* emits light.

If the ON/OFF command signal DRVON is the High level, the PMOS transistor 61*a* of the CMOS inverter 61 is OFF and the NMOS transistor 61*b* is ON, so that the data terminal DA is the Low level. The Low level at the data terminal DA is fed to the cathodes of the respective light emitting thyristors 210 through the connector 96-1, cable 95-1, connector 97-1, and common terminal IN. As a result, the anode-cathode voltage of the respective thyristors is substantially equal to the power supply voltage VDD.

At this moment, the scanning circuit 100 starts its shifting operation upon the High level of the second clock supplied from the second clock terminal CK2 through the resistor 150, outputting the High level signal to the gates of light emitting thyristors 210 that should be turned on. The High level at the gates causes a trigger current in the gates, which in turn causes the light emitting thyristors 210 that should be turned on. The cathode current (i.e., drive current Iout) flows into the data terminal DA, producing light.

When the Low level is fed to the cathodes of the light emitting thyristors to be turned on, their anode-cathode voltage is equal to the power supply voltage VDD. Since the gates of the light emitting thyristors 210 are directly connected to the gates of the self-scanning thyristors 111, a voltage is also applied across the gate and cathode of the self-scanning thyristors 111. Thus, if a High level signal is applied to the gates of the light emitting thyristors 210 that should be turned on, the High level signal causes a trigger current through light emitting thyristors 210 that should be turned on. Thus, the drive current Tout or a cathode current flows through the light emitting thyristors 210, causing the light emitting thyristors 210 to emit light.

{Detailed Operation of Printing Controller and Print Head}

Figure 15:
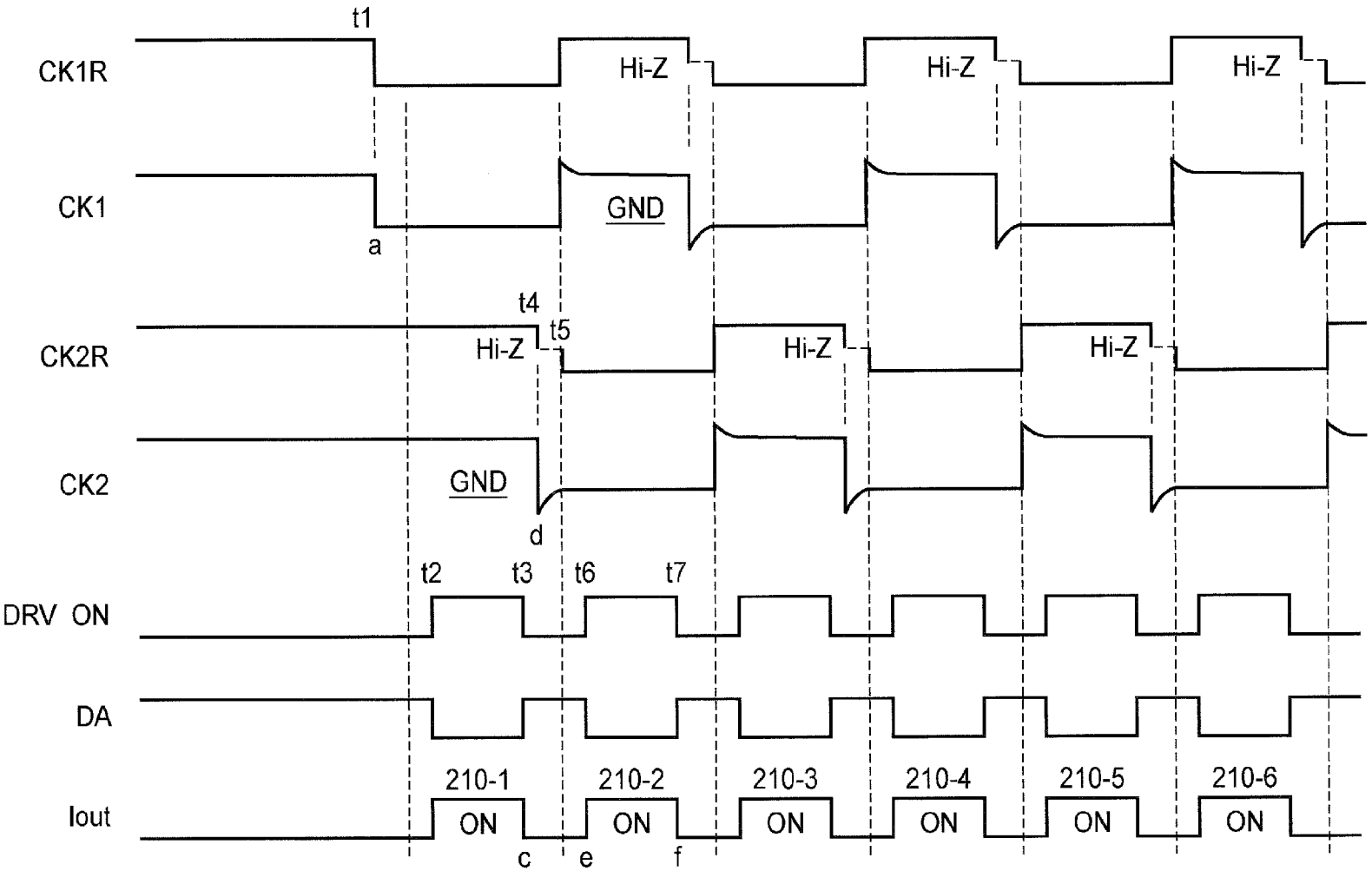
FIG. 15 is a timing chart illustrating the details of the operation of the printing controller and print head shown in FIG. 14.

FIG. 15 is a timing chart illustrating the details of the operation of the printing controller 40 and print head 13 shown in FIG. 14.

FIG. 15 illustrates the waveform of respective signals when the light emitting thyristors 210-1 to 210-*n* (e.g., n=6) are turned on alternately one at a time in a single scanning line.

The scanning circuit 100 using self-scanning thyristors 111 operates on the two-phase clock outputted from the first and second clock terminals CK1 and CK2. The two-phase clock is driven by the clock driver 70 having the first and second output terminals CK1R and CK2R.

Before time t1 shown in FIG. 15, the control signals C1 and C2 are the High level, and the square wave signals S69-1 and S69-2 outputted from the square wave generator (not shown) are fed to the first and second output buffers 80-1 and 80-2. The high level clock pulses are outputted from the first and second output terminals CK1R and CK2R.

The first output terminal CK1R is connected to the first clock terminal CK1 through the resistor 91. The second output terminal CK2R is connected to the second clock terminal CK2 through the resistor 92. Thus, before shown in FIG. 15, the cathodes of odd-numbered self-scanning thyristors 111-1, 111-3, 111-5 and the cathodes of even-numbered self-scanning thyristors 111-2, 111-4, 111-6 are the High level, and therefore the self-scanning thyristors are OFF. The ON/OFF command signal DRVON is the Low level and the output of the CMOS inverter 61 is the High level. The High level output of the CMOS inverter 61 is fed to the cathode of the light emitting thyristors 210-1 to 210-6 through the resistor 62, data terminal DA, connector 96-1, cable 95-1, connector 97-1, and common terminal IN. Thus, the light emitting thyristors 210-1 to 210-6 are OFF.

A description will be given of the process for turning on the self-scanning thyristors 111-1 and 111-2 in the sub scanning circuits 110-1 and 110-2, respectively.

{Phase I: Turning-on of Thyristor 111-1}

At time t1 shown in FIG. 15, the first output terminal CK1R goes low, so that the first clock terminal CK1 goes low as depicted at "a" causing the cathodes of the odd-numbered self-scanning thyristors 111-1, 111-3, 111-5 to become Low level. At time t1, the second output terminal CK2R is the High level, which in turn supplies a trigger current to the self-scanning thyristor 111-1. The trigger current flows through a path defined by the first clock terminal CK2, resistor 150, gate-cathode junction of the self-scanning thyristor 111-1, and the second clock terminal CK1. This trigger current causes the self-scanning thyristor 111-1 to turn.

In a typical design, when the self-scanning thyristor 111-1 turns on, the gate-cathode voltage is typically about 1.6 V. The power supply voltage VDD is about 3.3 V. The High level of the second clock terminal CK2 is substantially equal to the power supply voltage VDD which is sufficient to cause the gate current to flow into the self-scanning thyristor 111-1, eliminating the need for adding a later described prior art waveform with undershoot to the cathode.

At time t2, the ON/OFF command signal DRVON goes high, which in turn is inverted by the CMOS inverter 61. The CMOS inverter 61 outputs the Low level, so that the Low level appears on the data terminal DA. Thus, a voltage substantially equal to the power supply voltage VDD is applied via the common terminal IN across the anode and cathode of the light emitting thyristor 210-1. At this moment, the self-scanning thyristor 111-1 is ON. Therefore, the light emitting thyristor 210-1, which has the same gate potential as the self-scanning thyristor 111-1, turns on. The cathode current or drive current Tout as depicted at "b" starts to flow through the cathode of the light emitting thyristor 210-1, so that the light emitting thyristor 210-1 emits light.

At time t3, the ON/OFF command signal DRVON goes low and is inverted by the CMOS inverter 61. The output of the CMOS inverter 61 is now the High level, and appears on the data terminal DA. Thus, the anode-cathode voltage becomes substantially zero volts so that the light emitting thyristor 210-1 turns off, the drive current Iout becoming zero as depicted at "c".

The light emitted from the light emitting thyristor 210-1 may be used to form an electrostatic latent image on the photoconductor drum 11 shown in FIG. 1. The exposing energy is determined by the exposing time (i.e., time t3 to time t2) times the light power produced by the drive current Iout. The light power may vary due to variations in manufacturing process, but the exposing time for individual thyristors may be adjusted to compensate for the variations of light output. If the light emitting thyristor 210-1 is not to be turned on, the ON/OFF command signal DRVON can be maintained low for a period of time from time t2 to time t3. In this manner, the ON/OFF command signal DRVON can drive the light emitting thyristors 210 to become either ON or OFF.

{Phase II: Turning-on of Thyristor 111-2}

At time t4, the control signal C2 goes low, and the second output terminal CK2R enters the Hi-Z state. The Hi-Z state is depicted by a dotted line between the High level and the Low level in FIG. 15.

Immediately before time t4, the second output terminal CK2R is the High level and the first output terminal CK1R is the Low level. Therefore, current flows in a path defined by the second output terminal CK2R, resistors 92 and 94, inductor 93, resistor 91, and first output terminal CK1R (Low level). Since the second output terminal CK2R enters the Hi-Z state immediately after time t4, a back electromotive force is generated across the inductor 93. The back electromotive force causes a waveform that undershoots the ground level as depicted at "d" on the second clock terminal CK2.

At this moment, the anode potential of the self-scanning thyristor 111-2 is the power supply voltage VDD, which is 3.3 V in a typical design. The anode of the diode 130-2 is connected to the gate of the self-scanning thyristor 111-1, so that the self-scanning thyristor 111-1 is ON. The gate is the High level which is close to the power supply voltage VDD. Therefore, current flows in a path defined by the gate of the self-scanning thyristor 111-1, the anode-cathode junction of the diode 130-2, the gate-cathode junction of the self-scanning thyristor 111-2, and the second clock terminal CK2. This current serves as a trigger current for the self-scanning thyristor 111-2 to turn on.

At time t5, the second output terminal CK2R goes low, creating a current path for the cathode current of the self-scanning thyristor 111-2. Substantially at time t5, the first output terminal CK1R goes high so that the first clock terminal CK1 also goes high. Thus, the cathode potential of the self-scanning thyristor 111-1 goes up so that the anode-cathode voltage abruptly decreases, causing the self-scanning thyristor 111-1 to turn off.

At time t6, the ON/OFF command signal DRVON goes high and is inverted by the CMOS inverter 61. The output of the CMOS inverter 61 goes low, and appears on the data terminal DA. The Low level signal at the data terminal DA causes the anode-cathode voltage of the light emitting thyristor 210-2 to be substantially equal to the power supply voltage VDD. As described previously, the self-scanning thyristor 111-2 is ON at time t6, and the self-scanning thyristor 111-1 is OFF. Since the self-scanning thyristor 111-2 is ON, the light emitting thyristor 210-2, whose gate is at the same potential as the self-scanning thyristor 111-2, is ON. Thus, the drive current Iout depicted at "e" starts to flow through the cathode of the light emitting thyristor 210-2, producing a light output in accordance with the drive current Iout.

At time t7, the ON/OFF command signal DRVON goes low and is inverted by the CMOS inverter 61. The output of the CMOS inverter 61 goes high, and appears on the data terminal DA. The High level signal on the data terminal DA causes the anode-cathode voltage of the light emitting thyristor 210-2 to be substantially zero volts. Thus, the light emitting thyristor 210-2 turns off, and the drive current Iout becomes substantially zero as depicted at "f."

Likewise, the potential on the first and second output terminals CK1R and CK2R change between the High level and the Low level in sequence and the ON/OFF command signal DRVON becomes ON or OFF in sequence, which causes the light emitting thyristors 210-3 to 210-6 to turn on in sequence.

{Waveform with Undershoot Shown in FIG. 15}

Figures 16A, 16B:
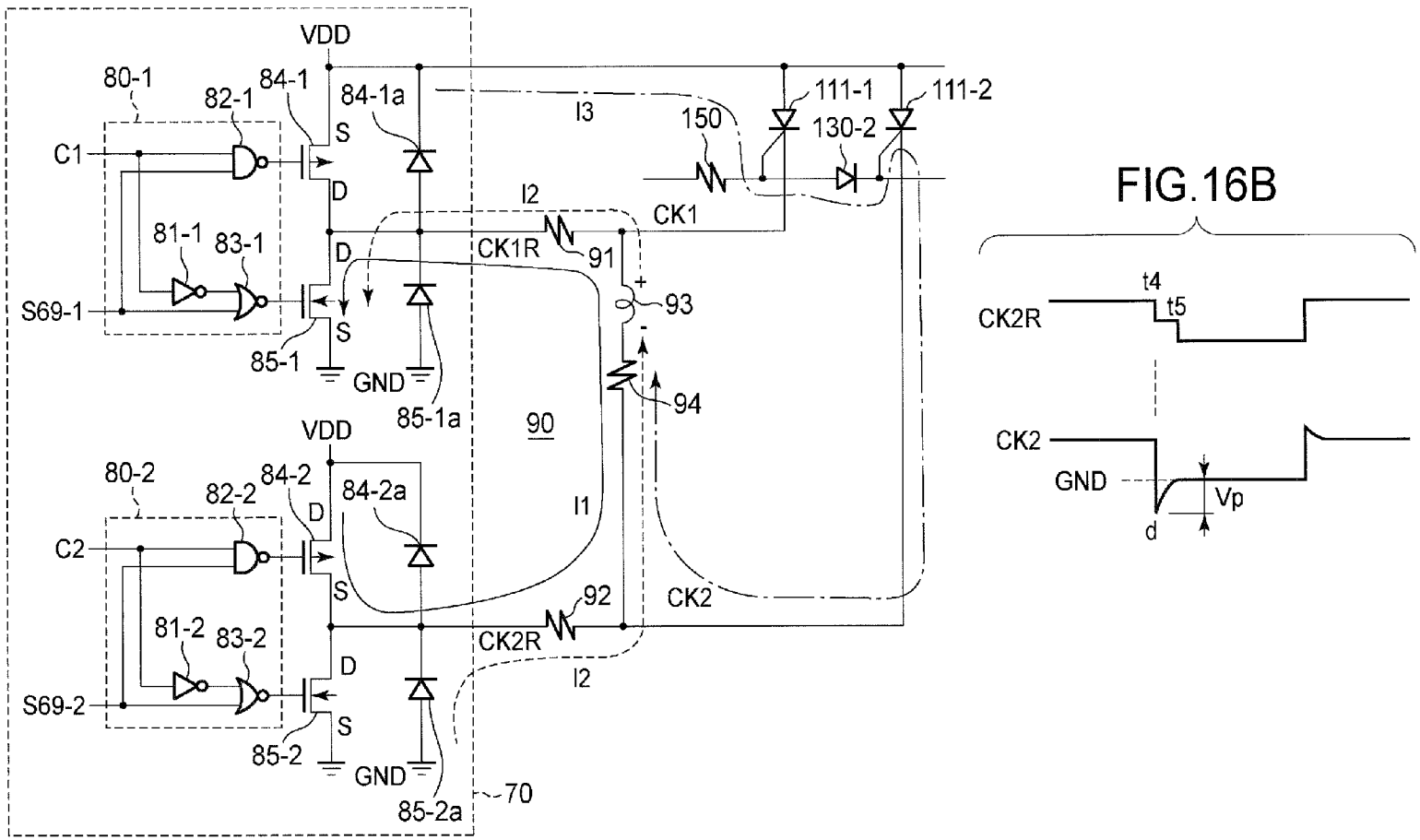
FIG. 16A illustrates the clock driver shown in FIG. 14.
FIG. 16B illustrates a part of the timing chart shown in FIG. 15.

FIG. 16A illustrates the clock driver 70 that includes the first and second output buffers 80-1 and 80-2, RL differentiation circuit 90, and part of the sub scanning circuits 110-1 and 110-2 shown in FIG. 14. FIG. 16B illustrates a part of the timing chart shown in FIG. 15.

Referring to FIG. 16A, the first output buffer 80-1 includes an inverter 81-1 that inverts the control signal C1, a two-input NAND gate 82-1 that outputs a negated logical product of the control signal C1 and the square wave signal S69-1, and a two-input NOR gate 83-1 that outputs a negated logical sum of the output of the inverter 81-1 and the square wave signal S69-1. The output of the NAND gate 82-1 is connected to the gate of a first switch element or PMOS transistor 84-1. The output of the NOR gate 83-1 is connected to the gate of a second switch element or NMOS transistor 85-1. A diode 84-1 is connected in parallel with the PMOS transistor 84-1. The diode 85-1*a* is connected in parallel with the NMOS transistor 85-1.

The PMOS transistor 84-1 has a gate connected to the output of the NAND gate 82-1, a source connected to the VDD, and a drain connected to the first output terminal CK1R. The NMOS transistor 85-1 has a gate connected to the output of the NOR gate 83-1, a drain connected to the first output terminals CK1R, and a source connected to the ground GND. The diode 84-1*a* has a cathode connected to the power supply voltage VDD, an anode connected to the first output terminal CK1R. The diode 85-1*a* has a cathode connected to the first output terminals CK1R and an anode connected to the ground GND.

The diode 84-1*a* is not essential to the circuit operation but is formed by accident as a parasitic diode between the substrate and the drain of the PMOS transistor 84-1 when the PMOS transistor 84-1 is fabricated.

The second output buffer 80-2 is of the same circuit configuration as the first output buffer 80-1. The second output buffer 80-2 includes an inverter 81-2 that inverts the control signal C2, a two-input NAND gate 82-2, a two-input NOR gate 83-2 and an inverter 81-2. The NAND gate 82-2 outputs a negated logical product of the control signal C2 and the square wave signal S69-2. The NOR gate 83-2 outputs a negated logical sum of the output signal of the inverter 81-2 and the square waveform signal S69-1. The output of the NAND gate 82-2 is connected to the gate of a third switch element or PMOS transistor 84-2. The output of the NOR gate 83-2 is connected to a fourth switch element or NMOS transistor 85-2.

The PMOS transistor 84-2 has a gate connected to the output terminal of the NAND gate 82-2, a source connected to the power supply voltage VDD, and a drain connected to the second output terminal CK2R. The NOMOS transistor 85-2 has a gate connected to the output terminal of the NOR gate 83-2, a drain connected to the second output terminal CK2R, and a source connected to the ground GND. The diode 84-2*a* has a cathode connected to the power supply voltage VDD and an anode connected to the second output terminal CK2R. The diode 85-2*a* has a cathode connected to the second output terminal CK2R and an anode connected to the ground GND.

The diode 84-2*a* is not essential to the circuit operation but is a parasitic diode formed by accident between the substrate and the drain of the NMOS transistor 85-2.

The first output buffer 80-1 and second output buffer 80-2 operate in the same manner, and only the first output buffer 80-1 will be described for simplicity.

If the control signal C1 is the High level, the square waveform signal S69-1 is the Low level, then the outputs of the NAND gate 82-1 and NOR gate 83-1 are both the High level, so that the PMOS transistor 84-1 is OFF and the NMOS transistor 85-1 is ON. Thus, the first output terminal CK1R is the Low level. If the control signal C1 and square wave signal S69-1 are both the High level, the outputs of the NAND gate 82-1 and NOR gate 83-1 are both the Low level, so that the PMOS transistor 84-1 is ON and the NMOS transistor 85-1 is OFF. Thus, the first output terminal CK1R is the High level. If the control signal C1 is the Low level and the square waveform signal S69-1 is the Low level, then the output of the NAND gate 82-1 is the High level and the output of the NOR gate 83-1 is the Low level, so that the PMOS transistor 84-1 and NMOS, transistor 85-1 are both OFF. Thus, the first output terminal CK1R enters the Hi-Z state.

The self-scanning thyristor 111-1 has its anode connected to the power supply voltage VDD and its cathode connected to the first clock terminal CK1. The first clock terminal CK1 is connected to the first output terminal CK1R through the resistor 91. The self-scanning thyristor 111-2 has its anode connected to the power supply voltage VDD and its cathode connected to the second clock terminal CK2. The second clock terminal CK2 is connected to the second output terminal CK2R through the resistor 92. A series circuit of the inductor 93 and the resistor 94 is connected between the first and second clock terminals CK1 and CK2. The gate of the self-scanning thyristor 111-1 is connected to the second clock terminal CK2 through the resistor 150.

As described previously, the gate of the self-scanning thyristor 111-1 reaches the High level substantially equal to the power supply voltage VDD, and the second clock terminal CK2 goes low, which causes gate current in the self-scanning thyristor 111-2 for the self-scanning thyristor 111-2 to turn on.

{Turning on Self-Scanning Thyristor}

The operation for turning on the self-scanning thyristor 111-2 will be discussed.

Shortly before time t4 shown in FIGS. 15 and 16B, the second output terminal CK2R is the High level, and the first output terminal CK1R is the Low level.

Immediately before time t4, a current I1 flows in a direction shown by a solid line shown in FIG. 16A in a path defined by the power supply voltage VDD, PMOS transistor 84-2, second output terminal CK2R, resistors 92 and 94, inductor 93, resistor 91, NMOS transistor 85-1, and the ground GND.

Immediately after time t4, the control signal C2 goes low, causing the PMOS transistor 84-2 to go off so that the second output terminal CK2R enters the Hi-Z state. This causes a back electromotive force in the inductor 93 with the polarities shown in FIG. 16A, which results in a current I2 shown by a dotted line. The current I2 flows in a path defined by the positive sign of the inductor 93, resistor 91, NMOS transistor 85-1, GND, diode 85-2*a*, resistors 92 and 94, and the negative sign of the inductor 93.

Let's focus our attention on the second current path. The anode of the diode 85-2*a* is connected to the ground GND so that the potential of the output terminal CKR2 is lower than that of the ground GND by the forward voltage of the diode 85-2*a*. Therefore, the potential of the second clock terminal CK2 is lower than that of the cathode of the diode 85-2*a* by the voltage drop across the resistor 92. As a result, as shown by a dot-dashed line, a current I3 flows in a path defined by the VDD, the anode-gate junction of the self-scanning thyristor 111-1, diode 130-2, the gate-cathode junction of the self-scanning thyristor 111-2, and second clock terminal CK2. The gate current that flows through the gate-cathode junction of the self-scanning thyristor 111-2 serves as a triggering current for the self-scanning thyristor 111-2 to turn on.

FIG. 16B illustrates the waveforms of the signals on the second output terminal CK2R and second clock terminal CK2. When the second output terminal CK2R changes from the High level to the Hi-Z state, the signal on the second clock terminal CK2 will have an abrupt undershoot as depicted at "d," being lower than the ground GND by voltage Vp.

In a typical design, the power supply voltage VDD is 3.3 V, the forward voltage Vf of the diode 130-2 is about 1.6 V, and the forward voltage Vgk of the gate-cathode junction of the self-scanning thyristor 111-2 is about 1.6 V. When the self-scanning thyristor 111-1 is turned on, the gate potential of the thyristor 111-1 is about 3.3 V, substantially equal to the power supply voltage VDD. In order for the current I3 to flow in the dotted-line path, the following relationship must be satisfied.

$$Vf+Vgk<VDD+Vp$$

At this moment, if the signal on the second clock terminal CK2 shown in FIG. 16B had no undershoot "d" so that Vp=0 V, the value of Vf+Vgk would be as follows:

$$Vf+Vgk=1.6\text{ V}+1.6\text{ V}=3.2\text{ V}$$

This implies that Vf+Vgk is somewhat lower than the power supply voltage VDD and therefore cannot cause sufficient gate current for the thyristor 111-2 to turn on.

In contrast, in the third embodiment, the undershoot voltage Vp=0.6 V is produced to satisfy the following relationship.

$$VDD+Vp=3.3\text{ V}+0.6\text{ V}=3.9\text{ V}$$

This indicates that the value of VDD+Vp is greater than Vf+Vgk and can cause sufficient trigger current for the self-scanning thyristor 111-2 to turn on. In addition, the waveform of the signal on the second clock terminal CK2 abruptly falls, which is effective in implementing the high speed turning-on of the self-scanning thyristor 111-2.

{First Modification to Third Embodiment}

Figure 17:
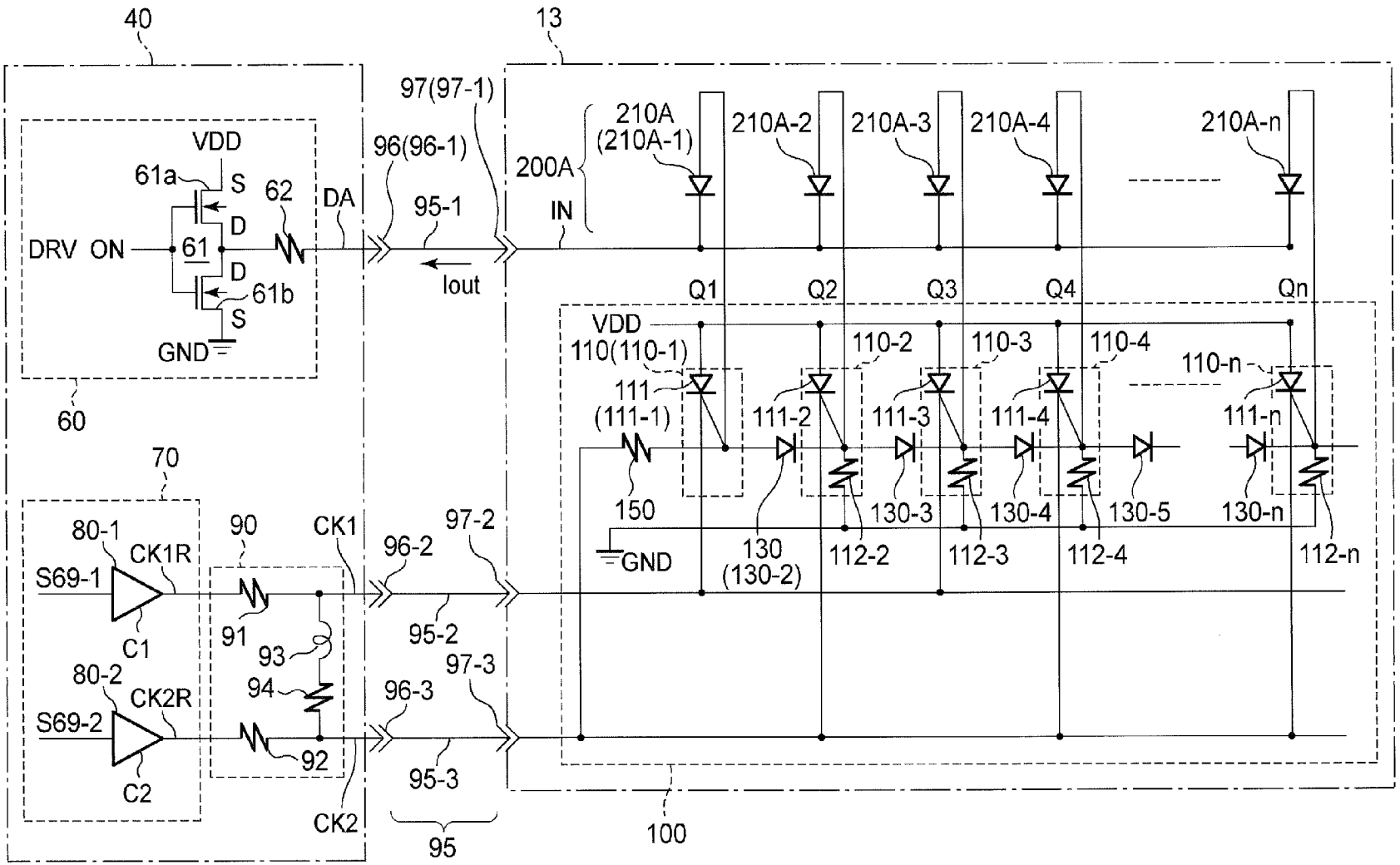
FIG. 17 is a block diagram illustrating the outline of the circuit configuration of the printing controller and the print head of a first modification to a third embodiment.

FIG. 17 is a block diagram illustrating the outline of the circuit configuration of the printing controller 40 and the print head 13A of a first modification to the third embodiment. Elements similar to those shown in FIG. 14 have been given the same reference numerals. The first modification differs from the third embodiment in the configuration of the print head.

The first modification to the third embodiment has a printing controller 40 similar to that of the third embodiment. The printing controller 40 is connected to a print head 13A via a plurality of connectors 96-1 to 91-3, cables 95-1 95-3, and connectors 97-1 to 97-3. The print head 13A includes a scanning circuit 100 similar to that of the third embodiment and light emitting element arrays 200A different from light emitting arrays 200 of the third embodiment.

The light emitting array 200A has a plurality of two-terminal light emitting elements (e.g., LEDs) 210A-1 to 210A-n. The light emitting elements have anodes connected to the corresponding output terminals Q1 to Q4 of the scanning circuit 100, and cathodes connected to the connector 97-1 via a common terminal IN through which a drive current Iout flows. A total of 4992 LEDs 210A are used for printing an image with a resolution of 600 dots per inch (dpi) on A4 size paper.

The printing controller 40 and print head 13A of the aforementioned configuration operate as follows:

For example, the ON/OFF command signals DRVON of the Low level is inverted by the CMOS inverter 61 of the data drive circuit 60, so that the High level appears on the data terminal DA via the resistor 62. The High level is directed through the connector 96-1, cable 95-1 and connector 97-1 to the cathodes of the respective LEDs 210A, causing all of the LEDs 210A-1 to 210A-n not to emit light.

Alternatively, if the ON/OFF command signal DRVON is the High level, the High level is inverted by the CMOS 61 so that the Low level appears on the data terminal DA through the resistor 62. Thus, the low level, which is nearly equal to the ground potential, also appears on the common terminal IN via the connector 96-1, cable 95-1, and connector 97-1. At this moment, the scanning circuit 100 applies the High level to the selected LEDs 210A, causing the selected LEDs 210A to turn on. The cathode current (i.e., drive current Tout) of the LED 210A flows into the data terminal DA, producing a light output in accordance with the drive current Iout. As described above, the first modification operates substantially in the same manner as the third embodiment.

{Second Modification to Third Embodiment}

Referring to FIG. 16A, the diodes 84-1*a*, 84-2*a*, 85-1*a*, and 85-2*a* may be in the form of parasitic diodes formed by accident when the PMOS transistor 84-1 and 84-2 and NMOS transistors 85-1 and 85-2 are fabricated.

If these PMOS and NMOS transistors are implemented with other form of switching element, e.g., bipolar transistors, the diodes 85-1*a* and 85-2*a* may be designed diodes instead of parasitic diodes, in which case since the diodes 84-1*a* and 84-2*a* do not form a path for the current I2 and therefore may be omitted. This saves the number of circuit elements.

{Effects of Third Embodiment and First and Second Modifications}

Effect A

In conventional scanning circuits, a CR differentiation circuit was used in place of the RL differentiation circuit 90 shown in FIG. 14, thereby outputting a two-phase clock from the first and second clock terminals CK1 and CK2 with undershoot at "d" shown in FIG. 16B. Since the CR differentiation circuit fails to transmit a direct current component, first and second output terminals CK1R and CK2R are required for supplying the direct current component for each of the first and second clock terminals CK1 and CK2. In other words, a total of four clock terminals are required for each transfer clock.

In contrast, in the third embodiment and the first and second modifications, the second clock terminal CK2 outputs the second clock to the starting sub scanning circuit 110-1 through the resistor 150, so that the scanning circuit 100 starts to scan the light emitting element arrays 200 and 200A. This configuration eliminates a start signal, simplifying the circuit configuration. In addition, the RL differentiation circuit 90 differentiates the first and second clock pulses outputted from the first and second output terminals CK1R and CK2R, thereby producing waveforms with undershoot at the portion "d" shown in FIG. 16B. Thus, a single first output terminal CK1R and a single second output terminal CK2R are required for each transfer clock, requiring only half the number of terminals which would otherwise be required in the conventional configuration. In addition, a single RL differentiation circuit 90 having a single inductor 93 is required as shown in FIG. 14. These configurations increase the data transfer speed in the print heads 13 and 13A and reduce the circuit size and hence manufacturing cost.

Effect B

The third embodiment and first and second modifications employ the print heads 13 and 13A, respectively, providing the high quality image forming apparatus with good space utilization efficiency and light outputting efficiency. The print heads 13 and 13*a* are applicable not only to the full color image forming apparatus 1 according to the third embodiment and first and second modifications but also to monochrome and multi color image forming apparatuses, in which case the present invention is particularly useful.

Fourth Embodiment

A fourth embodiment differs from the third embodiment in that a print head 13B is used in place of the print head 13. The fourth embodiment will be described mainly in terms of portions of the print head 13B different from the print head 13.

{Printing Controller and Print Head}

Figure 18:
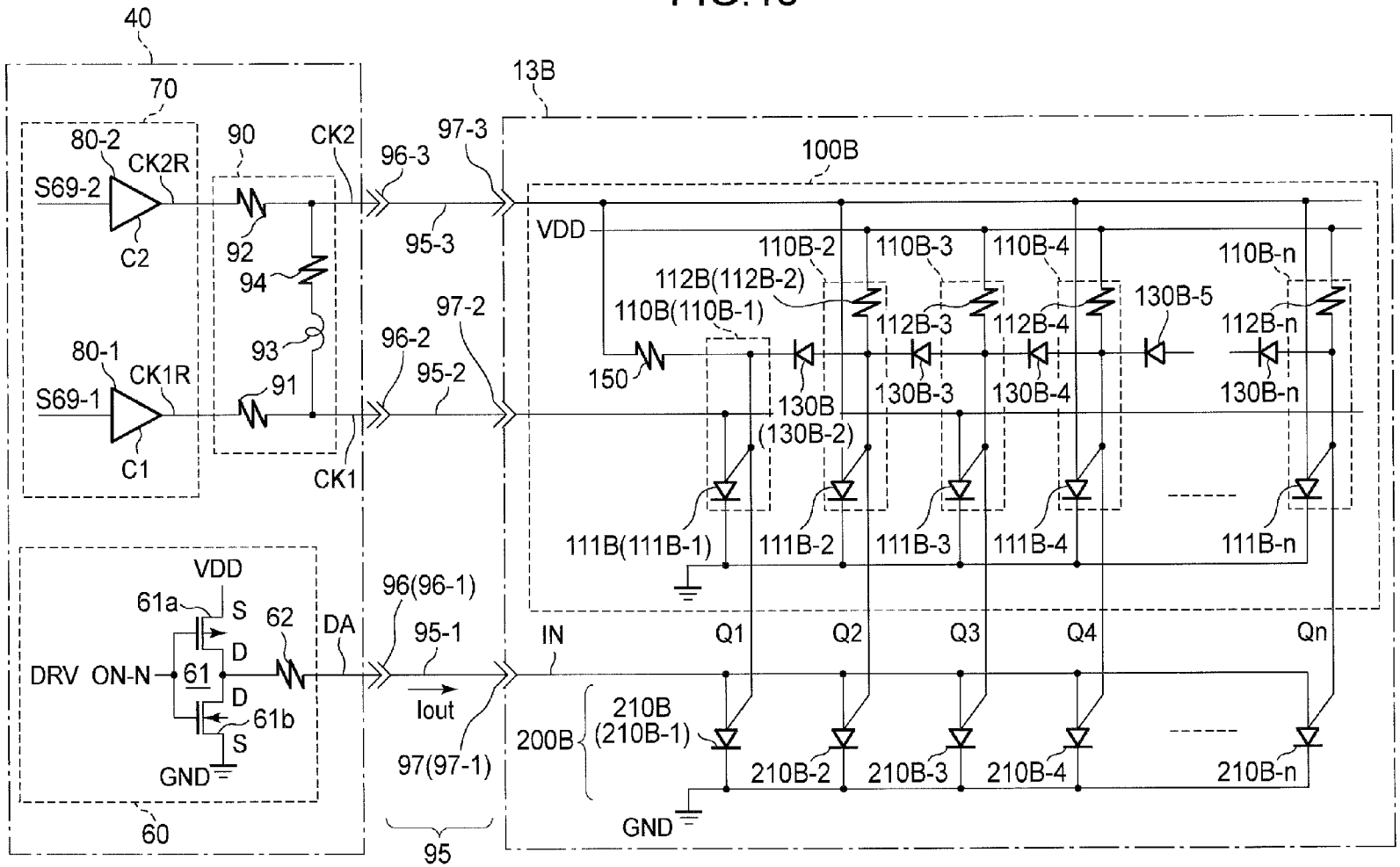
FIG. 18 illustrates the circuit configuration of a printing controller and the print head according to a fourth embodiment.

FIG. 18 illustrates the circuit configuration of a printing controller 40 and the print head 13B according to the fourth embodiment. Elements similar to those of the third embodiment shown in FIG. 14 have been given the same reference numerals.

The print head 13B has a scanning circuit 100B and light emitting element arrays 200B. The scanning circuit 100B and light emitting element arrays 200B are connected to the printing controller 40 via cables 95-1 to 95-3 and connectors 96-1 to 96-3 and 97-1 to 97-3 to the printing controller 40.

The light emitting thyristor array 200B scanned by the scanning circuit 100B includes a plurality of N gate type light emitting thyristors 210B-1 to 210B-n. Each of the N gate type light emitting thyristors has an anode connected to a connector 97-1 through a common terminal IN through which a drive current Tout flows, a cathode connected to the ground GND, and a gate connected to a corresponding one of output terminals Q1 to Qn. The optical print head 13 is capable of forming an electrostatic latent image on the photoconductive drum at a resolution of, for example, 600 dots per inch (dpi), and includes 4992 light emitting thyristors for forming 4992 dots on A4 size paper.

The scanning circuit 100B is clocked by a two-phase clock supplied from first and second clock terminals CK1 and CK2 through connectors 96-2 and 96-3, cables 95-2 and 95-3, and connectors 97-2 and 97-3, thereby controlling the trigger current to turn on or off the light emitting thyristor array 200B. The scanning circuit 100B is a self-scanning shift register. The scanning circuit 100B includes a plurality of sub scanning circuits 110B-1 to 110B-n (n is, for example, 4992), a resistor 1508 through which the second clock for starting the self-scanning operation is supplied from the second clock terminal CK2, a plurality of diodes 130B-2 to 130B-n (n is, for example, 4992) for determining the order in which the light emitting thyristors 210B-1 to 210B-n are scanned.

The first stage of sub scanning circuits 110B includes the resistor 150B connected to the power supply voltage VDD and a self-scanning thyristor 111B-1. The self-scanning thyristor 111B-1 has a cathode connected to the ground GND; an anode connected to a first clock terminal CK1 via a connector 97-2, cable 95-2, and connector 96-2; and a gate connected to a second clock terminal CK2 through the resistor 150B. Each of the second sub scanning circuits and onward (i.e., 110B-2 to 110B-n) includes a self-scanning thyristor (111B-2 to 111B-n) having an anode connected to the connector 97-3, and a resistor (112B-2 to 112B-n) connected between the gate of the self-scanning thyristor 111 and a power supply voltage VDD.

Odd-numbered sub scanning circuits 110B-3, 110B-5, . . . , 110B-(*n*−1) include corresponding self-scanning thyristors 111B-1, 111B-3, 111B-5, . . . , 111B-(*n*−1). Each self-scanning thyristor (110B-3, 110B-5, . . . , 110B-(*n*−1)) has the second terminal (anode) connected to the first clock terminal CK1 through the connector 97-2, cable 95-2, and connector 96-2; the cathode connected to the ground GND, and the gate connected to the power supply voltage VDD via the resistors 112B-3, 112B-5, . . . 112-(*n*−1), and connected to output terminals Q3, Q5, . . . Q (n−1), respectively.

Even-numbered sub scanning circuits 110B-2, 110B-4, . . . , 110B-n include corresponding self-scanning thyristors 111B-2, 111B-4, 111B-6, . . . , 111B-n. Each of the self-scanning thyristors 110B-2, 110B-4, . . . 110B-n has the second terminal (anode) connected to the second clock terminal CK2 through the connector 97-3, cable 95-3, and connector 96-3; the cathode connected to the ground GND; and the gate connected to the power supply voltage VDD via the resistors 112B-2, 112B-4, 112B-6, . . . 112-*n*, and connected to output terminals Q2, Q4, . . . Qn, respectively.

The gate of self-scanning thyristor 111B-1 is connected to the second clock terminal CK2 via the resistor 150B, connector 97-3, cable 95-3, and connector 96-3. Diodes 130B-2, 130B-3, 130B-4, . . . 130B-n are connected between the gates of adjacent ones of the self-scanning thyristors 111B-1, 111B-2, 111B-3, 111B-4, . . . 111B-n. The diodes 130B-2, 130B-3, 130B-4, . . . 130B-n determine the order in which the light emitting thyristors 210B-1, 210B-2, 210B-3, 210B-4, . . . 210B-n are turned on in sequence in this order.

The self-scanning thyristors 111B-1 to 111B-n in the scanning circuit 100B have a similar layer structure to the light emitting thyristors 210B in the light emitting thyristor arrays 200 and operate in a similar manner. However, the upper layer of the self-scanning thyristors 1113-1 to 111B-n is covered with an opaque material, e.g., metal since the self-scanning thyristors 111B-1 to 111B-n do not have to emit light.

The self-scanning thyristors 111B-1 to 111B-n in the self-scanning circuit 100B are clocked by the first clock and the second clock supplied from the first clock terminal CK1 and the second clock terminal CK2, respectively, of the printing controller 40, so that the self-scanning thyristors 111B-1 to 111B-n are selectively turned on. The ON-state of the self-scanning thyristors 111B-1 to 111B-n is transmitted to the light emitting thyristor array 200B, causing a corresponding light emitting thyristor (210B-1 to 210B-n) to emit light. The ON-state of the self-scanning thyristor 111B of each stage is transmitted to the next adjacent stage upon the first clock and the second clock, so that the entire self-scanning circuit 100B operates as a shift register.

The resistor 112B is not present between the gate of the self-scanning thyristor 111B-1 and the power supply voltage VDD for the purpose of saving parts. If saving parts is not primary importance, then the resistor 112B may be used between the gate of the self-scanning thyristor 111B-1 and the power supply voltage VDD.

Also, the diode 130B is missing from between the gate of the first stage self-scanning thyristor 111B-1 and the second clock terminal CK2, and the resistor 112B is missing from between the gate and the power supply voltage VDD. However, the resistor 150B is used in place of the diode 130B. Thus, another way of looking at the circuit configuration is that a resistor between the gate of the first stage self-scanning thyristor 111B-1 and the power supply voltage VDD is removed and is connected between the second clock terminal CK2 and the gate, and a diode is removed from between the second clock terminal CK2 and the gate. This configuration provides the following advantages.

When the image forming apparatus 1 is in the standby state where printing is not performed, the first and the second clocks supplied from the first and second clock terminals CK1 and CK2 are at the Low level. If the resistor 112B is connected between the gate of the self-scanning thyristor 111B-1 and the power supply voltage VDD, current will continue to flow from the power supply voltage VDD to the second clock terminal CK2 through the resistors 150B and 112B. This current causes unwanted power consumption, increasing the power consumption in the standby state. In addition, the currents flowing through the resistors 120B and 112B are detrimental to the measuring of leak current during the inspection stage after the manufacture of the print head 13.

If the self-scanning thyristors 111B-1 to 111B-n have some defects due to an improper semiconductor manufacturing process, a small leakage current less than 1 μA may flow during the standby state of the self-scanning thyristor. The small leakage current may be measured to identify a defective thyristor, thereby selecting only good thyristors with no leakage current. However, if the power consumption in the standby state is significant, it is difficult to detect a small increase in current due to the leakage current.

In contrast, the configuration of the third embodiment, the resistor 112B is not present between the gate of the self-scanning thyristor 111B-1 and the ground GND. Thus, no current flows between the gate of the self-scanning thyristor 111B-1 and the ground GND. This results in thyristors that has no power consumption during the standby state. Besides, the defective thyristors due to the leakage current can be effectively removed, thereby ensuring high quality self-scanning thyristors.

The print head 13B incorporating the scanning circuit 100B is connected to the printing controller 40. The printing controller 40 includes a plurality of data driver circuits 60, a clock driver 70, and an RL differentiation circuit 90. The data driver circuit 60 supplies a drive current Iout to the common terminal IN, thereby driving the plurality of light emitting thyristor arrays 200B in a time division manner in response to an ON/OFF command signal DRVON-N. The ON/OFF command signal DRVON-N is a negative logic and a square wave signal outputted from an ON/OFF command signal generating circuit (not shown). The clock driver 70 and RL differentiation circuit 90 cooperate to generate the first and second clocks to be supplied to the scanning circuit 100B, based on square signals S69-1 and S69-2 which are square wave signals outputted from the ON/OFF command signal generating circuit.

For the sake of simplicity, FIG. 18 illustrates only one of the data driver circuits 60. The light emitting thyristor arrays 200B include, for example, a total of 4992 light emitting thyristors 210B-1 to 210B-n, which are grouped into a plurality of groups. The respective groups are driven by corresponding driver circuits 60 so that the respective groups are driven simultaneously in a time division manner.

An exemplary configuration includes light emitting thyristor arrays 200B in chip form, each array including, for example, 192 light emitting thyristors (210-1 to 210-*n*). The 26 arrays are mounted on the printed wiring board 13*b* shown in FIG. 3. This configuration provides a total of 4992 light emitting thyristors 210-1 to 210-*n* necessary for the print head 13. The 26 light emitting thyristor arrays 200B are driven by corresponding data drivers 60 having a total of 26 output terminals.

The clock driver 70 and RL differentiation circuit 90 are designed to drive the scanning circuit 100B in the form of an array. The clock driver 70 and RL differentiation circuit 90 not only output clock signals but also control the energy required for turning on the self-scanning thyristors 111B. For high-speed operation of the print head 13B, the clock driver 70 and RL differentiation circuit 90 are preferably employed for each scanning circuit 100B. However, if low speed data transfer for the print head 13B is acceptable, each combination of the clock driver 70 and RL differentiation circuit 90 may be used to drive a plurality of scanning circuits 100B.

The driver apparatus according to the third embodiment is constituted of the data driver 60, clock driver 70, RL differentiation circuit 90, and scanning circuit 100B. Alternatively, the data driver 60, clock driver 70, and RL differentiation circuit 90 shown in FIG. 18 may be accommodated in the print head 13B.

{Light Emitting Thyristor of Third Embodiment}

Figure 19C:
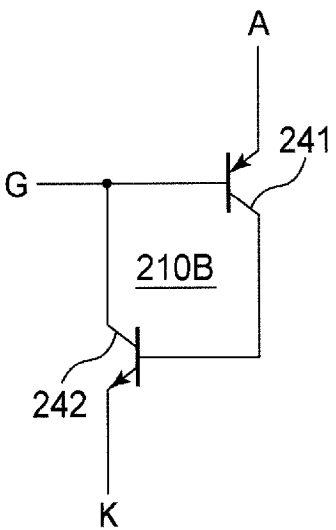
FIG. 19C illustrates an electrical equivalent circuit of the light emitting thyristor shown in FIGS. 19A-19B.
Figure 19B:
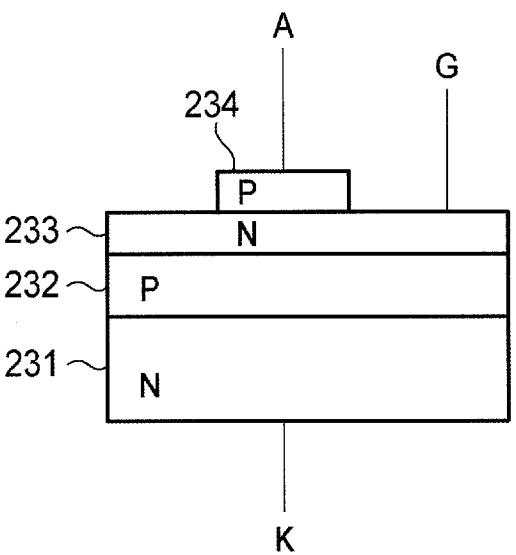
FIG. 19B is a cross-sectional view of the light emitting thyristor.
Figure 19A:
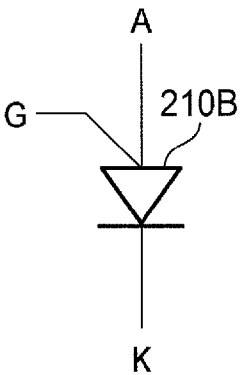
FIG. 19A illustrates the circuit symbol of the light emitting thyristor having an anode, a cathode, and a gate.

FIGS. 19A-19C illustrate the light emitting thyristor 210 shown in FIG. 14.

FIG. 19A illustrates the circuit symbol of the light emitting thyristor 210B having an anode A, a cathode K, and a gate G.

FIG. 19B is a cross-sectional view of the light emitting thyristor 210B. The light emitting thyristor 210B is fabricated as follows: First, a predetermined crystal is epitaxially grown on a P type GaAs wafer by known metal organic chemical vapor deposition (MO-CVD).

A predetermined buffer layer (not shown) is formed on an N type GaAs wafer and then an AlGaAs layer is formed on the buffer. A PNPN structure or a four-layer structure is fabricated on the AlGaAs layer. The four-layer structure includes an N-type layer 231 that contains an N-type impurity, a P-type layer 232 that contains a P-type impurity, an N-type layer 233 that contains an N-type impurity, and a P-type layer 234 that contains a P-type impurity, in this order. Grooves (not shown) are formed in the wafer to define individual devices by a known etching technique.

When etching is performed, a part of the N-type layer 233 is etched to expose. A metal wiring is formed on the exposed region to form a gate G. The uppermost P-type layer 234 is partially exposed and a metal wiring is formed on the exposed region to form an anode. A metal wiring is formed on a side of the N-type layer 231 opposite the P-type layer 232, thereby forming a cathode K.

FIG. 19C illustrates an electrical equivalent circuit of the light emitting thyristor 210B shown in FIGS. 19A-19B.

The light emitting thyristor 210B is constituted of a PNP transistor 241 and an NPN transistor 242. The emitter of the PNP transistor 241 corresponds to the anode A of the light emitting thyristors 210B, and the base of the PNP transistor 241 corresponds to the gate G of the thyristors 210B. The emitter of the NPN transistor 242 corresponds to the cathode K of the thyristor 210B. The collector of the PNP transistor 242 is connected to the base of the NPN transistor 241. The base of the PNP transistor 241 is also connected to the collector of the NPN transistor 242.

The light emitting thyristor 210 shown in FIGS. 19A-19C has an AlGaAs layer formed on the GaAs wafer. The thyristor 210 is not limited to this configuration. The thyristor 210 may have a layer of GaP, GaAsP, or AlGaInP formed on the GaAs wafer. Alternatively, the thyristor may have a GaN layer, an AlGaN layer, or an InGaN layer formed on a sapphire substrate.

{Brief Description of Printing Controller and Print Head}

Referring to FIG. 18, if the ON/OFF command signal DRVON-N is the High level, the PMOS transistor 61*a* of the CMOS inverter 61 is OFF and the NMOS transistor 61*b* is ON, so that the data terminal DA is the Low level. The Low level at the data terminal DA is fed to the anodes of the respective light emitting thyristors 210B through the connector 96-1, cable 95-1, connector 97-1, and common terminal IN. As a result, the anode-cathode voltage of the respective thyristors is substantially zero volts, causing the drive current Iout to become zero, so that none of the light emitting thyristors 210B-1 to 210B-n emits light.

If the ON/OFF command signal DRVON-N is the low level, the PMOS transistor 61*a* of the CMOS inverter 61 is ON and the NMOS transistor 61*b* is OFF, so that the data terminal DA is the High level. The High level at the data terminal DA is fed to the anodes of the respective light emitting thyristors 210B through the connector 96-1, cable 95-1, connector 97-1, and common terminal IN. As a result, the anode-cathode voltage of the respective thyristors 210B is substantially equal to the power supply voltage VDD.

At this moment, the scanning circuit 100B starts its shifting operation, outputting the Low level to the gates of selected light emitting thyristors 210B that should be turned on. The Low level at the gates causes a trigger current to flow in the gates, which in turn causes the light emitting thyristors 210B to turn on.

The cathodes of the light emitting thyristors are grounded. If a High level signal is applied to the anodes of these light emitting thyristors, a voltage is applied across the anode and cathode of these light emitting thyristors. Since the gates of the light emitting thyristors 210B are directly connected to the gates of the self-scanning thyristors 111B, a voltage is applied across the gate and cathode of the self-scanning thyristors 111B. Thus, if a Low level signal is applied to the gates of the light emitting thyristors 210B to be turned on, the Low level signal causes a trigger current through light emitting thyristors 210B that should be on. Thus, the drive current Iout or a cathode current flows through the light emitting thyristors 2103, causing the light emitting thyristors 210B to emit light.

{Detailed Operation of Printing Controller and Print Head}

Figure 20:
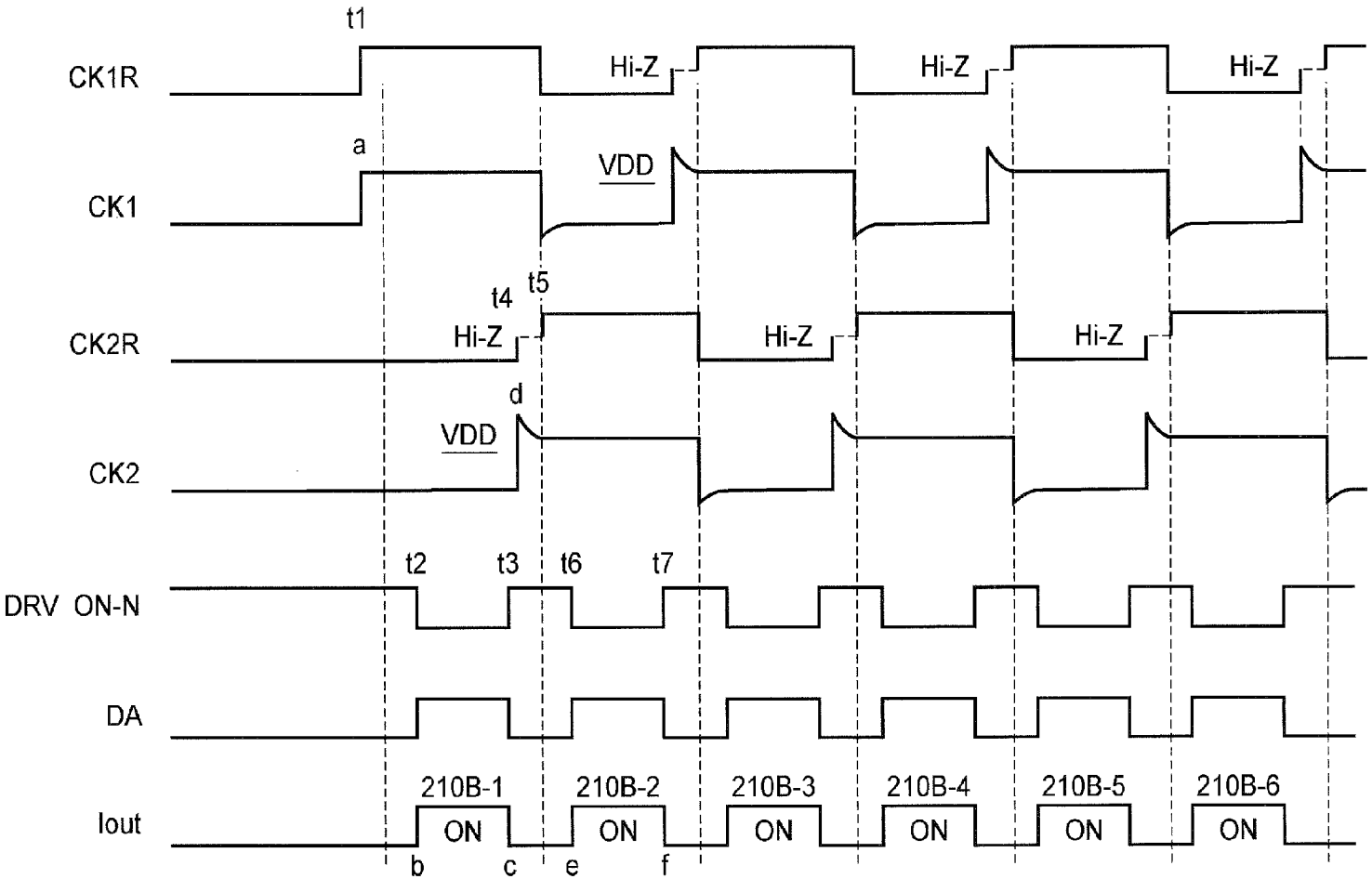
FIG. 20 is a timing chart illustrating the details of the operation of the printing controller and print head shown in FIG. 18.

FIG. 20 is a timing chart illustrating the details of the operation of the printing controller 40 and print head 13B shown in FIG. 18.

FIG. 20 illustrates the waveform of respective signals when the light emitting thyristors 210B-1 to 210B-n (e.g., n=6) are turned on alternately one at a time in a single scanning line.

Before time t1 shown in FIG. 20, the control signals C1 and C2 are the High level, and the square wave signals S69-1 and S69-2 outputted from a square wave generator (not shown) are fed to the first and second output buffers 80-1 and 80-2 in the form of a three state logic circuit, respectively. The Low level clock pulses are outputted from the first and second output terminals CK1R and CK2R.

The first output terminal CK1R is connected to the first clock terminal CK1 through the resistor 91. The second output terminal CK2R is connected to the second clock terminal CK2 through the resistor 92. Thus, the anodes of odd-numbered self-scanning thyristors 111B-1, 111B-3, 111B-5 and the anodes of even-numbered self-scanning thyristors 111B-2, 111B-4, 111B-6 are the Low level, and therefore the self-scanning thyristors are OFF. The ON/OFF command signal DRVON-N is the High level and the output of the CMOS inverter 61 is the Low level. The Low level output of the CMOS inverter 61 is fed to the cathode of the light emitting thyristors 210B-1 to 210B-6 through the resistor 62, data terminal DA, connector 96-1, cable 95-1, connector 97-1, and common terminals IN. Thus, the light emitting thyristors 210B-1 to 210B-6 are OFF.

A description will be given of the process for turning on the self-scanning thyristors 111B-1 and 111B-2 in the sub scanning circuits 110B-1 and 110B-2, respectively.

{Phase I: Turning-on of Thyristor 111-1}

At time t1 shown in FIG. 20, the first output terminal CK1R goes high, so that the first clock terminal CK1 goes high as depicted at "a". At time t1, the second output terminal CK2R is the Low level, and the clock terminal CK2 is also the Low level.

The power supply voltage VDD is about 3.3 V. The anode potential of the self-scanning thyristor 111B-1 is also about 3.3 V. Since the gate of the self-scanning thyristor 111B-1 is connected to the second clock terminals CK2 through the resistor 150B, current flows in a path defined by the power supply voltage VDD, anode-gate junction of the self-scanning thyristor 111B-1, resistor 150B, and the second clock terminal CK2. This current serves as a trigger current to turn on the self-scanning thyristor 111B-1.

At time t2, the ON/OFF command signal DRVON-N goes low, which in turn is inverted by the CMOS inverter 61. The CMOS inverter 61 outputs the High level, so that the High level appears on the data terminal DA. Thus, a voltage substantially equal to the power supply voltage VDD is applied across the anode and cathode of the light emitting thyristor 210B-1. At this moment, the self-scanning thyristor 111B-1 is ON. Therefore, the light emitting thyristor 210B-1, which has the same gate potential as the self-scanning thyristor 111B-1, turns on. The cathode current or drive current Iout as depicted at "b" starts to flow through the cathode of the light emitting thyristor 210B-1, so that the light emitting thyristor 210B-1 emits light.

At time t3, the ON/OFF command signal DRVON-N goes high and is inverted by the CMOS inverter 61. The output of the CMOS inverter 61 is the Low level, and appears on the data terminal DA. Thus, the anode-cathode voltage becomes substantially zero volts so that the light emitting thyristor 210B-1 turns off, the drive current Tout becoming substantially zero as depicted at "c".

The light emitted from the light emitting thyristor 210-1 may be used to form an electrostatic latent image on the photoconductor drum 11 shown in FIG. 1. The exposing energy is determined by the exposing time (i.e., time t3 to time t2) times the light power produced by the drive current Tout. The light power may vary due to variations in manufacturing process, but the exposing time for individual thyristors may be adjusted to compensate for the variations of light power. If the light emitting thyristor 210B-1 is not to be turned on, the ON/OFF command signal DRVON-N can be maintained high for a period of time from time t2 to time t3. In this manner, the ON/OFF command signal DRVON-N can drive the light emitting thyristors 210B.

{Phase II: Turning-on of Thyristor 111B-2}

At time t4, the control signal C2 goes low, and the second output terminal CK2R enters the Hi-Z state. The Hi-Z state is depicted by a dotted line between the High level and the Low level in FIG. 20.

Immediately before time t4, the second output terminal CK2R is the Low level and the first output terminal CK1R is the high level. Therefore, current flows in a path defined by the first output terminal CK1R, resistor 91, inductor 93, resistors 94 and 92, and second output terminal CK2R (Lowe level). Since the second output terminal CK2R enters the Hi-Z state immediately after time t4, a back electromotive force is generated across the inductor 93. The back electromotive force causes a waveform with undershoot above the power supply voltage VDD as depicted at "d" on the second clock terminal CK2.

At this moment, the anode potential of the self-scanning thyristor 111B-2 is the power supply voltage VDD, which is 3.3 V in a typical design. The overshoot causes the anode potential to exceed 3.3 V. The cathode of the diode 130B-2 is connected to the gate of the self-scanning thyristor 111B-1, so that the self-scanning thyristor 111B-1 is ON. The gate of the self-scanning thyristor 111B-1 is the low level which is close to the ground GND. Therefore, current flows in a path defined by the second clock terminal CK2, the anode-gate junction of the self-scanning thyristor 111B-2, the anode-cathode junction of the diode 130B-2, the gate-cathode junction of the self-scanning thyristor 111B-1, and the ground GND. This current serves as a trigger current for the self-scanning thyristor 111B-2 to turn on.

At time t5, the second output terminal CK2R goes high, causing the anode current of the self-scanning thyristor 111B-2 to continue to flow. At substantially time t5, the first output terminals CK1R goes low to turn on the self-scanning thyristor 111B-1 to turn on. At time t6, the ON/OFF command signal DRVON-N goes low and is inverted by the CMOS inverter 61. The output of the CMOS inverter 61 goes high, and appears on the data terminal DA. The Low level signal at the data terminal DA causes the anode-cathode voltage of the light emitting thyristor 210B-2 to be substantially equal to the power supply voltage VDD.

As described previously, at time t6, the self-scanning thyristor 111B-2 is ON, and the self-scanning thyristor 111B-1 is OFF. Since the self-scanning thyristor 111B-2 is ON, the light emitting thyristor 210B-2, whose gate is at the same potential as the self-scanning thyristor 111B-2, is ON. Thus, the drive current Iout depicted at "e" starts to flow through the cathode of the light emitting thyristor 210B-2, producing a light output in accordance with the drive current Iout.

At time t7, the ON/OFF command signal DRVON-N goes high and is inverted by the CMOS inverter 61. The output of the CMOS inverter 61 goes low, and appears on the data terminal DA. The low level signal on the data terminal DA causes the anode-cathode voltage of the light emitting thyristor 210B-2 to be substantially zero volts. Thus, the light emitting thyristor 210B-2 turns off, and the drive current Iout becomes substantially zero as depicted at "f".

Likewise, the potential on the first and second output terminals CK1R and CK2R change between the High level and the Low level and the ON/OFF command signal DRVON-N becomes ON or OFF in sequence, which causes the light emitting thyristor 210B-3 to 210B-6 to turn on in sequence.

Just as in the third embodiment, the first and second clocks outputted from the first and second clock terminals CK1 and CK2, respectively, are clocks having substantially the same waveform different in phase. The first clocks are fed to the odd-numbered self-scanning thyristors 111B-1, 111B-3, and 111B-5 in sequence and the second clocks are fed to the even-numbered self-scanning thyristors 111B-2, 111B-4, and 111B-6 in sequence, so that the self-scanning thyristors 111B-1, 111B-2, 111B-3, 111B-4, 111B-5, and 1113-6 turn on in sequence.

{Waveform with Undershoot Shown in FIG. 20}

Figures 21A, 21B:
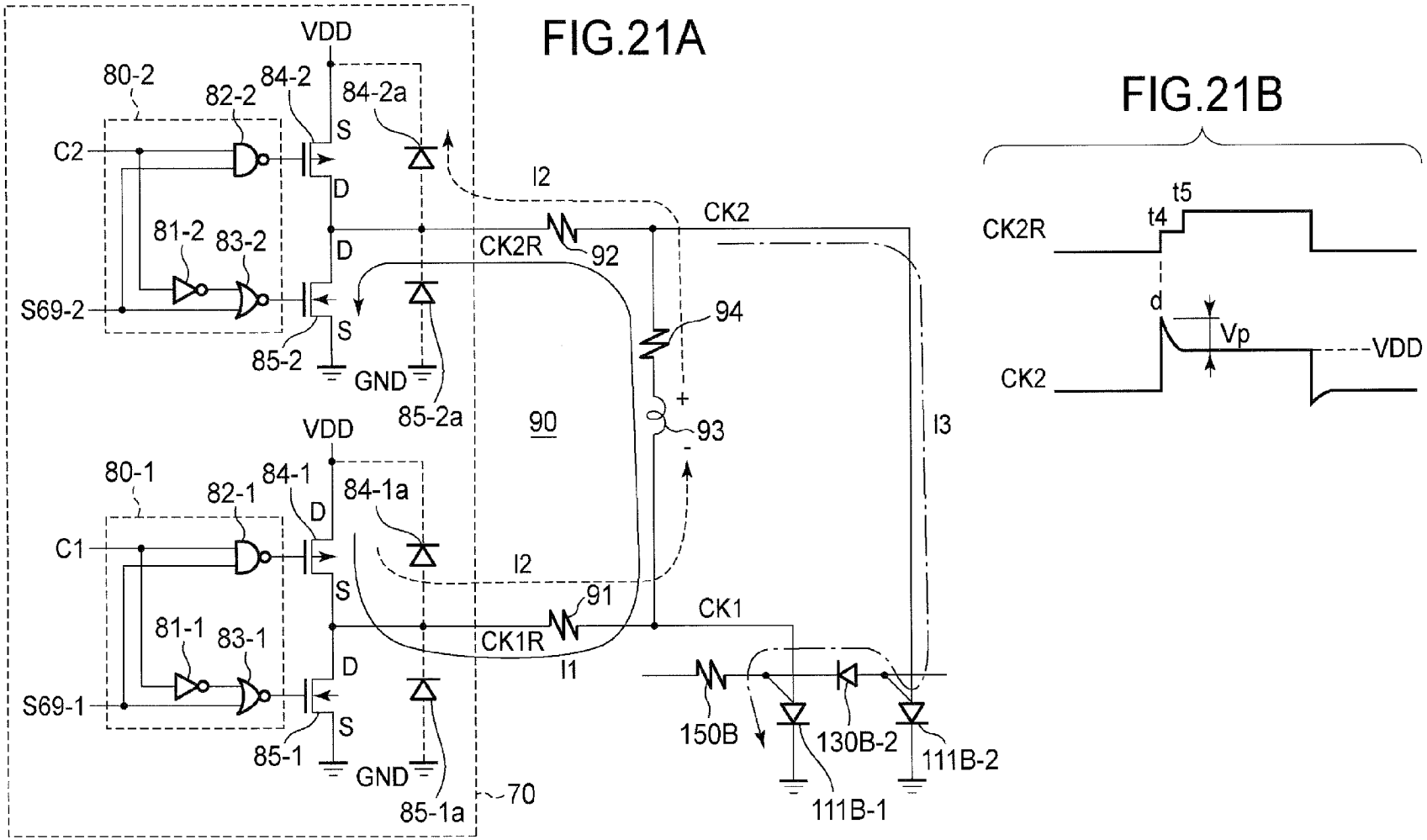
FIG. 21A illustrates the clock driver shown in FIG. 18.
FIG. 21B illustrates a part of the timing chart illustrated in FIG. 20.

FIG. 21A illustrates the clock driver 70 that includes the first and second output buffers 80-1 and 80-2, RL differentiation circuit 90, and part of the sub scanning circuits 110B-1 and 110B-2 shown in FIG. 18. FIG. 21B illustrates a part of the timing chart illustrated in FIG. 20.

Referring to FIG. 21A, the first output buffer 80-1 includes an inverter 81-1 that inverts the control signal C1, a two-input NAND gate 82-1 that outputs a negated logical product of the control signal C1 and the square wave signal S69-1, and a two-input NOR gate 83-1 that outputs a negated logical sum of the output of the inverter 81-1 and the square wave signal S69-1. The second output buffer 80-2 includes an inverter 81-2 that inverts the control signal C1, a two-input NAND gate 82-2 that outputs a negated logical product of the control signal C1 and the square wave signal S69-2, and a two-input NOR gate 83-2 that outputs a negated logical sum of the output of the inverter 81-2 and the square wave signal S69-2.

The PMOS transistor 84-1 has a gate connected to the output of the NAND gate 82-1, a source connected to the VDD, and a drain connected to the first output terminal CK1R. The NMOS transistor 85-1 has a gate connected to the output of the NOR gate 83-1, a drain connected to the first output terminal CK1R, and a source connected to the ground GND. The diode 84-1*a* has a cathode connected to the power supply voltage VDD, an anode connected to the first output terminal CK1R. The diode 85-1*a* has a cathode connected to the first output terminal CK1R and an anode connected to the ground GND.

Likewise, the PMOS transistor 84-2 has a gate connected to the output of the NAND gate 82-2, a source connected to the VDD, and a drain connected to the second output terminal CK2R. The NMOS transistor 85-2 has a gate connected to the output of the NOR gate 83-2, a drain connected to the second output terminal CK2R, and a source connected to the ground GND. The diode 84-2*a* has a cathode connected to the power supply voltage VDD and an anode connected to the second output terminal CK2R. The diode 85-2*a* has a cathode connected to the second output terminal CK2R and an anode connected to the ground GND.

The diode 85-1*a* is not essential to the circuit operation but is formed by accident as a parasitic diode between the substrate and the drain of the NMOS transistor 85-1 when the NMOS transistor 85-1 is fabricated. Likewise, the diode 85-2*a* is not essential to the circuit operation but is formed by accident as a parasitic diode between the substrate and the drain of the NMOS transistor 85-2 when the NMOS transistor 85-2 is fabricated.

The first output buffer 80-1 and second output buffer 80-2 operate in the same manner, and only the first output buffer 80-1 will be described for simplicity.

If the control signal C1 is the High level, the square waveform signal S69-1 is the Low level, then the outputs of the NAND gate 82-1 and NOR gate 85-1 are both the High level, so that the PMOS transistor 84-1 is OFF and the NMOS transistor 85-1 is ON. Thus, the first output terminal CK1R is the Low level. If the control signal C1 and square wave signal S69-1 are both the High level, the outputs of the NAND gate 82-1 and NOR gate 83-1 are both the Low level, so that the PMOS transistor 84-1 is ON and the NMOS transistor 85-1 is OFF. Thus, the first output terminal CK1R is the High level. If the control signal C1 is the Low level and the square waveform signal S69-1 is the Low level, then the output of the NAND gate 82-1 is the High level and the output of the NOR gate 83-1 is the Low level, so that the PMOS transistor 84-1 and NMOS transistor 85-1 are both OFF. Thus, the first output terminal CK1R enters the Hi-Z state.

The self-scanning thyristor 111B-1 has its cathode connected to the ground GND and its anode connected to the first clock terminal CK1. The first clock terminal CK1 is connected to the first output terminal CK1R through the resistor 91. The self-scanning thyristor 111B-2 has its cathode connected to the ground GND and its anode connected to the second clock terminal CK2. The second clock terminal CK2 is connected to the second output terminal CK2R through the resistor 92. A series circuit of the inductor 93 and the resistor 94 is connected between the first and second clock terminals CK1 and CK2. A diode 130B-2 is connected between the gate of the self-scanning thyristor 111B-1 and the gate of the self-scanning thyristor 111B-2.

For example, let's consider a case in which the first output terminal CK1R is the High level and the second output terminal CK2R is the Low level.

Immediately before time t4, a current I1 flows in a direction shown by a solid line shown in FIG. 21A in a path defined by the power supply voltage VDD, PMOS transistor 84-1, first output terminal CK1R, resistor 91, inductor 93, resistors 94 and 92, NMOS transistor 85-2, and the ground GND.

Immediately after time t4, the control signal C2 goes low, causing the NMOS transistor 84-2 to go off so that the second output terminal CK2R enters the Hi-Z state. This causes a back electromotive force in the inductor 93 with the polarities shown in FIG. 21A, which results in a current I2 shown by a dotted line. The current I2 flows in a path defined by the positive sign of the inductor 93, resistors 94 and 92, diode 84-2*a*, power supply voltage VDD, PMOS transistor 84-1, first output terminal CK1R, resistor 91, and the negative sign of the inductor 93.

Let's focus our attention on the second current path. The cathode of the diode 84-2*a* is connected to the power supply voltage VDD so that the potential of the output terminal CKR2 is higher than that of the power supply voltage VDD by the forward voltage of the diode 84-2*a*. Therefore, the potential of the second clock terminal CK2 is higher than that of the cathode of the diode 84-2*a* by the voltage drop across the resistor 92. As a result, as shown by a dot-dashed line, a current I3 flows in a path defined by the second clock terminal CK2, the anode-gate junction of the self-scanning thyristor 111B-2, diode 130B-2, the gate-cathode junction of the self-scanning thyristor 111B-1, and the ground GND. The gate current that flows through the gate-cathode junction of the self-scanning thyristor 111B-2 serves as a triggering current for the self-scanning thyristor 111B-2 to turn on.

FIG. 21B illustrates the waveform of the signals on the second output terminal CK2R and second clock terminal CK2. When the second output terminal CK2R changes from the High level to the Hi-Z state, the signal on the second clock terminal CK2 will have an abrupt undershoot as depicted at "d," being lower than the ground GND by a voltage Vp.

In a typical design, the power supply voltage VDD is 3.3 V, the forward voltage Vf of the diode 130B-2 is about 1.6 V, and the forward voltage Vag of the anode-gate junction of the self-scanning thyristor 111-2 is about 1.6 V. In order for the current I3 to flow in the dotted-line path, the following relationship must be satisfied.

$$Vf+Vag<VDD+Vp$$

At this moment, if the signal on the second clock terminal CK2 shown in FIG. 21B had no undershoot "d" so that Vp=0 V, the value of Vf+Vag would be as follows:

$$Vf+Vag=1.6\text{ V}+1.6\text{ V}=3.2\text{ V}$$

This implies that Vf+Vag is somewhat lower than the power supply voltage VDD and therefore cannot cause sufficient gate current for the thyristor 111B-2 to turn on.

In contrast, in the third embodiment, the undershoot voltage Vp=0.6 V is produced to satisfy the following relationship.

$$VDD+Vp=3.3\text{ V}+0.6\text{ V}=3.9\text{ V}$$

This indicates that the value of VDD+Vp is greater than Vf+Vag and can cause sufficient trigger current for the self-scanning thyristor 111B-2 to turn on. In addition, the waveform of the signal on the second clock terminal CK2 abruptly rises at "d," which is effective in implementing the high speed turning-on of the self-scanning thyristor 111B-2.

{Modification to Fourth Embodiment}

The light emitting array 200B has a plurality of two-terminal light emitting elements (e.g., LED) 210B-1 to 210B-n. The light emitting elements have anodes connected to the corresponding output terminals Q1 to Q4 of the self-scanning circuit 100B, and cathodes connected to the connector 97-1 via a common terminal IN through which a drive current Iout flows.

The print head of the aforementioned configuration operates as follows:

For example, when the data terminal DA goes low, all of the LEDs connected to the common terminal IN are turned off. Selected LEDs are turned on when the data terminal DA goes high and the scanning circuit 100B selectively sets the cathodes of LEDs to the Low level. Light outputs are produced in accordance with the drive current Iout that flows through the anodes of the LEDs. As described above, the modification to the fourth embodiment operates in much the same way as the third embodiment.

{Effects of Fourth Embodiment and Modification}

The fourth embodiment and its modification provide the following effects.

In contrast, in the fourth embodiment and the modification thereof, the second clock terminal CK2 outputs the second clock to the starting sub scanning circuit 110B-1 through the resistor 150B, so that the scanning circuit 100B starts to scan the light emitting element arrays 200B. This configuration eliminates a start signal, simplifying the circuit configuration. In addition, the RL differentiation circuit 90 differentiates the first and second clock pulses outputted from the first and second output terminals CK1R and CK2R, thereby producing waveforms with undershoot at the portion "d" shown in FIG. 21B. Thus, a single first output terminal CK1R and a single second output terminal CK2R are required for each transfer clock, requiring only half the number of terminals which would otherwise be required in the conventional configuration. In addition, a single RL differentiation circuit 90 and a single inductor 93 are required as shown in FIG. 14. These configurations increase the data transfer speed in the print heads 13 and 13A and reduce the circuit size and hence manufacturing cost.

The print head 13B provides similar effects to those of Effect B of the third embodiment.

The invention may include the following variations.

{Further Modifications}

The third embodiment, fourth embodiment, and modification to the fourth embodiment have been described in terms of light emitting thyristors 210 and 210B and LEDs 210A. The present invention may also be applicable to other configurations in which thyristors are used as switching elements that control the voltage applied to light emitting elements (e.g., organic electroluminescence, OEL). The print heads 13 and 13A are applicable to printers that employ a print head constituted of OEL elements and display devices that have rows and columns of display elements.

The invention may be applied to thyristors that drive display elements disposed in a row or a matrix. The invention may also be applied not only to three-terminal thyristors but also four-terminal thyristors or semiconductor controlled switch (SCS) with first and second gates.

What is claimed is:

1. A driver apparatus for driving a plurality of light emitting elements commonly connected to a common terminal, comprising:

a clock driver configured to output a first clock pulse to a first output terminal and a second clock pulse to a second output terminal, the first clock pulse and the second clock pulse being produced based on a scanning square signal and outputted alternately;

a differentiating circuit formed of an inductor and a resistor, the differentiating circuit differentiating the first clock pulse thereby to produce a first clock and differentiating the second clock pulse to thereby produce a second clock, the first clock and the second clock each having a waveform that is produced by back electromotive force induced across the inductor;

a first clock terminal to which the first clock is outputted from the differentiating circuit;

a second clock terminal to which the second clock is outputted from the differentiating circuit;

a data driver circuit that outputs a data signal to the common terminal in response to an ON/OFF command signal;

a scanning circuit including a plurality of cascaded sub scanning stages which starts to operate in response to a starting signal such that the cascaded sub scanning stages turn on in sequence one at a time, the plurality of cascaded sub scanning stages having an odd-numbered sub scanning stage that turns on in response to the first clock and outputs a drive signal to a corresponding one of the light emitting elements, and an even-numbered sub scanning stage that turns on in response to the second clock and outputs a drive signal to a corresponding one of the light emitting elements, wherein the light emitting elements emit light only when the drive signal and the ON/OFF command signal are fed to the light emitting elements.

2. The driver apparatus according to claim 1, wherein each odd-numbered sub scanning stage includes a three-terminal switch element, the three-terminal switch element including a first terminal connected to a first power supply for supplying a first power supply voltage, a second terminal connected to the first clock terminal, and a third terminal connected to a corresponding odd-numbered light emitting element; and wherein each even-numbered sub scanning stage includes a three-terminal switch element, the three-terminal switch element including a first terminal connected to the first power supply, a second terminal connected to the second clock terminal, and a third terminal connected to a corresponding even-numbered light emitting element.

3. The driver apparatus according to claim 2, wherein the scanning circuit comprises:

a first diode having a cathode connected to a starting one of the sub scanning stages and having an anode to which the start signal is fed; and a second diode having a cathode connected to a following one of adjacent sub scanning stages and an anode connected to a preceding one of the adjacent sub scanning stages, wherein each of the third terminals is connected through a resistor to a second power supply for supplying a second power supply voltage less than the first power supply voltage.

4. The driver apparatus according to claim 2, wherein each of the third terminals is connected through a resistor to a second power supply for supplying a second power supply voltage less than the first power supply voltage.

5. The driver apparatus according to claim 4, wherein the clock driver includes a first buffer and a second buffer, wherein the first buffer includes;

a first switch element connected between the first power supply and the first output terminal, and turning ON and OFF in response to the scanning square signal;

a second switch element connected between the second power supply and the first output terminal, and turning ON and OFF in response to the scanning square signal, wherein the first switch element and the second switch element alternately turn on and off such that when one switches on and the other switches off, so that the first output terminal changes between a high logic level and a low logic level; and a first diode in parallel with the second switch element, the first diode having an anode connected to the second power supply;

wherein the second buffer includes;

a third switch element connected between the first power supply and the second output terminal, and turning ON and OFF in response to the scanning square signal;

a fourth switch element connected between the second power supply and the second output terminal and turning ON and OFF in response to the scanning square signal, wherein the third switch element and the fourth switch element alternately turn ON and OFF such that when one switches on, the other switches off, so that the second output terminal changes between a high logic level and a low logic level; and a second diode in parallel with the fourth switch element, the second diode having an anode connected to the second power supply.

6. The driver apparatus according to claim 5, wherein the first switch element and the third switch element are formed of MOS transistors of a first conductivity type, and configured to switch ON and OFF in response to the scanning square signal;

wherein the second switch element and the fourth switch element are formed of MOS transistors of a second conductivity type, and configured to switch ON and OFF in response to the scanning square signal;

wherein the first diode is a parasitic diode across the MOS transistor of the second switch element; and wherein the second diode is a parasitic diode across the MOS transistor of the fourth switch element.

7. The driver apparatus according to claim 4, wherein the clock driver includes a first three-state buffer and a second three-state buffer, wherein the first three-state buffer includes;

a first switch element connected between the first power supply and the first output terminal, and turning ON and OFF in response to the scanning square signal;

a second switch element connected between the second power supply and the first output terminal, and turning ON and OFF in response to the scanning square signal, the first switch element and the second switch element alternately turning ON and OFF such that when one switches on, the other switches off, so that the first output terminal changes among a high level, a low level, and a high-impedance state; and a first diode in parallel with the second switch element, the first diode having an anode connected to the second power supply;

wherein the second three-state buffer includes;

a third switch element connected between the first power supply and the second output terminal and turning ON and OFF in response to the scanning square signal;

a fourth switch element connected between the second power supply and the second output terminal and turning ON and OFF in response to the scanning square signal, wherein the third switch element and the fourth switch element alternately turn on and off such that when one switches on, the other switches off, so that the second output terminal changes among a high logic level, a low logic level, and a high-impedance state; and a second diode in parallel with the fourth switch element, the second diode having an anode connected to the second power supply.

8. The driver apparatus according to claim 4, wherein the resistor is a first resistor of a plurality of resistors, and the third terminal of sub scanning stages after a starting one of the sub scanning stages is connected to the second power supply through a second resistor.

9. The driver apparatus according to claim 2, wherein the differentiating circuit is connected between the first clock terminal and the second clock terminal.

10. The driver apparatus according to claim 1, wherein each odd-numbered sub scanning stage includes a three-terminal switch element, the three-terminal switch element including a first terminal connected to a first clock terminal, a second terminal connected to a second power supply for supplying a second power supply voltage, and a third terminal connected to a corresponding odd-numbered light emitting element; and wherein each even-numbered sub scanning stage includes a three-terminal switch element, the three-terminal switch element including a first terminal connected to the second clock terminal, a second terminal connected to the second power supply, and a third terminal connected to a corresponding even-numbered light emitting element.

11. The driver apparatus according to claim 10, wherein the scanning circuit comprises:

a first diode having an anode connected to a starting one of the sub scanning stages and having a cathode to which the starting signal is fed; and a second diode having a cathode connected to a preceding one of adjacent sub scanning stages and an anode connected to a following one of the adjacent sub scanning stages, wherein each of the third terminals is connected through a resistor to a first power supply for supplying a first power supply voltage greater than the second power supply voltage.

12. The driver apparatus according to claim 10, wherein each of the third terminals is connected through a resistor to a first power supply for supplying a first power supply voltage greater than the second power supply voltage.

13. The driver apparatus according to claim 12, wherein the clock driver includes a first buffer and a second buffer, wherein the first buffer includes;

a first switch element connected between the first power supply and the first output terminal, and turning ON and OFF in response to the scanning square signal;

a second switch element connected between the second power supply and the first output terminal, and turning ON and OFF in response to the scanning square signal, wherein the first switch element and the second switch element alternately turn on and off such that when one switches on, the other switches off, so that the first output terminal changes between a high logic level and a low logic level; and a first diode in parallel with the second switch element, the first diode having an anode connected to the second power supply;

wherein the second buffer includes;

a third switch element connected between the first power supply and the second output terminal and turning ON and OFF in response to the scanning square signal;

a fourth switch element connected between the second power supply and the second output terminal and turning ON and OFF in response to the scanning square signal, wherein the third switch element and the fourth switch element alternately turn ON and OFF such that when one switches on, the other switches off, so that the second output terminal changes between a high logic level and a low logic level; and a second diode in parallel with the fourth switch element, the second diode having an anode connected to the second power supply.

14. The driver apparatus according to claim 13, wherein the first switch element and the third switch element are formed of MOS transistors of a first conductivity type, and configured to switch ON and OFF in response to the scanning square signal;

wherein the second switch element and the fourth switch element are formed of MOS transistors of a second conductivity type, and configured to switch ON and OFF in response to the scanning square signal;

wherein the first diode is a parasitic diode across the MOS transistor of the second switch element; and wherein the second diode is a parasitic diode across the MOS transistor of the fourth switch element.

15. The driver apparatus according to claim 12, wherein the first clock terminal supplies a power supply voltage and the second power supply supplies a ground potential;

wherein the clock driver includes a first three-state buffer and a second three-state buffer, wherein the first three-state buffer includes;

a first switch element connected between the first power supply and the first output terminal, and turning ON and OFF in response to the scanning square signal;

a second switch element connected between the second power supply and the first output terminal, and turning ON and OFF in response to the scanning square signal, the first switch element and the second switch element alternately turning ON and OFF such that when one switches on, the other switches off, so that the first output terminal changes among a high level, a low level, and a high-impedance state; and a first diode in parallel with the second switch element, the first diode having an anode connected to the second power supply;

wherein the second three-state buffer includes;

a third switch element connected between the first power supply and the second output terminal and turning ON and OFF in response to the scanning square signal;

a fourth switch element connected between the second power supply and the second output terminal and turning ON and OFF in response to the scanning square signal, wherein the third switch element and the fourth switch element alternately turn on and off such that when one switches on, the other switches off, so that the second output terminal changes among a high logic level, a low logic level, and a high-impedance state; and a second diode in parallel with the second switch element, the second diode having an anode connected to the second power supply.

16. The driver apparatus according to claim 12, wherein the resistor is a first resistor of a plurality of resistors, and the third terminal of a starting one of the sub scanning stages is connected to the first power supply through a second resistor.

17. The driver apparatus according to claim 1, wherein the starting signal is the second clock signal fed through a resistor.

18. The driver apparatus according to claim 1 further comprising a circuit for generating the starting signal.

19. The driver apparatus according to claim 18, wherein the starting signal is fed from the circuit to a starting one of the sub scanning stages through a diode.

20. The driver apparatus according to claim 1, wherein the odd-numbered sub scanning stage is a thyristor and even-numbered sub scanning stage is a thyristor.

21. The driver apparatus according to claim 1, wherein the light emitting elements are three-terminal light emitting elements.

22. The driver apparatus according to claim 1, wherein the light emitting elements are light emitting thyristors.

23. The driver apparatus according to claim 1, wherein the light emitting elements are two-terminal light emitting elements.

24. The driver apparatus according to claim 23, wherein the two-terminal light emitting elements are light emitting diodes.

25. A print head incorporating the driver apparatus according to claim 1 and light emitting elements according to claim 1.

26. An image forming apparatus incorporating the print head according to claim 25, comprising:

a photoconductive body; and a charging section that charges a surface of the photoconductive body;

wherein the print head illuminates the charge surface of the photoconductive body to form an electrostatic latent image on the photoconductive body.

27. The driver apparatus according to claim 1, wherein:

the first output terminal and the second output terminal are connected to the first clock terminal and the second clock terminal, respectively; and the inductor is connected between the first clock terminal and the second clock terminal.

28. The driver apparatus according to claim 1, wherein the waveform is either an overshoot waveform or an undershoot waveform.

* * * * *